US005369078A

United States Patent [19]

Eguchi et al.

[11] Patent Number: 5,369,078

[45] Date of Patent: Nov. 29, 1994

[54] THERMAL TRANSFER SHEET

[75] Inventors: Hiroshi Eguchi; Komei Kafuku; Ryohei Takiguchi, all of Tokyo, Japan

[73] Assignee: Dai Nippon Printing Co., Ltd., Japan

[21] Appl. No.: 974,723

[22] Filed: Nov. 13, 1992

[30] Foreign Application Priority Data

| | | | |
|---|---|---|---|
| Nov. 14, 1991 | [JP] | Japan | 3-325058 |
| Nov. 14, 1991 | [JP] | Japan | 3-325060 |
| Jan. 21, 1992 | [JP] | Japan | 4-029042 |
| Jan. 21, 1992 | [JP] | Japan | 4-029043 |
| Jun. 25, 1992 | [JP] | Japan | 4-190257 |
| Sep. 22, 1992 | [JP] | Japan | 4-276811 |

[51] Int. Cl.[5] ..... B41M 5/035; B41M 5/38

[52] U.S. Cl. ..... 503/227; 418/145; 418/913; 418/914

[58] Field of Search ..... 8/471; 428/195, 913, 428/914; 503/227

[56] References Cited

U.S. PATENT DOCUMENTS

| | | | |
|---|---|---|---|
| 4,968,657 | 11/1990 | Gregory et al. | 503/227 |
| 4,985,396 | 1/1991 | Kawakami et al. | 503/227 |

FOREIGN PATENT DOCUMENTS

| | | | |
|---|---|---|---|
| 0217036 | 4/1987 | European Pat. Off. | 503/227 |
| 0258856 | 3/1988 | European Pat. Off. | 503/227 |
| 0270677 | 6/1988 | European Pat. Off. | 503/227 |
| 0318032 | 5/1989 | European Pat. Off. | 503/227 |
| 0323259 | 7/1989 | European Pat. Off. | 503/227 |
| 0365392 | 4/1990 | European Pat. Off. | 503/227 |
| 0416434 | 3/1991 | European Pat. Off. | 503/227 |

OTHER PUBLICATIONS

Patent Abstracts of Japan, vol. 12, No. 84, Mar. 17, 1988.

Database WPIL, Week 8819, Derwent Publications Ltd., London, GB; AN 88-129015 & JP-A-63,071,392 (Matsushita Elec Ind KK) Mar. 31, 1988.

*Primary Examiner*—Bruce Hess

*Attorney, Agent, or Firm*—Parkhurst, Wendel & Rossi

[57] ABSTRACT

A thermal transfer sheet wherein a clear image having a sufficient density is formed in a thermal transfer process using a sublimable dye and wherein the formed image exhibits excellent fastnesses, particularly excellent light fastness.

The thermal transfer sheet includes a base sheet and a dye-containing layer formed on one surface of the base sheet wherein a dye contained in the dye-containing layer includes a mixture of two or more specific dyes.

3 Claims, 4 Drawing Sheets

CHROMATICITY DIAGRAM OF EXAMPLE 384 AND COMPARATIVE EXAMPLE 52

CHARACTERISTIC CURVE OF COMPARATIVE EXAMPLE 52

THERMAL TRANSFER SHEET

BACKGROUND OF THE INVENTION

This invention relates to a thermal transfer sheet, and more particularly to a thermal transfer sheet capable of forming a recording image having excellent color density, clearness, and fastnesses, particularly light fastness.

Heretofore, various thermal transfer processes have been known. Of these, there has been widely used a sublimation transfer process wherein a sublimable dye is used as a recording agent; it is carried on a base sheet such as paper to form a thermal transfer sheet; this thermal transfer sheet is superposed on a transferable material which can be dyed by the sublimable dye, for example, a polyester woven fabric or the like; and a heat energy is applied in the form of a pattern from the back surface of the thermal transfer sheet to transfer the sublimable dye to the transferable material.

Recently, there has been a process for forming various full color images on materials such as paper and plastic films using the thermal transfer process of sublimation type described above. In this case, a thermal head of a printer is used as heating means, multi-color dots such as three-color or four-color dots are transferred to the transferable material by heating for an extremely short period of time, and the full color images of a original are reproduced by the multi-color dots.

The images thus formed are very clear since the colorant used is a dye. Because the transparency is excellent, the images obtained have excellent neutral tint reproducibility and gradation, they are similar to the images obtained by the prior offset printing and gravure printing and high performance images comparable to full color photographic images can be formed.

However, the most important problems of the thermal transfer process described above are inferior color density and light fastness of the formed images.

That is, in the case of high-speed recording, it is required that the impartation of the heat energy be an extremely short period of time of subsecond. Accordingly, the sublimable dye and the transferable material are not sufficiently heated due to such a short period of time and therefore images having a sufficient density cannot be formed.

Accordingly, sublimable dyes having an excellent sublimation property have been developed in order to cope with such a high-speed recording, process. However, the dyes having an excellent sublimation property have generally a small molecular weight and therefore their light fastness is lack in the transferable material after transfer. Thus, the formed images are liable to be faded.

If sublimable dyes having a relatively high molecular weight are used in order to avoid such problems, images having a satisfactory density as described above cannot be obtained since the sublimation rate is inferior in the high-speed recording process as described above.

SUMMARY OF THE INVENTION

An object of the present invention is to provide a thermal transfer sheet wherein clear images having a sufficiently high density is provided in a thermal transfer process using a sublimable dye and wherein formed images exhibit excellent fastnesses, particularly excellent light fastness.

The object described above is achieved by the present invention. That is, the present invention is directed to a thermal transfer sheet comprising a base sheet and a dye-containing layer formed on the one surface of said base sheet wherein a dye included in said dye-containing layer comprises a mixture of two or more specific dyes.

A mixture of at least one dye represented by the following formulae (1) and (2) with at least one dye represented by the following formulae (3) and (4) is suitable as a yellow dye included in said dye-containing layer:

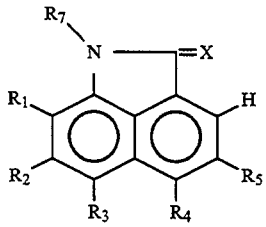

(1)

wherein X represents

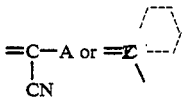

(a five or six-membered ring reaction residue represented by

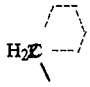

which may have a fused ring); A represents an electron attractive group; Z represents —CO—, —$NR_6$—, —S—, —O— or —NH—; $R_1$ represents a hydrogen atom, $R_6$, a halogen atom, a nitro group, —$OR_6$, —$SR_6$ or an allyl group which may be substituted; $R_2$ represents a hydrogen atom, a halogen atom, —$OR_6$ or —$SR_6$; $R_3$ represents a hydrogen atom, $R_6$, a halogen atom, a nitro group, an allyl group which may be substituted, —$OR_6$, —$SR_6$, a sulfamoyl group, a carbamoyl group, an acyl group, an acylamide group, a sulfonamide group, an ureido group, or —$NR_6R_6$ ($R_6$ may be the same or different); $R_4$ represents a hydrogen atom, a halogen atom, —$OR_6$, —$SR_6$, a cyano group, —$COOR_6$, a carbamoyl group, or a sulfamoyl group; $R_5$ represents a hydrogen atom, a halogen atom, —$OR_6$, or —$SR_6$; $R_6$ represents an alkyl group which may be substituted, an aryl group which may be substituted, a cycloalkyl group which may be substituted, or a heterocyclic ring which may be substituted; and $R_7$ represents a hydrogen atom, —$R_6$ an allyl group which may be substituted, an alkenyl group which may be substituted, a heteroalkenyl group which may be substituted, an arylalkyl group which may be substituted, an alkoxyalkyl group which may be substituted, a oxycarbonylalkyl group which may be substituted, a carboxyalkyl group which may be substituted, a oxycarboxyalkyl group which may be substituted, or a cycloalkylalkyl group which may be substituted; provided that two mutually adjacent substituents $R_1$ through $R_5$ may form a ring;

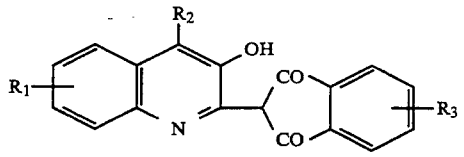

(2)

wherein $R_1$ represents a hydrogen atom, an alkyl group having from 1 to 8 carbon atoms, or a cycloalkyl group; $R_2$ represents a hydrogen atom, a halogen atom, an alkoxy group which may be substituted, an alkylthio group which may be substituted, or an arylthio group which may be substituted; and $R_3$ represents a branched alkyl group having from 3 to 5 carbon atoms, an o-substituted oxycarbonyl group, N-substituted aminocarbonyl group in which the N-substituent may from a ring, or a substituted or unsubstituted heterocyclic ring having at least two atoms selected from the group consisting of a nitrogen atom, an oxygen atom, a sulfur atom and combinations thereof, provided that when $R_1$ is hydrogen, $R_3$ is a branched alkyl group having from 3 to 5 carbon atoms, or a substituted heterocyclic ring having at least two atoms selected from the group consisting of an oxygen atom, a sulfur atom and combinations thereof;

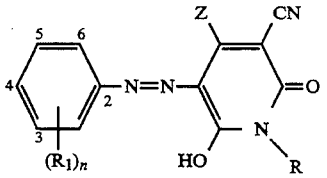

(3)

wherein Z represents an alkyl group which may be substituted, an aryl group which may be substituted, or a heterocyclic aryl group which may be substituted; R represents an alkyl group which may be substituted, a cycloalkyl group which may be substituted, $—R_2$, $—COR_2$, $—OSO_2R_2$, $—CO·OR_2$, $—OR_2$, $—O·COR_2$, $—SO_2R_2$, an aryl group which may be substituted, or a heterocyclic aryl group which may be substituted; $R_1$ represents a hydrogen atom, an alkyl group which may be substituted, an aryl group which may be substituted, a cyano group, a nitro group, a halogen atom, a heterocyclic aryl group, a cycloalkyl group which may be substituted, $—R_2$, $—COR_2$, $—OSO_2R_2$, $—CO·OR_2$, $—OR_2$, $—O·COR_2$, or $—SO_2R_2$ (when n is other than 1, $R_1$ may be the same or different); $R_2$ represents an alkyl group containing at least one group selected from the group consisting of —O—, —O·CO—, —CO·O—, $—SO_2—$, $—OSO_2—$, —NH—, —O·CO·O—, and —OH; and n represents an integer of from 1 to 5;

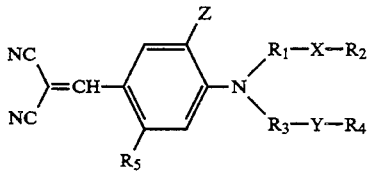

(4)

$R_1$ and $R_3$ represent an alkyl group which may be substituted, a cycloalkyl group which may be substituted, an arylalkyl group which may be substituted, a heterocyclic aryl group which may be substituted, or $—R_6$ ($R_1$ and $R_3$ may be the same or different); X and Y represent a hydrogen atom, a cycloalkyl group which may be substituted, an aryl group which may be substituted, heterocyclic ring which may be substituted, —OH, —CN, $—NO_2$ or $R_6$ (X and Y may be the same or different), $R_2$ and $R_4$ (when X and Y are those other than a hydrogen atom, —OH, —CN and $—NO_2$) represent a hydrogen atom, —OH, —CN, $—NO_2$, an alkyl group which may be substituted, a cycloalkyl group which may be substituted, an aryl group which may be substituted, a heterocyclic ring which may be substituted, or $—R_6$; Z represents an alkyl group which may be substituted and/or may form a ring together with $R_1$, $R_2$, $R_3$, or $R_4$, $—NHCOR_6$, $—NHSO_2R_6$, —CN, $—NO_2$, $R_6$ or $—OR_6$; $R_5$ represents an alkyl group which may; be substituted, —OH, $—R_6$, $—NHCOR_1$, $—OR_1$, $—COR_1$, $—NHSO_2R_1$, or $—CO·OR_1$; and $R_6$ represents an alkyl group interrupted by at least one group selected from the group consisting of —O—, —O·CO—, —CO·O—, $—SO_2—$, $—OSO_2—$, —NH—, —O·CO·O— and combinations thereof.

In order to adjust hue, known yellow dyes, magenta dyes or cyan dyes can also be mixed.

A mixture of at least one anthraquinone dye represented by the following formulae (5) through (8) with at least one polymethine dye represented by the following formula (9) is suitable as a magenta dye included in said dye-containing layer:

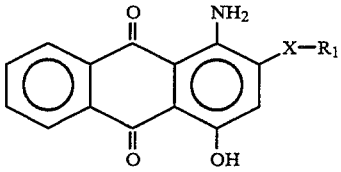

(5)

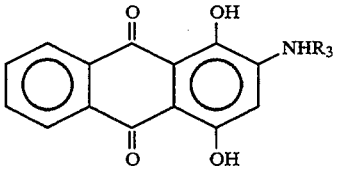

(6)

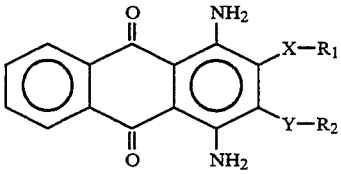

(7)

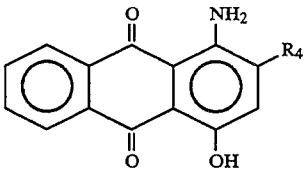

(8)

wherein X and Y represent —S—, —O—, or $—SO_2—$; $R_1$, $R_2$ and $R_3$ represent a substituted or unsubstituted alkyl, cycloalkyl, aryl or allyl group, and $R_4$ represent a halogen atom or a cyano group;

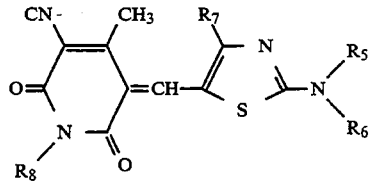

(9)

wherein $R_5$ and $R_6$ represent a substituted or unsubstituted alkyl; $R_7$ represents a substituted or unsubstituted aryl group or a substituted or unsubstituted aromatic heterocyclic group; $R_8$ represents a substituted or unsubstituted alkyl or cycloalkyl group or $NR_9R_{10}$; and $R_9$ and $R_{10}$ represent a substituted or unsubstituted alkylcarbonyl group or a substituted or unsubstituted arylcarbonyl group.

In order to adjust hue, known yellow dyes, magenta dyes or cyan dyes can also be mixed.

A mixture of at least one anthraquinone dye represented by the following formulae (10) through (14) with at least one dye represented by the following formula (15) and (16) is suitable as a cyan dye included in said dye-containing layer:

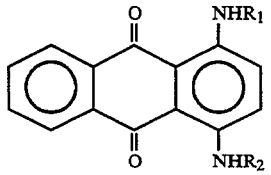

(10)

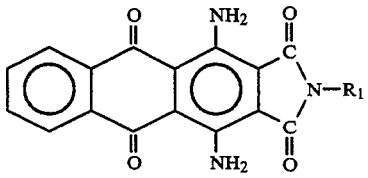

(11)

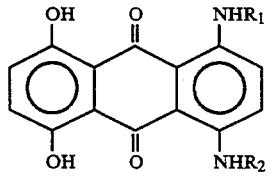

(12)

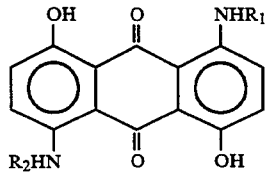

(13)

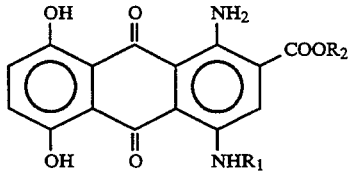

(14)

wherein $R_1$ and $R_2$ represent an alkyl group which may be substituted, a cycloalkyl group which may be substituted, an aryl group which may be substituted, a heterocyclic group which may be substituted, an allyl group which may be substituted, or an arylalkyl group which may be substituted;

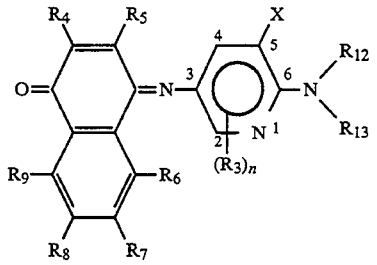

(15)

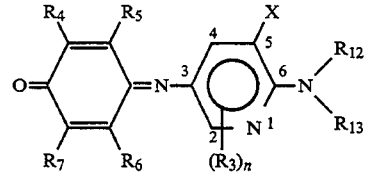

(16)

wherein $R_4$ through $R_9$ represent a hydrogen atom, a halogen atom, a substituted or unsubstituted alkyl, alkoxy, amino, or ureido group, $—CON(R_{10})(R_{11})$, $—CSN(R_{10})(R_{11})$, $—SO_2N(R_{10})(R_{11})$, $—COOR_{10}$, or $—CSOR_{10}$; $R_{10}$ and $R_{11}$ represent a hydrogen atom, a halogen atom, a substituted or unsubstituted alkyl, cycloalkyl, aryl, vinyl, allyl, cycloalkyl or aromatic heterocyclic group; $R_{10}$ and $R_{11}$ may form a ring; $R_{12}$ and $R_{13}$ represent independently a hydrogen atom, a substituted or unsubstituted alkyl, vinyl, allyl, aryl, alkoxyalkyl, aralkyl, alkoxycarbonylalkyl, carboxyalkyl or alkoxycarboxyalkyl group, $R_{12}$ and $R_{13}$ may form a ring and $R_{12}$ or $R_{13}$ may form a ring together with X or Y; $R_3$ represents a hydroxyl group, a halogen atom, a cyano group, a substituted or unsubstituted alkyl, alkylformylamino, alkylsulfonylamino, formylamino, allylformylamino, sulfonylamino, allylsulfonylamino, carbamoyl, sulfamoyl, amino, carboxyl, alkoxy or ureido group; and n represents an integer of from 0 to 3.

In order to adjust hue, known yellow dyes, magenta dyes or cyan dyes can also be mixed.

In a black thermal transfer sheet comprising a base sheet and a dye layer containing a plurality of dyes which is formed on the one surface of said base sheet, a mixture of at least one dye represented by the following general formulae (17) and (18), at least one dye represented by the following general formula (19) and at least one dye represented by the following general formulae (20) and (21) is suitable as dyes included in said dye layer:

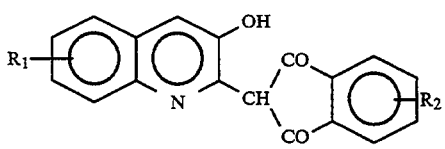

(17)

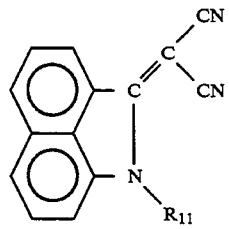

(18)

-continued (19)

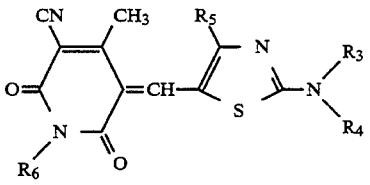

(20)

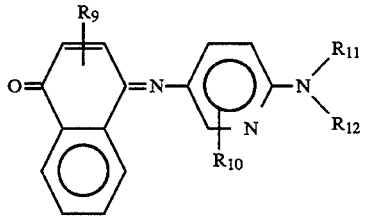

(21)

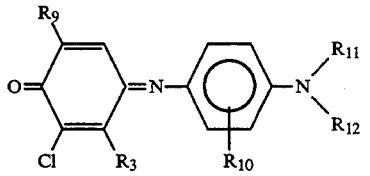

wherein $R_1$ represents a substituted or unsubstituted alkyl or alkoxy group; $R_2$ represents an alkoxy carbonyl, alkylaminocarbonyl, alkoxy, alkoxyalkoxy, alkyl, cycloalkyl or heterocyclic group; $R_3$ and $R_4$ represent a substituted or unsubstituted alkyl group; $R_5$ represents a substituted or unsubstituted aryl group or a substituted or unsubstituted aromatic heterocyclic group; $R_6$ represents a substituted or unsubstituted alkyl or cycloalkyl group or $NR_7R_8$; $R_7$ and $R_8$ represent a substituted or unsubstituted alkylcarbonyl group or a substituted or unsubstituted arylcarbonyl group; $R_{11}$ and $R_{12}$ represent a substituted or unsubstituted alkyl, aryl, cycloalkyl or vinyl group; $R_9$ represents CONHR, NHCOR, $SO_2NHR$, or $NHSO_2R$ in which R represents a substituted or unsubstituted alkyl, cycloalkyl, aryl or aromatic heterocyclic group; and $R_{10}$ represents a substituted or unsubstituted alkyl, alkoxy, alkylcarbonylamino, alkylsulfonylamino, carbamoyl or sulfamoyl group, a hydrogen atom, or a halogen atom.

In a thermal transfer sheet comprising a base sheet and at least three color layers of yellow, magenta, cyan (and like) formed plane successively on the one surface of said base sheet, it is suitable that there be used at least one dye represented by the following formulae (22) and (23) as the yellow dye, at least one dye represented by the following formula (24) as the magenta dye and at least one dye represented by the following formulae (25) and (26) as the cyan dye:

(22)

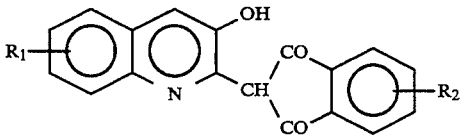

-continued (23)

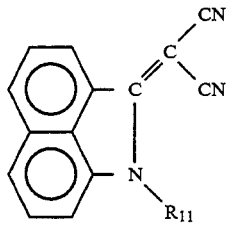

(24)

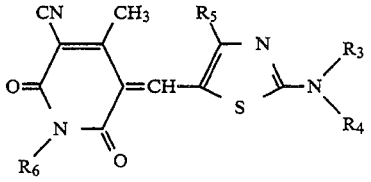

(25)

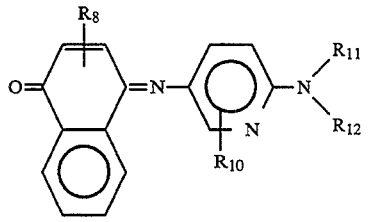

(26)

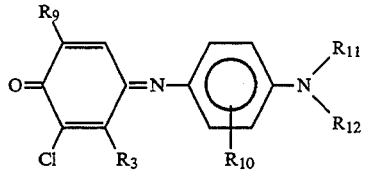

wherein $R_1$ and $R_{10}$ represent a substituted or unsubstituted alkyl or alkoxy group; $R_2$ represents an alkoxycarbonyl, alkylaminocarbonyl, alkoxy, alkoxyalkoxy, alkyl, or cycloalkyl group; $R_3$ and $R_4$ represent a substituted or unsubstituted alkyl group; $R_5$ represents a substituted or unsubstituted aryl group or a substituted or unsubstituted aromatic heterocyclic group; $R_6$ represents a substituted or unsubstituted alkyl or cycloalkyl group or $NR_7R_8$; $R_7$ and $R_8$ represent a substituted or unsubstituted alkylcarbonyl group or a substituted or unsubstituted arylcarbonyl group; $R_{11}$ and $R_{12}$ represent a substituted or unsubstituted alkyl or aryl group; $R_9$ represents CONHR, NHCOR, $SO_2NHR$, or $NHSO_2R$ in which R represents a substituted or unsubstituted alkyl, cycloalkyl, aryl or aromatic heterocyclic group, and $R_{10}$ represents a substituted or unsubstituted alkyl, alkoxy, alkylcarbonylamino, alkylsulfonylamino, carbamoyl or sulfamoyl group, a hydrogen atom, or a halogen atom.

In a further embodiment, in a thermal transfer sheet comprising a base sheet and dye-containing layer formed on the one surface of said base sheet wherein dyes included in the dye-containing layer are a mixture of at least two dyes, it is suitable that there be used a mixture of at least one dye represented by the following formulae (27) with at least one dye represented by the following formula (28) as cyan dyes included in said dye-containing layer:

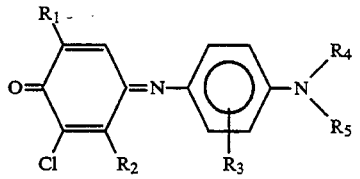

(27)

wherein $R_1$ represents CONHR, NHCOR, $SO_2NHR$ or $NHSO_2R$ in which R represents a substituted or unsubstituted alkyl, cycloalkyl, aryl, or heterocyclic group; $R_2$ represents a substituted or unsubstituted alkyl group; $R_3$ represents an alkyl or alkoxy group; and $R_4$ and $R_5$ represent a substituted or unsubstituted alkyl or alkoxy group; and

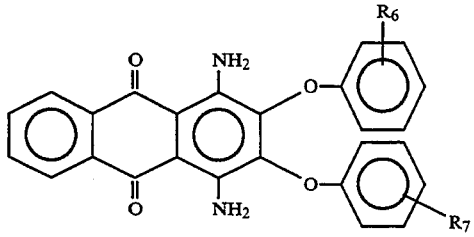

(28)

wherein $R_6$ and $R_7$ represent a hydrogen atom, a halogen atom, or a substituted or unsubstituted alkyl group.

In order to adjust hue, the prior known yellow dyes, magenta dyes or cyan dyes may be mixed.

DETAILED DESCRIPTION OF THE INVENTION

Figure 1:
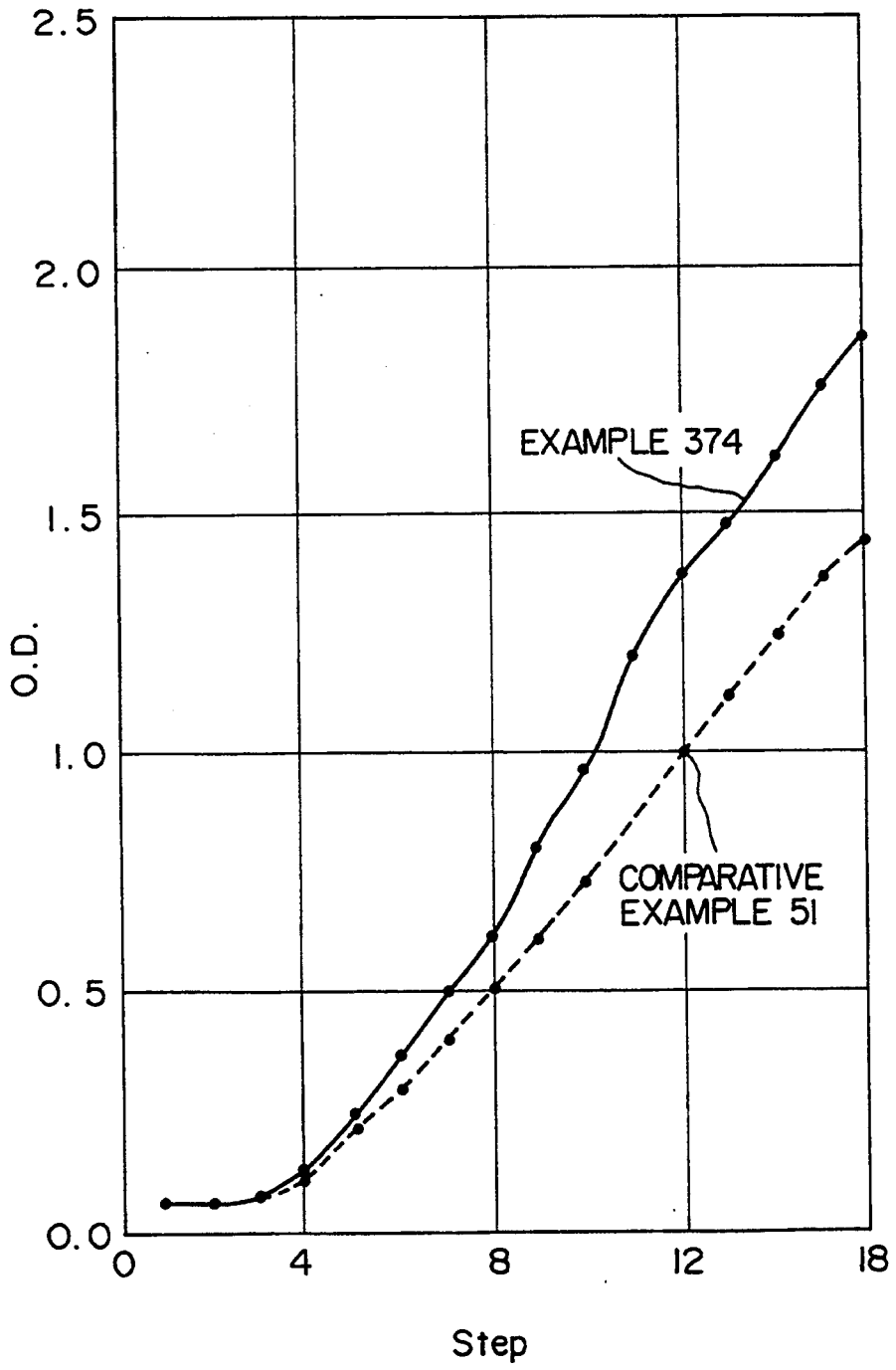
FIG. 1 is a view showing characteristic curves of Example 382 and Comparative Example 51.

Dyes of the formulae (1) through (4) suitable for use in the present invention are shown in the following Tables 1 through 8 by expressing them by their substituents:

Dye 1-1:

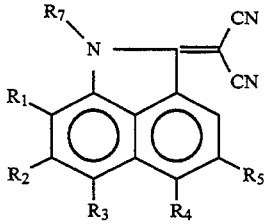

Dye 1-2:

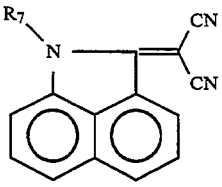

Dye 1-3:

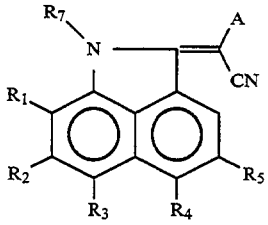

Dye 1-4:

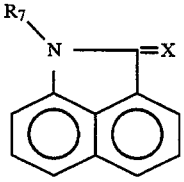

Dye 1-5:

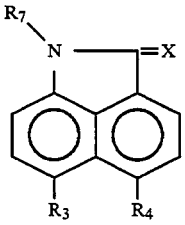

TABLE 1

Dye 1-1

| No | $R_1$ | $R_2$ | $R_3$ | $R_4$ | $R_5$ | $R_7$ |
|---|---|---|---|---|---|---|
| 1 | —H | —H | —H | —H | —H | $—C_4H_9$ |
| 2 | —H | —H | —H | —H | —H | $—C_8H_{17}$ |
| 3 | —H | —H | —H | —H | —H | $—C_{10}H_{21}$ |
| 4 | —H | —H | —H | —H | —H | $—C_2H_4Ph$ |
| 5 | $—CH_3$ | —H | $—CH_3$ | —H | —H | $—C_4H_9$ |
| 6 | —Cl | —H | —H | —H | —H | $—C_4H_9$ |
| 7 | $—NO_2$ | —H | —H | —H | —H | $—C_4H_9$ |
| 8 | $—CH_2CH{=}CH_2$ | —H | —H | —H | —H | $—C_4H_9$ |
| 9 | —SPh | —H | —H | —H | —H | $—C_4H_9$ |
| 10 | $—SC_2H_5$ | —H | —H | —H | —H | $—C_4H_9$ |
| 11 | $—OC_2H_5$ | —H | $—CH_3$ | —H | —H | $—C_4H_9$ |
| 12 | —H | —Cl | —Cl | —H | —H | $—C_4H_9$ |
| 13 | —H | —SPh | —SPh | —H | —H | $—C_4H_9$ |
| 14 | —H | $—OC_2H_5$ | —H | —H | —Cl | $—C_4H_9$ |

TABLE 1-continued

| No | $R_1$ | $R_2$ | $R_3$ | Dye 1-1 $R_4$ | $R_5$ | $R_7$ |
|---|---|---|---|---|---|---|
| 15 | —H | —H | —H | —H | —H | —$C_4H_8OH$ |
| 16 | —H | —H | —H | —H | —H | —$C_6H_{12}OH$ |
| 17 | —H | —H | —H | —H | —H | —$C_8H_{16}OH$ |
| 18 | —H | —H | —H | —H | —H | —$C_{10}H_{22}OH$ |
| 19 | —H | —H | —Ph | —H | —H | —$C_4H_9$ |
| 20 | —H | —H | 2-pyridyl- | —H | —H | —$C_4H_9$ |
| 21 | —H | —H | —$CH_2Ph$ | —H | —H | —$C_4H_9$ |
| 22 | —H | —H | cyclohexyl- | —H | —H | —$C_4H_9$ |
| 23 | —H | —H | 2-thienyl- | —H | —H | —$C_4H_9$ |
| 24 | —OPh | —H | —H | —$COOC_2H_5$ | —H | —Ph |
| 25 | —H | —H | —H | —H | —H | —$(C_2H_4O)_2C_4H_9$ |
| 26 | —H | —H | —H | —H | —Cl | —$C_2H_4OPh$ |
| 27 | —H | —H | —$SC_2H_5$ | —H | —H | —$C_2H_4OCOCH_3$ |
| 28 | —H | —H | (2-pyridyl) —S— | —H | —H | —$C_2H_4COOC_2H_5$ |
| 29 | —H | —H | —$NO_2$ | —H | —H | —$C_2H_4OCOPh$ |
| 30 | —H | —H | —$SO_2NHCH_3$ | —H | —H | —$C_2H_4OCOOPh$ |
| 31 | —H | —H | —Cl | —Cl | —H | —$(C_2H_4O)_2C_2H_5$ |
| 32 | —H | —H | —$CH_2CH{=}CH_2$ | —H | —H | —$C_4H_9$ |
| 33 | —H | —H | —$CONHCH_3$ | —H | —H | —$C_4H_9$ |
| 34 | —H | —H | —CONHPh | —H | —H | —$C_4H_9$ |
| 35 | —H | —H | —$COCH_3$ | —H | —H | —$C_4H_9$ |
| 36 | —H | —H | —COPh | —H | —H | —$C_4H_9$ |
| 37 | —H | —H | —$NHCOCH_3$ | —H | —H | —$C_4H_9$ |
| 38 | —H | —H | —$NHSO_2CH_3$ | —H | —H | —$C_4H_9$ |
| 39 | —H | —H | —$NHCONHCH_3$ | —H | —H | —$C_4H_9$ |
| 40 | —H | —H | —$N(CH_3)_2$ | —H | —H | —$C_4H_9$ |
| 41 | —H | —H | —$N(CH_3)C_2H_4Ph$ | —H | —H | —$C_4H_9$ |
| 42 | cyclohexyl —O— | —H | —H | —H | —H | —$C_4H_9$ |
| 43 | (2-furyl) —O— | —H | —H | —H | —H | —$C_4H_9$ |
| 44 | —H | cyclohexyl —S— | —H | —H | —H | —$C_4H_9$ |
| 45 | —H | (2-pyridyl) —S— | —H | —H | —H | —$C_4H_9$ |
| 46 | —H | —$SC_2H_5$ | —H | —H | —H | —$C_4H_9$ |
| 47 | —H | —OPh | —H | —H | —H | —$C_4H_9$ |
| 48 | —H | (2-pyridyl) —O— | —H | —H | —H | —$C_4H_9$ |
| 49 | —H | —H | —$OC_2H_5$ | —H | —H | —$C_4H_9$ |
| 50 | —H | —H | —OPh | —H | —H | —$C_4H_9$ |
| 51 | —H | —H | cyclohexyl-O— | —H | —H | —$C_4H_9$ |
| 52 | —H | —H | (2-pyridyl)-O— | —H | —H | —$C_4H_9$ |
| 53 | —H | —H | cyclohexyl-S— | —H | —H | —$C_4H_9$ |
| 54 | —H | —H | (2-pyridyl)-S— | —H | —H | —$C_4H_9$ |
| 55 | —H | —H | —H | —$OC_2H_5$ | —H | —$C_4H_9$ |
| 56 | —H | —H | —H | —OPh | —H | —$C_4H_9$ |
| 57 | —H | —H | —H | —$SC_2H_5$ | —H | —$C_4H_9$ |
| 58 | —H | —H | —H | —SPh | —H | —$C_4H_9$ |
| 59 | —H | —H | —H | —CN | —H | —$C_4H_9$ |
| 60 | —H | —H | —H | —$CONHCH_3$ | —H | —$C_4H_9$ |
| 61 | —H | —H | —H | —$SO_2NHCH_3$ | —H | —$C_4H_9$ |
| 62 | —H | —H | —H | (2-pyridyl)-S— | —H | —$C_4H_9$ |
| 63 | —H | —H | —H | cyclohexyl-S— | —H | —$C_4H_9$ |
| 64 | —H | —H | —H | (2-furyl)-O— | —H | —$C_4H_9$ |
| 65 | —H | —H | —H | cyclohexyl-O— | —H | —$C_4H_9$ |
| 66 | —H | —H | —H | —H | —$OC_2H_5$ | —$C_4H_9$ |
| 67 | —H | —H | —H | —H | —OPh | —$C_4H_9$ |
| 68 | —H | —H | —H | —H | cyclohexyl-O— | —$C_4H_9$ |
| 69 | —H | —H | —H | —H | (2-pyridyl)-O— | —$C_4H_9$ |
| 70 | —H | —H | —H | —H | —$SC_2H_5$ | —$C_4H_9$ |
| 71 | —H | —H | —H | —H | —SPh | —$C_4H_9$ |
| 72 | —H | —H | —H | —H | cyclohexyl-S— | —$C_4H_9$ |
| 73 | —H | —H | —H | —H | (2-pyridyl)-O— | —$C_4H_9$ |
| 74 | —H | —H | —$CH{=}C(CN)_2$ | —H | —H | —$C_2H_5$ |
| 75 | —H | —H | —H | —H | —H | —$C_2H_5$ |
| 76 | —H | —H | —H | —H | —$OCH_3$ | —$C_4H_9$ |
| 77 | —H | —H | -t-$C_4H_9$ | —H | —H | —$C_2H_5$ |
| 78 | —H | —H | —H | —H | —$OCH_2Ph$ | —$C_2H_5$ |

TABLE 2

| No | Dye 1-2 $R_7$ |
|---|---|
| 1 | —$(C_2H_4O)_3C_2H_5$ |
| 2 | -iso-$C_3H_7$ |
| 3 | cyclohexyl- |

TABLE 2-continued

| No | Dye 1-2 $R_7$ |
|---|---|
| 4 | 2,4-dichlorobenzyl- |
| 5 | 2-pyridyl- |
| 6 | 2-(6-methylpyridyl)- |

TABLE 2-continued

| Dye 1-2 | |
|---|---|
| No | $R_7$ |
| 7 | (2-pyridyl)methyl- |
| 8 | 2,4,6-trichlorobenzyl- |
| 9 | 4-ethoxycarbonylbenzyl- |
| 10 | 2-ethoxycarbonylbenzyl- |
| 11 | $—C_2H_4CN$ |
| 12 | (2-pyridyl)ethyl- |
| 13 | 2-chlorophenyl- |
| 14 | 4-chlorophenyl- |
| 15 | 2,4-dichlorophenyl- |
| 16 | 4-hydroxyphenetyl- |
| 17 | 2-methylphenetyl- |
| 18 | 3-methylphenetyl- |
| 19 | 4-methylphenetyl- |
| 20 | $CH_2COOCH_2COOC_2H_6$ |
| 21 | $—CH_2COOCH_2Ph$ |
| 22 | 4-ethoxycarbonylphenoxycarbonylmethyl- |
| 23 | 4-cyclohexyloxycarbonylphenoxycarbonylmethyl- |
| 24 | 4-cyclohexylphenoxycarbonylmethyl- |
| 25 | $—CH_2CONHC_6H_{13}$ |
| 26 | $—CH_2SO_2NHC_6H_{13}$ |
| 27 | 4-(2-hydroxyethyl)benzyl- |
| 28 | 4-[2-(2-hydroxyethoxy)ethyl]benzyl- |
| 29 | 2-[2-(2-hydroxyethoxy)ethyl]benzyl- |
| 30 | 3-[4-(2-hydroxyetyl)phenoxy]ethoxyethyl- |
| 31 | 4-[2-[2-(2-hydroxyethoxy)ethyl]phenyl]butyl- |
| 32 | 3-[4-[2-(2-hydroxyethoxy)ethyl]phenoxycarbonyl propyl- |
| 33 | 4-(ethoxycarbonylmethoxycarbonyl)phenetyl- |
| 34 | 2-[4-(3-ethoxycarbonylpropoxycarbonyl)phenoxy]ethyl- |
| 35 | 4-[2-[2-(2-hydroxyethoxy)ethoxy]ethyl] phenoxycarbonylmethyl- |
| 36 | 2-[2-[2-(2-hydroxyethoxy)ethoxy]ethyl] phenoxycarbonylmethyl- |
| 37 | 4-hyroxybenzyl- |
| 38 | 2-hyroxybenzyl- |
| 39 | 4-hydroxycarbonylbenzyl- |
| 40 | 4-isopropylbenzyl- |
| 41 | 4-(4-hydroxybutyl)benzyl- |
| 42 | 4-dibutylaminobenzyl- |
| 43 | 4-(2-ethoxycarbonylethoxycarbonyl)benzyl- |
| 44 | $—C_3H_6OCOCH_3$ |
| 45 | $—C_3H_6OCOOCH_3$ |
| 46 | $—C_3H_6OCOOPh$ |
| 47 | $—C_3H_6OCOC_3H_7$ |
| 48 | $—C_3H_6OCOC_4H_9$ |
| 49 | $—C_3H_6OCOOCH_3$ |
| 50 | $—C_3H_6OCOOC_3H_7$ |
| 51 | $—C_4H_8OCOCH_3$ |
| 52 | $—C_4H_8OCOC_5H_{11}$ |
| 53 | $—C_4H_8COOCH_3$ |
| 54 | $—C_4H_8COOC_3H_7$ |
| 55 | $—C_3H_6OCOC_3H_7$-iso |
| 56 | $—C_4H_8OCOOCH_3$ |
| 57 | $—C_4H_8OCOOPh$ |
| 58 | $—C_6H_{12}OCOCH_3$ |
| 59 | $—C_6H_{12}COOCH_3$ |
| 60 | $—C_4H_8COOC_4H_9$-sec |
| 61 | $—C_6H_{12}COOC_3H_7$ |
| 62 | $—C_5H_{10}OH$ |
| 63 | $—C_5H_{10}OCOCH_3$ |
| 64 | $—C_5H_{10}COOCH_3$ |
| 65 | $—C_3H_6OCOC_4H_9$-sec |
| 66 | $—C_3H_6OCOC_2H_5$ |
| 67 | $—C_4H_8OCOC_2H_5$ |
| 68 | $—C_6H_{12}COOC_2H_5$ |
| 69 | 4-(3-piperidyl)butyl- |
| 70 | 4-(4-piperidylcarboxy)butyl- |
| 71 | 4-(1-piperazynyloxycarboxy)butyl- |
| 72 | 4-(2-piperazynyloxycarboxy)butyl- |
| 73 | 4-(morphoinylcarboxy)butyl- |
| 74 | 4-(2-thienyloxy)butyl- |
| 75 | 5-[5-(3-methyl-1-hexene)carboxy]pentyl- |
| 76 | 4-(3-pyranyloxycarboxy)butyl- |
| 77 | 6-(6-bicyclo[3.2.1.]octoxy)hexyl- |

TABLE 3

| Dye 1-3 | | | | | | | |
|---|---|---|---|---|---|---|---|
| No | $R^1$ | $R^2$ | $R^3$ | $R_4$ | $R_5$ | $R_7$ | A |
| 1 | —H | —H | —H | —H | —H | $—C_2H_5$ | $—CONHC_2H_5$ |
| 2 | —H | —H | —H | —H | —H | $—C_2H_5$ | 2-thiazolyl- |
| 3 | —H | —H | —H | —H | —H | $—C_2H_5$ | 2-pyridyl- |
| 4 | —H | —H | —H | —H | —H | $—C_2H_5$ | 2-benzoxazolyl- |
| 5 | —H | —H | —H | —H | —H | $—C_2H_5$ | 2-benzothiazolyl- |
| 6 | —H | —H | —H | —H | —H | $—C_2H_5$ | 3-ethyl-2-benzimidazolyl- |
| 7 | —H | —H | —H | —H | —H | $—C_2H_5$ | 3,3-dimethyl-3H-indol-2-yl- |
| 8 | —H | —H | —SPh | —H | —H | $—C_4H_8OH$ | $—CONHC_2H_5$ |
| 9 | —H | —H | $—CH_3$ | —H | —H | $—C_4H_8OH$ | $—CONHC_2H_5$ |
| 10 | —H | —H | —H | —H | —H | $—C_4H_8OH$ | 3-ethyl-4,5-dicyano-2-imidazolyl- |
| 11 | —H | —H | —H | —H | —H | $—C_4H_8OH$ | 5-(4-ethyl-3-cyano-1,2,4-triazolyl)- |
| 12 | —H | —H | —H | —H | —H | $—C_4H_8OH$ | 2-(5-phenyl-1,3,4-oxadiazolyl)- |
| 13 | —H | —H | —H | —H | —Cl | $—C_4H_8OH$ | 2-(5-phenyl-1,3,4-oxadiazolyl)- |
| 14 | —H | —H | —H | $—CONHC_2H_4OCH_3$ | —H | $—C_4H_8OH$ | 2-benzothiazolyl- |

TABLE 4

| Dye 1-4 | | |
|---|---|---|
| No | $R_7$ | X |
| 1 | $—C_8H_{16}OH$ | 1-phenyl-3-methyl-pyrazolin-5-one-4-ylindene- |
| 2 | $—C_8H_{16}OH$ | 1-phenyl-3-dimethylamino-pyrazolin-5-one-4-ylindene- |
| 3 | $—C_8H_{16}OH$ | 1,2-diphenyl-pyrazolidine-3,5-dione-4-ylindene- |
| 4 | $—C_8H_{16}OH$ | 1-butyl-3,3-dimethyl-2-indolinylidene- |
| 5 | $—C_8H_{16}OH$ | 3-ethyl-2-benzoxazolinylidene- |
| 6 | $—C_8H_{16}OH$ | 3-ethyl-2-benzothiazolinylidene- |
| 7 | $—C_8H_{16}OH$ | 4,6-diphenyl-2H-pyran-2-ylindene- |
| 8 | $—C_8H_{16}OH$ | 3-methyl-5-phenyl-2-oxadiazolinylidene- |
| 9 | $—C_8H_{16}OH$ | 3-methyl-5-phenyl-2-thiadiazolinylidene- |
| 10 | $—C_8H_{16}OH$ | 3-ethyl-4,5-dicyano-2-thiazolinylidene- |
| 11 | $—C_8H_{16}OH$ | 1,3-diethyl-2-benzimidazolinylidene- |
| 12 | $—C_8H_{16}OH$ | 1-butyl-2-pyridinylidene- |
| 13 | $—C_8H_{16}OH$ | 2-phenyl-thiazolin-4-one-5-ylindene- |
| 14 | $—C_8H_{16}OH$ | 2-diethylamino-thiazolin-4-one-5-ylindene- |
| 15 | $—C_8H_{16}OH$ | 1-butyl-3-phenyl-imidazolidine-2-thion-4-one-5-ylindene- |
| 16 | $—C_8H_{16}OH$ | benzo-[b]-thien-3-one-2-ylindene- |
| 17 | $—C_8H_{16}OH$ | 3-phenyl-thiazolidine-2-thion-4-one-5-ylindene- |
| 18 | $—C_8H_{16}OH$ | 3-phenyl-thiazolidine-2,4-dione-5-ylindene- |
| 19 | $—C_8H_{16}OH$ | 3-phenyl-oxazolidine-2-thion-4-one-5-indene- |
| 20 | $—C_8H_{16}OH$ | 1,3-diphenyl-hexahydropyrimidine-2,4,6-trione-5-ylindene |
| 21 | $—C_8H_{16}OH$ | 2H-indene-1,3-dione-2-2-indene- |

TABLE 4-continued

Dye 1-4

| No | $R_7$ | X |
|---|---|---|
| 22 | $-C_8H_{16}OH$ | 1-phenyl-4-pyridinylidene- |

TABLE 5

Dye 1-5

| No | $R_3$ | $R_4$ | $R_7$ | X |
|---|---|---|---|---|
| 1 | —H | $-CONHCH_3$ | $-C_8H_{17}$ | 1-phenyl-3-methyl-pyrazolin-5-one-4-ylindene- |
| 2 | —SPh | —H | $-C_8H_{16}OH$ | 1-phenyl-3-dimethylamino-pyrazolin-5-one-4-ylindene |
| 3 | —H | $-COOC_2H_4OC_2H_5$ | $-C_8H_{16}OH$ | 1-phenyl-3-dimethylamino-pyrazolin-5-one-4-ylindene |
| 4 | —Cl | —H | $-C_8H_{16}OH$ | 1,2-diphenyl-pyrazolidine-3,5-dione-4-ylindene- |
| 5 | —H | —Cl | $-C_8H_{16}OH$ | 1,2-diphenyl-pyrazolidine-3,5-dione-4-ylindene- |
| 6 | —H | —SPh | $-C_8H_{16}OH$ | 1-phenyl-3-methyl-pyrazolin-5-one-4-ylindene- |

TABLE 6

Dye 2

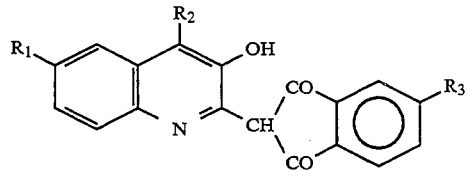

| No | $R_1$ | $R_2$ | $R_3$ |
|---|---|---|---|
| 1 | $-isoC_3H_7$ | —H | $-CON(n\text{-}C_4H_9)_2$ |
| 2 | $-nC_4H_9$ | —H | $-COOCH_2COOC_4H_9(n)$ |
| 3 | —H | 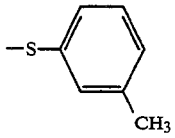 | —H |
| 4 | 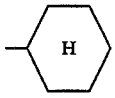 | —H | $-COOC_2H_5$ |
| 5 | $-isoC_3H_7$ | —H | 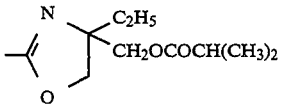 |

TABLE 7

Dye 3

| No | Z | R | $4R_2$ |
|---|---|---|---|
| 1 | $-CH_3$ | $-C_2H_5$ | —H |
| 2 | $-CH_3$ | $-C_3H_7(n)$ | —H |
| 3 | $-CH_3$ | $-C_4H_9(n)$ | —H |
| 4 | $-CH_3$ | $-C_2H_4OCH_3$ | —H |
| 5 | $-CH_3$ | $-C_4H_9(n)$ | $-CH_3$ |
| 6 | $-CH_3$ | $-CH_3$ | $-C_2H_5$ |
| 7 | $-CH_3$ | $-CH_3$ | $-OC_2H_5$ |
| 8 | $-CH_3$ | $-CH_3$ | —Cl |
| 9 | $-CH_3$ | $-CH_3$ | —F |
| 10 | $-CH_3$ | $-CH_2OH$ | —H |
| 11 | $-CH_3$ | 4-hydroxymethylcyclohexylmethyl- | —H |
| 12 | $-CH_3$ | $-CH_2CH(CH_3)OH$ | —H |
| 13 | $-CH_3$ | $-(CH_2)_4OH$ | —H |
| 14 | $-CH_3$ | $-CH_2CH(CH_3)C_2H_4OH$ | $-CH_3$ |
| 15 | $-CH_3$ | $-C_2H_4OC_2H_4OH$ | —Cl |
| 16 | $-CH_3$ | $-C_2H_4CN$ | —H |
| 17 | $-CH_3$ | —Ph | $-CH_3$ |
| 18 | $-CH_3$ | 2-pyridyl- | $-CF_3$ |
| 19 | $-CH_3$ | 2-(6-methyl)pyridyl- | —CN |
| 20 | $-CH_3$ | m-toluyl- | $-NO_2$ |

TABLE 7-continued

| No | Z | R | 4R2 |
|---|---|---|---|
| | | Dye 3 | |
| 21 | —$CH_3$ | P-toluyl- | —Cl |
| 22 | —$CH_3$ | cyclohexyl- | —CN |
| 23 | —$CH_3$ | —$C_2H_4OCOCH_3$ | —$CO_2CH_2CO_2C_2H_5$ |
| 24 | —$CH_3$ | —$C_4H_8COOC_2H_5$ | cyclohexyl- |
| 25 | —$CH_3$ | —$C_2H_4NHSO_2CH_3$ | —$COOC_2H_5$ |
| 26 | —$CH_3$ | —$C_2H_4OCOOCH_3$ | —$OCOCH_3$ |
| 27 | —$CH_3$ | —$C_2H_4NHCOCH_3$ | 4-acetoxyphehyl- |
| 28 | —$CH_3$ | —$C_4H_8OCH_3$ | —Ph |
| 29 | —$CH_3$ | —$C_4H_8OCOPh$ | 4-ethoxycarbonylphenyl- |
| 30 | —$CH_3$ | —$C_4H_8OCOOPh$ | —H |
| 31 | —$C_2H_5$ | —$C_4H_8CONHCH_3$ | acetyl- |
| 32 | —$C_2H_5$ | —$C_4H_9$(n) | —$OC_2H_5$ |
| 33 | —$C_2H_5$ | —$C_4H_9$(n) | 2-hyroxyethyl- |
| 34 | —$C_2H_5$ | —$C_4H_9$(n) | —$CO_2CH_2CO_2C_2H_5$ |
| 35 | —$C_2H_5$ | —$C_4H_9$(n) | —Cl |
| 36 | —Ph | —$C_4H_9$(n) | —$CH_3$ |
| 37 | —Ph | —$C_2H_4COOC_2H_5$ | cyclohexyl- |
| 38 | —Ph | —$C_4H_9$(n) | —$C_6H_{12}OH$ |
| 39 | —Ph | —$C_2H_4OC_2H_4OC_2H_5$ | —$CH_2CO_2CH_2CO_2C_2H_5$ |
| 40 | —$CH_3$ | —$C_4H_9$(n) | cyclohexyl- |
| 41 | —$CH_3$ | —$C_4H_9$(n) | cyclohexyloxycarbonylmethyl- |
| 42 | —$CH_3$ | —$C_4H_9$(n) | cyclohexylmethyl- |
| 43 | —$CH_3$ | —$C_4H_9$(n) | —$SO_2CH_3$ |
| 44 | —$CH_3$ | —$CH_2Ph$ | —$CH_2CO_2CH_2CO_2C_2H_5$ |
| 45 | —$CH_3$ | —$C_4H_9$(n) | —$CO_2CH_2CO_2C_4H_9$ |
| 46 | —$CH_3$ | —$C_4H_9$(n) | cyclohexylcarboxymethyl- |
| 47 | —$CH_3$ | —$C_4H_9$(n) | —$CO_2CH_2CO_2C_2H_5$ |
| 48 | —$CH_3$ | —$C_3H_6OCH_3$ | —$OSO_2CH_3$ |
| 49 | —$CH_3$ | —$C_2H_4OC_2H_4OC_2H_5$ | 4-cyclohexylphenyl- |
| 50 | —$CH_3$ | —$C_3H_6OCH_3$ | —$CH_2Ph$ |
| 51 | —$CH_3$ | —$C_2H_4OC_2H_4OC_2H_5$ | —$C_4H_9$(n) |
| 52 | —$CH_3$ | —$C_3H_6OC_2H_5$ | 2-hydroxyethyl- |
| 53 | —$CH_3$ | —$C_4H_9$(n) | —$N(C_4H_9)_2$ |
| 54 | —$CH_3$ | —$C_3H_6OCH_3$ | —$CON(C_4H_9)_2$ |
| 55 | —$CH_3$ | —$C_2H_4OC_2H_4OCOCH_3$ | —$CH_3$ |
| 56 | —$CH_3$ | —$C_4H_9$(n) | 2-$CH_3$, 4-$CH_3$ |
| 57 | —$CH_3$ | —$C_4H_9$(n) | 2-Cl, 4-Cl |
| 58 | —$CH_3$ | —$C_4H_9$(n) | 3-Cl |
| 59 | —$CH_3$ | —$C_4H_9$(n) | 3-F |

TABLE 8

| No | Z | $R_5$ | —$R_2$—$R_2$ | —$R_3$—X—$R_4$ |
|---|---|---|---|---|
| | | | Dye of the formula (4) | |
| 1 | —H | —H | —$C_2H_5$ | —$C_2H_5$ |
| 2 | —H | —$CH_3$ | —$C_2H_5$ | —$C_2H_5$ |
| 3 | —H | —H | —$C_2H_5$ | —$C_4H_9$(n) |
| 4 | —H | —$CH_3$ | —$C_2H_5$ | —$C_4H_9$(n) |
| 5 | —H | —$CH_3$ | —$C_2H_5$ | —$C_2H_4CO_2CH_3$ |
| 6 | —H | —$CH_3$ | —$C_2H_4OCOCH_3$ | —$C_2H_4OCOCH_3$ |
| 7 | —H | —$CH_3$ | —$C_2H_4OCH_3$ | —$C_2H_4OCH_3$ |
| 8 | —H | —$CH_3$ | —$C_2H_4CO_2CH_3$ | —$C_2H_4CO_2CH_3$ |
| 9 | —H | —$CH_3$ | —$C_2H_5$ | —$C_2H_4OCONHC_3H_7$ |
| 10 | —H | —$CH_3$ | —$C_2H_5$ | —$C_2H_4OCONHC_2H_5$ |
| 11 | —H | —$CH_3$ | —$C_2H_5$ | —$C_2H_4OCONHC_4H_9$ |
| 12 | —H | —$CH_3$ | —$C_2H_5$ | 2-cyclohexylaminocarboxyethyl- |
| 13 | —$CH_3$ | —$CH_3$ | —$C_2H_5$ | —$C_2H_5$ |
| 14 | —$OC_2H_5$ | —$CH_3$ | —$C_2H_5$ | —$C_2H_5$ |
| 15 | —H | —$NHCOCH_3$ | —$C_2H_5$ | —$C_2H_5$ |
| 16 | —H | —$NHC_2H_4O$ $C_2H_4OH$ | —$C_2H_4OCH_3$ | —$C_2H_4OCH_3$ |
| 17 | —H | —NHCOO $C_2H_4OCH_3$ | —$C_2H_5$ —$C_2H_5$ | —$C_2H_5$ |
| 18 | —H | —OH | —$C_2H_5$ | —$C_2H_4CN$ |
| 19 | —H | —$NHSO_2CH_3$ | —$C_2H_5$ | —$C_2H_5OH$ |
| 20 | —H | —$COOCH_3$ | —$C_2H_5$ | —$C_2H_5$ |
| 21 | —Cl | —$CH_3$ | —$C_2H_5$ | —$C_2H_5$ |
| 22 | —H | —$CH_3$ | —$C_2H_5$ | 4-cyclohexyloxybenzyl- |
| 23 | —H | —$OCH_3$ | —$C_2H_5$ | —$C_2H_5$ |
| 24 | —H | —$CH_3$ | —$C_2H_5$ | —$C_2H_4OCOOC_4H_9$ |
| 25 | —H | —$CH_3$ | —$C_2H_5$ | 2-phenoxycarboxyethyl- |
| 26 | —H | —$CH_3$ | —$C_2H_5$ | —$CH_2CO_2CH_2CO_2C_2H_5$ |
| 27 | —H | —$CH_3$ | —$C_2H_5$ | 2-(2-cyclohexyloxythoxycarbonyl) ethyl- |
| 28 | —H | —$CH_3$ | —$C_2H_5$ | 2-(4-cyclohexylphenoxy)ethyl- |
| 29 | —H | —$CH_3$ | —$C_2H_4OH$ | —$C_2H_5$ |
| 30 | —H | —$CH_3$ | —$C_2H_5$ | benzyl- |
| 31 | —H | —$CH_3$ | —$C_2H_5$ | 2-thienylethyl- |

TABLE 8-continued

| No | Z | $R_5$ | Dye of the formula (4) $-R_2-R_2$ | $-R_3-X-R_4$ |
|---|---|---|---|---|
| 32 | —H | $-CH_3$ | $-C_2H_5$ | 2-pyridylethyl- |
| 33 | —H | $-CH_3$ | $-C_2H_5$ | m-toluyl- |
| 34 | —H | $-CH_3$ | $-C_2H_5$ | $-C_2H_4OC_2H_4OC_2H_5$ |
| 35 | —H | $-CH_3$ | $-C_2H_5$ | $-C_2H_4OC_2H_4OCOCH_3$ |
| 36 | —Cl | $-CH_3$ | $-C_2H_4OCOCH_3$ | $-C_2H_4OCOCH_3$ |
| 37 | $-OCH_3$ | $-CH_3$ | $-C_2H_5$ | $-C_4H_9(n)$ |

While the amount of the dyes of the formulae (1) and (2) and the amount of the dyes of the formulae (3) and (4) can vary depending upon the respective specific dyes selected, they are preferably used in a weight ratio of from 10:90 to 90:10. If the proportion of the dye of the formulae (1) and (2) is larger, the color density will be reduced. If the proportion of the dye of the formulae (1) and (2) is smaller, the light fastness will be reduced.

In order to adjust hue, known dyes can be mixed. In general, dyes such as diarylmethane dyes: triarylmethane dyes; thiazole dyes; methine dyes represented by merocyanine; azomethine dyes represented by indoaniline, acetophenoneazomethine, imidazoleazomethine, pyrazoloazomethine, imidazoazomethine, and pyridoneazomethine; xanthene dyes; oxazine dyes; cyanomethylene dyes represented by dicyanostyrene and tricyanostyrene; thiazine dyes; azine dyes; acridine dyes; benzeneazo dyes; heterocyclic azo dyes represented by pyridoneazo, thiopheneazo, isothiaoleazo, pyrroleazo, pyrazoleazo, imidazoleazo, thiadiazoleazo, triazoleazo, and disazo, compounds; spirodipyran dyes; indolineospiropyran dyes; fluoran dyes; rhodamine lactam dyes; naphthoquinone dyes; antraquinone dyes; and quinophalone dyes are typical. The following dyes can be preferably used:

| C.I. (COLOR INDEX) C.I. | |
|---|---|
| Disperse Yellow | 51, 3, 54, 79, 60, 23, 7, 141, 201, and 231; |
| Disperse Blue | 24, 56, 14, 301, 334, 165, 19, 72, 87, 287, 154, 26 and 354; |
| Disperse Red | 135, 146, 59, 1, 73, 60 and 167; |
| Disperse Violet | 4, 13, 26, 36, 56 and 31; |
| Disperse Orange | 149; |
| Solvent Violet | 13; |
| Solvent Black | 3; |
| Solvent Green | 3; |
| Solvent Yellow | 56, 14, 16 and 29; |
| Solvent Blue | 70, 35, 63, 36, 50, 49, 111, 105, 97 and 11; |
| Solvent Red | 135, 8, 18, 25, 19, 23, 24, 143, 146, |

-continued

| C.I. (COLOR INDEX) C.I. |
|---|
| 182; |

and the like.

Examples of such dyes include methine (cyanine) basic dyes such as monomethine, dimethine or trimethine dyes such as 3,3'-diethyloxathiacyanine iodide Astrazon Pink FG (manufactured by Bayer; C.I. 48015), 2,2'-carbocyanine (C.I. 808), Astraphylloxine FF (C.I. 48070), Astrazone Yellow 7GLL (C.I. Basic Yellow 21), Aizen Kachiron Yellow 3 GLH (manufactured by Hodogay Kagaku; C.I. 48055) and Aizen Kachiron Red 6 BH (C.I. 48020); diphenylmethane basic dyes such as Auramine (C.I. 655); triphenylmethane basic dyes such as Malachite Green (C.I. 42700) Brilliant Green (C.I. 42040), Magenta (C.I. 42510), Metal Violet (C.I. 42535), Crystal violet (C.I. 42555), Methyl Green (C.I. 684) and, Victoria Blue B (C.I. 44045); xanthene basic dyes such as Pyronine G (C.I. 739), Rhodamine B (C.I. 45170), and Rhodamine 6G (C.I. 45160); acridine basic dyes such as Acridine Yellow G (C.I. 785), Leone AL (C.I. 46075), benzoflavin (C.I. 791) and affine (C.I. 46045; quinoneimine basic dyes such as Neutral Red (C.I. 50040), Astrazone Blue BGE/x 125% (C.I. 51005) and Methylene Blue (C.I. 52015); and other basic dyes such as antraquinone basic dyes having a quanternary ammonium group.

The cyan dyes include Kayaset Blue 714 (manufactured by Nippon kayaku; Solvent Blue 63), Phorone Brilliant Blue S-R (manufactured by Sand; Disperse Blue 354) and Waxoline AP-FW (manufactured by I.C.I.; Solvent Blue 36); the magenta dyes include MS-RED G (manufactured by Mitsui Toatsu; Disperse Red 60), Macrorex Red Violet R (manufactured by Bayer; disperse Violet 26); the yellow dyes include Phorone Brilliant Yellow S-6GL (manufactured by Sand; Disperse Yellow 231), and Macrorex Yellow-6G (manufactured by Bayer; Disperse Yellow 201); and dyes having the following skeleton can be used herein:

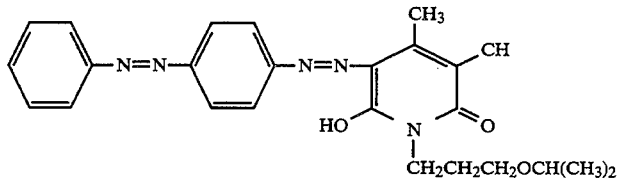

-continued

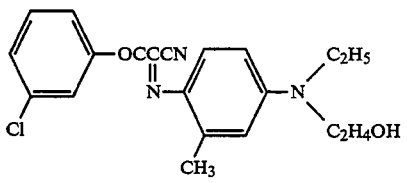

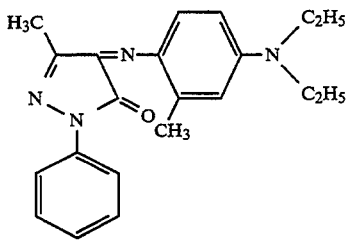

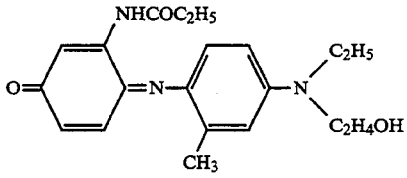

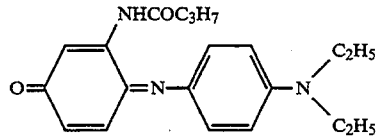

These dyes can be used in the form such that they are intact. Alternatively, these dyes can be used in the form wherein they are treated with an alkali. Further, counter ion exchangers or leuco products of these dyes can be used. When leuco dyes which are colorless or light-colored under normal conditions, a developer is included in a thermal transfer image-receptive sheet.

Sublimable yellow dyes described in Japanese patent Laid-Open Publication Nos. 78,895/1984, 28,451/1985, 28,453/1985, 53,564/1985, 148,096/1986, 239,290/1985, 31,565/1985, 30,393/1985, 53,565/1985, 27,594/1985, 262,191/1986, 152,563/1985, 244,595/1986 and 196,186/1987, and International Publication No. WO 92/05032; sublimable magenta dyes described in Japanese Patent Laid-Open Publication Nos. 223,862/1985, 28,452/1985, 31,563/1985, 78, 896/1984, 31,564/1985, 30,391/1985, 227,092/1986, 227,091/1986, 30,392/1985, 30,394/1985, 131,293/1985, 227,093/1986, 159,091/1985 and 262,190/1986, U.S. Pat. No. 4,698,651, Japanese Patent Application No. 220,793/1987 and U.S. Pat. No. 5,079,365; and sublimable cyan dyes described in Japanese Patent Laid-Open Publication Nos. 78,894/1984, 227,490/1984, 151,098/1985, 227,493/1984, 244,594/1986, 227,948/1984, 131,292/1985, 172,591/1985, 151, 097/1985, 131,294/1985, 217,266/1985, 31,559/1985, 53,563/1985, 225,897/1986, 239,289/1985, 22,993/1986, 19,396/1986, 268,493/1986, 35,994/1986, 31,467/1986, 148,269/1986, 49,873/1986, 57,651/1986, 239,291/1985, 239,292/1985, 284,489/1986 and 191,191/1987, Japanese Patent Application No. 176, 625/1987, and U.S. Pat. No. 5,079,365 also are suitably used.

More preferred dyes having the following general formulae are exemplified:

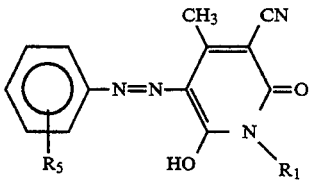

(1)

-continued

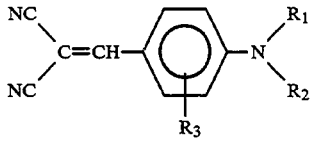

(2)

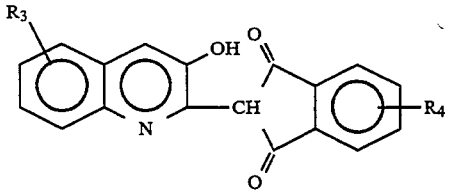

(3)

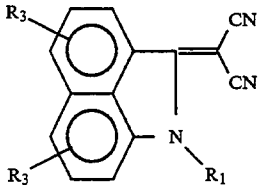

(4)

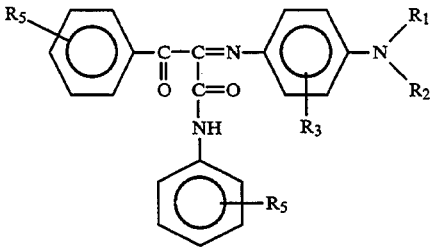

(5)

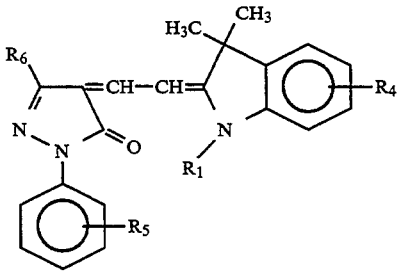

(6)

-continued
(7)
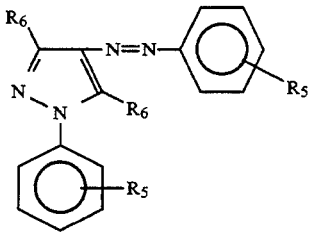
(8)
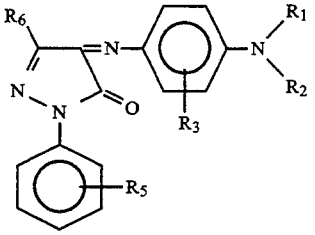
(9)
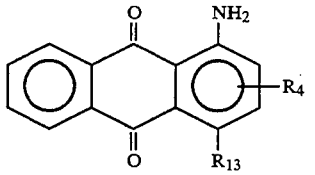
(10)
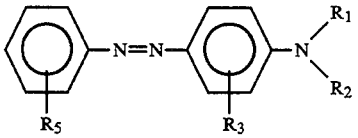
(11)
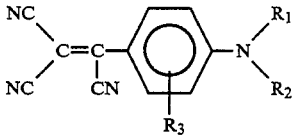
(12)
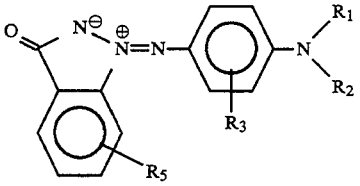
(13)
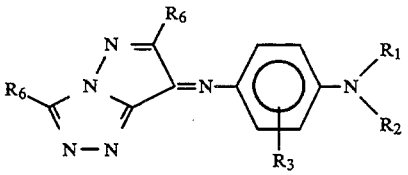
(14)
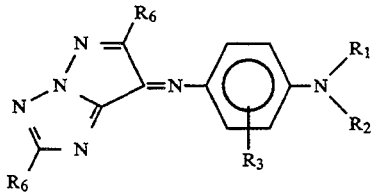
-continued
(15)
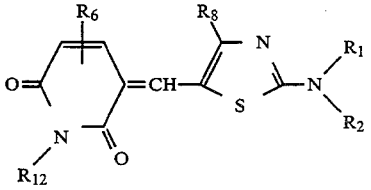
(16)
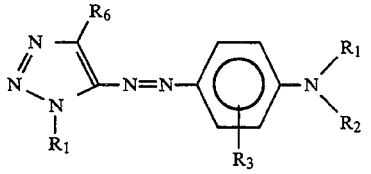
(17)
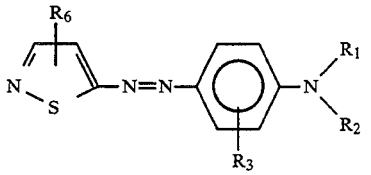
(18)
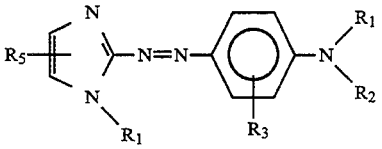
(19)
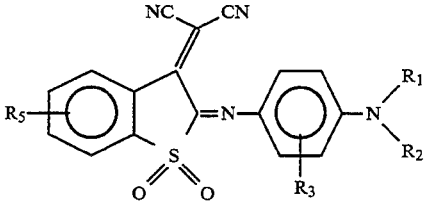
(20)
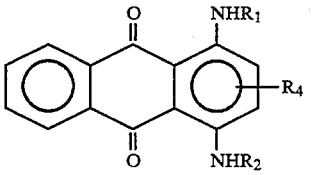
(21)
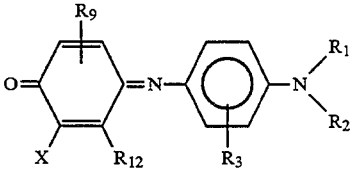
(22)
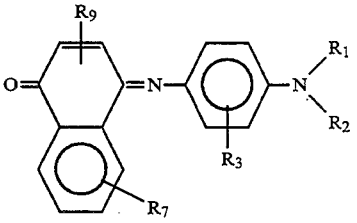

-continued (23)

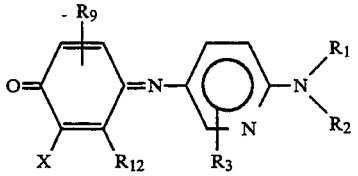

(24)

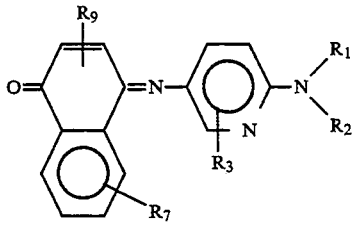

(25)

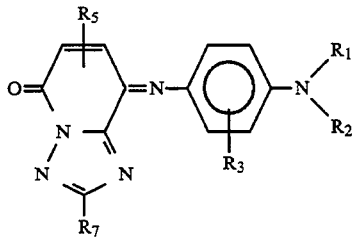

(26)

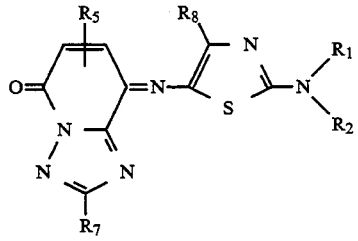

(27)

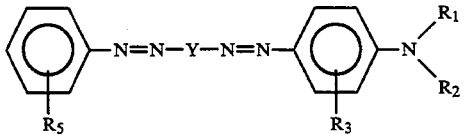

(28)

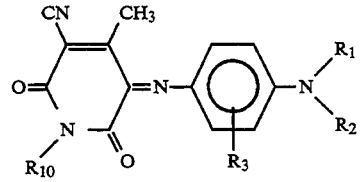

wherein $R_1$ and $R_2$ represent a substituted or unsubstituted alkyl group, a substituted or unsubstituted cycloalkyl group, or a substituted or unsubstituted aralkyl group; $R_3$ represents a substituted or unsubstituted alkyl group, a substituted or unsubstituted alkoxy group, a substituted or unsubstituted alkylcarbonylamino group, a substituted or unsubstituted alkylsulfonylamino group, a substituted or unsubstituted alkylaminocarbonyl group, substituted or unsubstituted alkylaminosulfonyl group, or a halogen atom; $R_4$ represents a substituted or unsubstituted alkoxycarbonyl group, a substituted or unsubstituted alkylaminocarbonyl group, a substituted or unsubstituted alkoxy group, a substituted or unsubstituted alkyl group, a substituted or unsubstituted cycloalkyl group, a heterocyclic group, or a halogen atom; $R_5$ represents a substituted or unsubstituted alkyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group or a halogen atom; $R_6$ represents a substituted or unsubstituted alkyl group, a substituted or unsubstituted aryl group, a substituted or unsubstituted amino group, a substituted or unsubstituted cycloalkyl group, a cyano group, a nitro group, or a halogen atom; $R_7$ represents a substituted or unsubstituted alkyl group, a substituted or unsubstituted amino group, a substituted or unsubstituted alkoxy group, a substituted or unsubstituted alkoxycarbonyl group, or a halogen atom; $R_8$ represents a substituted or unsubstituted aryl group, an aromatic heterocyclic group, a cyano group, a nitro group, a halogen atom, or an electron attractive group; $R_9$ represents $CONHR_{10}$, $SO_2NHR_{10}$, $NHCOR_{11}$, $NHSO_2R_{11}$ or a halogen atom; $R_{10}$ represents a substituted or unsubstituted alkyl group, a substituted or unsubstituted cycloalkyl group, a substituted or unsubstituted aryl group, or a substituted or unsubstituted aromatic heterocyclic group; $R_{11}$ represents a substituted or unsubstituted alkyl group, a substituted or unsubstituted cycloalkyl group, a substituted or unsubstituted amino group, a substituted or unsubstituted aryl group, or a substituted or unsubstituted aromatic heterocyclic group; $R_{12}$ represents a substituted or unsubstituted aryl group; $R_{13}$ represents an amino group or a hydroxyl group; X represents a halogen atom; and Y represents a substituted or unsubstituted aryl group or a substituted or unsubstituted aromatic heterocyclic group.

The thermal transfer sheet of the present invention is characterized in that the specific dye mixture as described above is used. Other constitutions may be similar to those of the prior known thermal transfer sheets.

Any prior known material may be used as the base sheet for use in the thermal transfer sheet of the present invention wherein the dye mixture described above is used, provided that the material has a certain measure of heat resistance and strength. Examples of such materials include materials having a thickness of the order of from 0.5 to 50 micrometers, preferably from 3 to 10 micrometers such as papers, various processed papers, polyester films, polystyrene films, polypropylene films, polysulfone films, polycarbonate films, aramid films, polyvinyl alcohol films, cellophane and the like. A particularly preferred material is a polyester film.

A dye-containing layer provided on the surface of the base sheet as described above is a layer wherein the dye mixture described above is supported on the base sheet by an optional binder resin.

Any prior known binder resin can be used as the binder resin for supporting the dye mixture described above. Examples of the preferred binder resins include cellulosic resins such as ethyl cellulose, hydroxyethyl cellulose, ethyl hydroxyethyl cellulose, hydroxypropyl cellulose, methyl cellulose, cellulose acetate and cellulose acetate butyrate; vinylic resins such as polyvinyl alcohol, polyvinyl acetate, polyvinyl butyral, polyvinyl acetoacetal, polyvinyl pyrrolidone, polyacrylamide and polystyrene; and the like. Of these, polyvinyl butyral and polyvinyl acetal are particularly preferred from the standpoints of heat resistance and dye migration.

While the dye-containing layer of the thermal transfer sheet of the present invention is basically formed by the materials described above, it may include various additives similar to the prior known additives as needed. Such a dye-containing layer is preferably formed by adding the dye mixture, the binder resin and optional components to a suitable solvent to dissolve or disperse each component therein to prepare a coating solution or ink composition for forming the dye-containing layer, applying the coating solution or ink composition to the base sheet described above and drying the whole. The dye-containing layer thus formed has a thickness of the order of from 0.2 to 5.0 micrometers, preferably from 0.4 to 2.0 micrometers. It is suitable that the dye mixture in the dye-containing layer be present in an amount of from 5% to 70% by weight, preferably from 10% to 60% by weight bared on the weight of the dye-containing layer. While the present thermal transfer sheet as described above is sufficiently useful for thermal transfer as it is, the surface of the dye-containing layer may be provided with an antisticking layer, i.e., a release layer. Such a layer prevents the sticking between the thermal transfer sheet and the transferable material during the thermal transfer operation. Thus, higher thermal transfer temperatures can be used, and images having an even more excellent density can be formed.

When an antisticking inorganic powder is merely deposited, the resulting release layer exerts a relatively high effect. Further, a release layer having a thickness of from 0.1 to 5 micrometers, preferably from 0.05 to 2 micrometers can be formed from resins having excellent releasability such as silicone polymers, acrylic polymers and fluorinated polymers.

Even if the inorganic powder or releasing polymers as described above are included in the dye-containing layer, a sufficient effect can be obtained.

Further, the back surface of such a thermal transfer sheet may be provided with a heat-resistant layer in order to prevent adverse effect due to the heat of the thermal head.

Any transferable material may be used in forming images using the thermal transfer sheet as described above, provided that its recording surface has a dye receptivity against the dye described above. When the transferable materials are those having no dye receptivity such as papers, metals, glasses and synthetic resins, a dye-receptive layer may be formed or at least one surface thereof.

Means for imparting a heat energy used in carrying out thermal transfer using the present thermal transfer sheet as described above and the recordable material as described above may be any of the prior known means. For example, a required purpose can be achieved by imparting a heat energy of the order of from 5 to 100 $mJ/mm^2$ by controlling the recording time vic a recording device such as a thermal printer (e.g., Video Printer VY-100 manufactured by Hitachi Seisakusho).

According to the thermal transfer sheet of the present invention, yellow images can be formed. Full color images having excellent color reproducibility can be provided by using the present thermal transfer sheet having the yellow dye-containing layer in combination with a thermal transfer sheet having a cyan dye-containing layer and a thermal transfer sheet having a magenta dye-containing layer. Alternatively, full color images having excellent color reproducibility can be provided by a thermal transfer sheet having a layer formed by superficially successively applying a cyan dye, the yellow dye and a magenta dye.

Examples and Comparative Examples illustrate the present invention in more detail. Parts and percentages herein are by weight unless otherwise specified.

REFERENCE EXAMPLE 1

16.9 grams of N-ethyl-benz[cd]indol-2(1H) one, 6 grams of malonitrile and 19.4 grams of phosphorus oxychloride were added to 150 ml of toluene. The resulting mixture was heated for 4 hours on a water bath with stirring and the reaction mixture was poured 600 ml of methanol. A deposited crystal was filtered off. The crude product was recrystallized from a chloroform-methanol mixture to obtain a dye of No. 75 of dye 1-1. This dye was a yellow crystal having an absorption maximum wavelength of 441 nm (methanol) and a melting point of 196°–197° C.

REFERENCE EXAMPLE 2

9.3 grams of a quaternary salt represented by the formula:

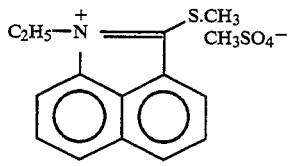

and 3.4 grams of ethyl cyanoacetate were added to 85 ml of acetonitrole. To the resulting mixture was added 5.3 ml of triethylamine, and the resulting mixture was heated for 1 hour under reflux. Thereafter, the solvent was distilled off and methanol was added. A crystal obtained was filtered off. This crude product was purified by a column using a silica gel to obtain a dye of No. 1 shown in Table 2. This dye was a yellow crystal having an absorption maximum wavelength of 454 nm (methylene chloride) and a melting point of 86°–87° C.

REFERENCE EXAMPLE 3

Dyes shown in Tables 1 through 5 described above were obtained as in Reference Examples 1 and 2 except that starting materials corresponding to the dyes shown in Table 1 through 5.

EXAMPLES 1 THROUGH 261

An ink composition for forming a dye-containing layer having the following composition was prepared. The ink composition was applied to a polyethylene terephthalate film having a thickness of 6 micrometers (wherein its back surface had been treated to provide heat resistance) so that the dry coating weight was 1.0 gram per square meter. The whole was dried to obtain a thermal transfer sheet of the present invention.

| Ink Composition | |
|---|---|
| Dye of the formula (1) or (2) | "a" parts |
| Dye of the formula (3) or (4) | "b" parts |
| Polyvinyl butyral resin | 4.5 parts |
| Methyl ethyl ketone | 45.75 parts |
| Toluene | 45.75 parts |

When the dyes in the composition described above were insoluble, a solvent such as DMF, dioxane or chloroform was suitably used. (The dyes used and their amounts ("a", "b") are shown in the following Table 9.)

Synthetic paper (Yupo FPG #150 manufactured by Oji Yuka) was used as a base sheet. A coating solution having the following composition was applied to the one surface of the base sheet so that its dry coating weight was 10.0 grams per square meter. The whole was dried for 30 minutes at 100° C. to obtain a transferable material.

Polyester resin (Vylon 200 11.5 parts manufactured by Toyobo)

Vinyl chloride-vinyl acetate copolymer 5.0 parts (VYHH manufactured by U.C.C.)

Amino-modified silicone (KF-393 1.2 part manufactured by Shin-etsu Kaguku Kogyo)

Epoxy-modified silicone (X-22-343 1.2 part manufactured by Shin-etsu Kagaku Kogyo)

Methyl ethyl ketone/toluene/cyclohexanone 102.0 parts (weight ratio of 4:4:2)

Thermal Transfer Recording Test

The present thermal transfer sheet described above and the transferable material described above were stacked with the dye-containing layer opposing to the dye-receptive surface. Recording was carried out by means of a thermal head from the back surface of the thermal transfer sheet under a head application voltage of 11 V for an application time of 16 msec. The results are shown in Table 9.

Light Fastness Test

A light fastness test of the yellow images obtained in the thermal transfer test described above was carried out by means of a xenon fadeometer (Ci 35 A manufactured by Atlas) (the black panel temperature being 50° C. and the illuminance being 50 kLux). In any case, discoloration and fading did not occur when the irradiation time wad 50 hours.

Measurement of Color Density

The color density was measured by means of a densitometer RD-918 manufactured by U.S. Macbeth Company.

TABLE 9

| Ex. | Dye Formula and Number | Dye Amount used "a" | Dye Formula and Number | Dye Amount used "b" | Color Density | Light Fastness |
|---|---|---|---|---|---|---|
| 1 | 1-1-1 | 2.0 | 3-1 | 2.0 | 2.26 | ○ |
| 2 | 1-1-2 | 2.0 | 3-1 | 2.0 | 2.18 | ○ |
| 3 | 1-1-3 | 2.0 | 3-3 | 2.0 | 1.97 | ○ |
| 4 | 1-1-4 | 2.5 | 3-5 | 1.5 | 1.89 | ○ |
| 5 | 1-1-7 | 2.0 | 3-7 | 2.0 | 2.27 | ○ |
| 6 | 1-1-11 | 3.0 | 3-9 | 1.0 | 2.36 | ○ |
| 7 | 1-1-15 | 2.0 | 3-10 | 2.0 | 2.24 | ○ |
| 8 | 1-1-18 | 2.0 | 3-11 | 2.0 | 2.15 | ○ |
| 9 | 1-1-19 | 2.0 | 3-13 | 2.0 | 2.07 | ○ |
| 10 | 1-1-22 | 2.0 | 3-13 | 2.0 | 1.97 | ○ |
| 11 | 1-1-24 | 2.0 | 3-14 | 2.0 | 1.97 | ○ |
| 12 | 1-1-27 | 2.0 | 3-16 | 2.0 | 1.88 | ○ |
| 13 | 1-1-33 | 2.0 | 3-19 | 2.0 | 1.94 | ○ |
| 14 | 1-1-35 | 1.5 | 3-20 | 1.5 | 1.97 | ○ |
| 15 | 1-1-42 | 1.0 | 3-23 | 3.0 | 1.82 | ○ |
| 16 | 1-1-44 | 2.0 | 3-26 | 2.0 | 1.99 | ○ |
| 17 | 1-1-47 | 2.0 | 3-28 | 2.0 | 2.17 | ○ |
| 18 | 1-1-49 | 2.0 | 3-29 | 2.0 | 2.27 | ○ |
| 19 | 1-1-52 | 2.0 | 3-30 | 2.0 | 2.33 | ○ |
| 20 | 1-1-55 | 2.0 | 3-33 | 2.0 | 2.31 | ○ |
| 21 | 1-1-60 | 2.0 | 3-34 | 2.0 | 2.07 | ○ |
| 22 | 1-1-63 | 2.0 | 3-35 | 2.0 | 2.05 | ○ |
| 23 | 1-1-66 | 2.0 | 3-36 | 2.0 | 2.08 | ○ |
| 24 | 1-1-70 | 2.5 | 3-36 | 2.0 | 2.14 | ○ |
| 25 | 1-1-71 | 2.0 | 3-38 | 2.0 | 2.17 | ○ |
| 26 | 1-1-75 | 3.0 | 3-39 | 2.0 | 2.23 | ○ |

TABLE 9-continued

| Ex. | Dye Formula and Number | Dye Amount used "a" | Dye Formula and Number | Dye Amount used "b" | Color Density | Light Fastness |
|---|---|---|---|---|---|---|
| 27 | 1-1-77 | 2.0 | 3-40 | 2.0 | 2.29 | ○ |
| 28 | 1-2-1 | 2.0 | 3-44 | 2.0 | 2.33 | ○ |
| 29 | 1-2-2 | 2.0 | 3-44 | 2.0 | 2.31 | ○ |
| 30 | 1-2-6 | 1.5 | 3-44 | 2.5 | 2.40 | ○ |
| 31 | 1-2-7 | 1.5 | 3-44 | 2.5 | 2.39 | ○ |
| 32 | 1-2-9 | 2.5 | 3-44 | 1.5 | 2.32 | ○ |
| 33 | 1-2-11 | 2.5 | 3-45 | 1.5 | 1.87 | ○ |
| 34 | 1-2-12 | 2.5 | 3-45 | 1.5 | 1.97 | ○ |
| 35 | 1-2-15 | 2.0 | 3-47 | 2.0 | 1.96 | ○ |
| 36 | 1-2-17 | 2.0 | 3-48 | 2.0 | 2.17 | ○ |
| 37 | 1-2-19 | 2.0 | 3-49 | 2.0 | 2.14 | ○ |
| 38 | 1-2-22 | 2.0 | 3-50 | 2.0 | 2.17 | ○ |
| 39 | 1-2-25 | 2.0 | 3-1 | 2.0 | 2.14 | ○ |
| 40 | 1-2-26 | 2.0 | 3-6 | 2.0 | 2.27 | ○ |
| 41 | 1-2-29 | 1.5 | 3-8 | 2.5 | 2.22 | ○ |
| 42 | 1-2-33 | 2.0 | 3-10 | 2.0 | 2.33 | ○ |
| 43 | 1-2-36 | 2.0 | 3-20 | 2.0 | 2.39 | ○ |
| 44 | 1-2-40 | 2.0 | 3-22 | 2.0 | 2.41 | ○ |
| 45 | 1-2-45 | 2.0 | 3-24 | 2.0 | 2.23 | ○ |
| 46 | 1-2-46 | 2.0 | 3-25 | 2.0 | 2.25 | ○ |
| 47 | 1-2-47 | 2.0 | 3-26 | 2.0 | 2.19 | ○ |
| 48 | 1-2-49 | 2.0 | 3-29 | 2.0 | 2.17 | ○ |
| 49 | 1-2-50 | 2.0 | 3-35 | 2.0 | 2.14 | ○ |
| 50 | 1-2-51 | 2.0 | 3-36 | 2.0 | 2.07 | ○ |
| 51 | 1-2-53 | 2.0 | 3-39 | 2.0 | 1.93 | ○ |
| 52 | 1-2-54 | 2.5 | 3-41 | 1.5 | 1.84 | ○ |
| 53 | 1-2-56 | 2.5 | 3-41 | 1.5 | 1.92 | ○ |
| 54 | 1-2-58 | 2.0 | 3-48 | 2.0 | 1.95 | ○ |
| 55 | 1-2-60 | 2.5 | 3-50 | 1.5 | 1.93 | ○ |
| 56 | 1-2-63 | 2.5 | 3-51 | 1.5 | 1.91 | ○ |
| 57 | 1-2-66 | 2.0 | 3-52 | 2.0 | 1.79 | ○ |
| 58 | 1-2-68 | 2.0 | 3-55 | 2.0 | 1.84 | ○ |
| 59 | 1-2-70 | 2.0 | 3-57 | 2.0 | 1.91 | ○ |
| 60 | 1-2-74 | 2.0 | 3-59 | 2.0 | 1.90 | ○ |
| 61 | 1-3-1 | 2.0 | 3-7 | 2.0 | 1.80 | ○ |
| 62 | 1-3-5 | 2.0 | 3-15 | 2.0 | 1.83 | ○ |
| 63 | 1-3-6 | 2.0 | 3-19 | 2.0 | 1.85 | ○ |
| 64 | 1-3-9 | 2.0 | 3-23 | 2.0 | 1.77 | ○ |
| 65 | 1-3-10 | 2.0 | 3-41 | 2.0 | 2.14 | ○ |
| 66 | 1-3-13 | 2.0 | 3-44 | 2.0 | 2.10 | ○ |
| 67 | 1-4-1 | 2.5 | 3-19 | 1.5 | 2.20 | ○ |
| 68 | 1-4-2 | 2.5 | 3-27 | 1.5 | 2.23 | ○ |
| 69 | 1-4-4 | 2.5 | 3-30 | 1.5 | 2.26 | ○ |
| 70 | 1-4-8 | 2.0 | 3-31 | 2.0 | 2.28 | ○ |
| 71 | 1-4-9 | 2.0 | 3-54 | 2.0 | 2.29 | ○ |
| 72 | 1-4-11 | 2.0 | 3-55 | 2.0 | 2.14 | ○ |
| 73 | 1-4-15 | 2.0 | 3-56 | 2.0 | 2.17 | ○ |
| 74 | 1-4-17 | 2.0 | 3-56 | 2.0 | 2.19 | ○ |
| 75 | 1-4-19 | 2.0 | 3-58 | 2.0 | 2.30 | ○ |
| 76 | 1-4-21 | 2.0 | 3-59 | 2.0 | 2.32 | ○ |
| 77 | 1-5-2 | 2.0 | 3-17 | 2.0 | 2.33 | ○ |
| 78 | 1-5-3 | 2.0 | 3-19 | 2.0 | 2.17 | ○ |
| 79 | 1-5-5 | 2.0 | 3-38 | 2.0 | 2.15 | ○ |
| 80 | 1-5-6 | 2.0 | 3-57 | 2.0 | 2.14 | ○ |
| 81 | 1-1-1 | 1.5 | 3-1 | 2.5 | 2.08 | ○ |
| 82 | 1-1-2 | 1.5 | 3-1 | 2.5 | 2.00 | ○ |
| 83 | 1-1-4 | 1.5 | 3-1 | 2.5 | 2.11 | ○ |
| 84 | 1-1-5 | 1.5 | 3-3 | 2.5 | 2.17 | ○ |
| 85 | 1-1-6 | 1.5 | 3-4 | 2.5 | 2.10 | ○ |
| 86 | 1-1-7 | 2.0 | 3-6 | 2.0 | 2.19 | ○ |
| 87 | 1-1-9 | 2.0 | 3-7 | 2.0 | 2.30 | ○ |
| 88 | 1-1-10 | 2.0 | 3-7 | 2.0 | 2.44 | ○ |
| 89 | 1-1-12 | 2.0 | 3-8 | 2.0 | 2.50 | ○ |
| 90 | 1-1-14 | 2.0 | 3-9 | 2.0 | 2.10 | ○ |
| 91 | 1-1-16 | 2.0 | 3-9 | 2.0 | 2.07 | ○ |
| 92 | 1-1-19 | 2.0 | 3-11 | 2.0 | 2.18 | ○ |
| 93 | 1-1-22 | 2.0 | 3-12 | 2.0 | 2.19 | ○ |
| 94 | 1-1-25 | 2.0 | 3-14 | 2.0 | 2.30 | ○ |
| 95 | 1-1-28 | 2.0 | 3-15 | 2.0 | 2.10 | ○ |
| 96 | 1-1-32 | 2.5 | 3-16 | 1.5 | 2.07 | ○ |
| 97 | 1-1-36 | 2.5 | 3-17 | 1.5 | 2.00 | ○ |
| 98 | 1-1-39 | 2.5 | 3-19 | 1.5 | 1.99 | ○ |
| 99 | 1-1-41 | 2.0 | 3-22 | 2.0 | 1.98 | ○ |
| 100 | 1-1-44 | 2.0 | 3-24 | 2.0 | 1.97 | ○ |
| 101 | 1-1-47 | 2.5 | 3-26 | 1.5 | 1.97 | ○ |
| 102 | 1-1-49 | 2.5 | 3-29 | 1.5 | 1.99 | ○ |
| 103 | 1-1-53 | 2.5 | 3-30 | 1.5 | 2.03 | ○ |

TABLE 9-continued

| Ex. | Dye Formula and Number | Dye Amount used "a" | Dye Formula and Number | Dye Amount used "b" | Color Density | Light Fastness |
|---|---|---|---|---|---|---|
| 104 | 1-1-57 | 2.5 | 3-31 | 1.5 | 2.05 | ○ |
| 105 | 1-1-61 | 2.0 | 3-33 | 2.0 | 2.18 | ○ |
| 106 | 1-1-64 | 2.0 | 3-33 | 2.0 | 2.16 | ○ |
| 107 | 1-1-67 | 2.0 | 3-34 | 2.0 | 2.30 | ○ |
| 108 | 1-1-68 | 2.0 | 3-36 | 2.0 | 2.12 | ○ |
| 109 | 1-1-69 | 2.0 | 3-36 | 2.0 | 2.07 | ○ |
| 110 | 1-1-72 | 2.0 | 3-37 | 2.0 | 2.40 | ○ |
| 111 | 1-1-74 | 2.0 | 3-37 | 2.0 | 2.31 | ○ |
| 112 | 1-2-2 | 2.0 | 3-1 | 2.0 | 2.33 | ○ |
| 113 | 1-2-4 | 2.0 | 3-4 | 2.0 | 1.97 | ○ |
| 114 | 1-2-7 | 2.0 | 3-7 | 2.0 | 1.76 | ○ |
| 115 | 1-2-9 | 1.5 | 3-9 | 2.5 | 2.13 | ○ |
| 116 | 1-2-14 | 1.5 | 3-13 | 2.5 | 2.17 | ○ |
| 117 | 1-2-17 | 1.5 | 3-15 | 2.5 | 2.27 | ○ |
| 118 | 1-2-20 | 2.0 | 3-17 | 2.0 | 2.21 | ○ |
| 119 | 1-2-23 | 2.0 | 3-18 | 2.0 | 2.20 | ○ |
| 120 | 1-2-27 | 2.0 | 3-22 | 2.0 | 2.10 | ○ |
| 121 | 1-2-33 | 2.0 | 3-23 | 2.0 | 1.97 | ○ |
| 122 | 1-2-38 | 2.0 | 3-25 | 2.0 | 1.99 | ○ |
| 123 | 1-2-41 | 2.0 | 3-27 | 2.0 | 2.06 | ○ |
| 124 | 1-2-47 | 2.0 | 3-27 | 2.0 | 2.14 | ○ |
| 125 | 1-2-49 | 2.0 | 3-27 | 2.0 | 2.03 | ○ |
| 126 | 1-2-54 | 2.0 | 3-28 | 2.0 | 2.07 | ○ |
| 127 | 1-2-57 | 2.0 | 3-30 | 2.0 | 2.14 | ○ |
| 128 | 1-2-60 | 2.0 | 3-30 | 2.0 | 2.15 | ○ |
| 129 | 1-2-63 | 2.0 | 3-31 | 2.0 | 2.13 | ○ |
| 130 | 1-2-65 | 2.0 | 3-32 | 2.0 | 2.18 | ○ |
| 131 | 1-2-67 | 2.0 | 3-35 | 2.0 | 2.10 | ○ |
| 132 | 1-2-70 | 2.0 | 3-35 | 2.0 | 2.30 | ○ |
| 133 | 1-2-71 | 2.0 | 3-36 | 2.0 | 2.34 | ○ |
| 134 | 1-2-74 | 2.0 | 3-36 | 2.0 | 2.36 | ○ |
| 135 | 1-2-77 | 2.5 | 3-37 | 1.5 | 2.38 | ○ |
| 136 | 1-3-1 | 2.0 | 3-4 | 2.0 | 2.29 | ○ |
| 137 | 1-3-4 | 2.5 | 3-5 | 1.5 | 2.22 | ○ |
| 138 | 1-3-6 | 2.5 | 3-6 | 1.5 | 2.24 | ○ |
| 139 | 1-3-7 | 2.0 | 3-6 | 2.0 | 2.06 | ○ |
| 140 | 1-3-8 | 2.0 | 3-7 | 2.0 | 1.89 | ○ |
| 141 | 1-3-11 | 1.5 | 3-11 | 2.5 | 1.93 | ○ |
| 142 | 1-4-2 | 1.5 | 3-27 | 2.5 | 1.91 | ○ |
| 143 | 1-4-4 | 2.0 | 3-30 | 2.0 | 1.99 | ○ |
| 144 | 1-4-5 | 2.0 | 3-34 | 2.0 | 2.01 | ○ |
| 145 | 1-4-7 | 2.0 | 3-35 | 2.0 | 2.07 | ○ |
| 146 | 1-4-9 | 2.0 | 3-36 | 2.0 | 2.18 | ○ |
| 147 | 1-4-10 | 2.5 | 3-37 | 1.5 | 2.19 | ○ |
| 148 | 1-5-1 | 2.0 | 3-11 | 2.0 | 2.26 | ○ |
| 149 | 1-5-2 | 2.0 | 3-19 | 2.0 | 2.14 | ○ |
| 150 | 1-5-4 | 2.0 | 3-31 | 2.0 | 2.13 | ○ |
| 151 | 1-5-6 | 2.0 | 3-37 | 2.0 | 2.10 | ○ |
| 152 | 1-1-1 | 2.0 | 4-1 | 2.0 | 1.87 | ○ |
| 153 | 1-1-2 | 2.0 | 4-1 | 2.0 | 1.94 | ○ |
| 154 | 1-1-4 | 2.0 | 4-2 | 2.0 | 1.93 | ○ |
| 155 | 1-1-5 | 2.0 | 4-2 | 2.0 | 1.99 | ○ |
| 156 | 1-1-7 | 1.5 | 4-3 | 2.0 | 2.03 | ○ |
| 157 | 1-1-9 | 1.5 | 4-4 | 3.0 | 2.17 | ○ |
| 158 | 1-1-10 | 2.0 | 4-5 | 2.0 | 2.00 | ○ |
| 159 | 1-1-11 | 2.0 | 4-6 | 2.0 | 1.84 | ○ |
| 160 | 1-1-12 | 2.5 | 4-7 | 2.0 | 1.97 | ○ |
| 161 | 1-1-14 | 2.0 | 4-7 | 1.5 | 1.90 | ○ |
| 162 | 1-1-16 | 2.0 | 4-8 | 2.0 | 1.88 | ○ |
| 163 | 1-1-18 | 2.0 | 4-10 | 2.0 | 1.96 | ○ |
| 164 | 1-1-19 | 2.0 | 4-10 | 2.0 | 1.98 | ○ |
| 165 | 1-1-20 | 1.5 | 4-11 | 2.5 | 2.24 | ○ |
| 166 | 1-1-21 | 2.5 | 4-12 | 2.0 | 1.96 | ○ |
| 167 | 1-1-22 | 1.5 | 4-13 | 2.5 | 2.17 | ○ |
| 168 | 1-1-23 | 2.0 | 4-13 | 2.0 | 1.93 | ○ |
| 169 | 1-1-24 | 2.0 | 4-14 | 2.0 | 1.92 | ○ |
| 170 | 1-1-26 | 2.0 | 4-15 | 2.0 | 1.86 | ○ |
| 171 | 1-1-27 | 2.0 | 4-17 | 2.0 | 1.88 | ○ |
| 172 | 1-1-28 | 2.0 | 4-17 | 2.0 | 1.88 | ○ |
| 173 | 1-1-29 | 2.0 | 4-18 | 2.0 | 1.79 | ○ |
| 174 | 1-1-30 | 2.0 | 4-18 | 2.0 | 1.77 | ○ |
| 175 | 1-1-33 | 2.0 | 4-19 | 2.0 | 1.94 | ○ |
| 176 | 1-1-35 | 2.0 | 4-19 | 2.0 | 1.95 | ○ |
| 177 | 1-1-36 | 2.0 | 4-20 | 2.0 | 1.90 | ○ |
| 178 | 1-1-37 | 2.0 | 4-20 | 2.0 | 1.98 | ○ |
| 179 | 1-1-38 | 2.5 | 4-21 | 2.0 | 2.13 | ○ |
| 180 | 1-1-39 | 2.0 | 4-22 | 2.0 | 2.06 | ○ |

TABLE 9-continued

| Ex. | Dye Formula and Number | Dye Amount used "a" | Dye Formula and Number | Dye Amount used "b" | Color Density | Light Fastness |
|---|---|---|---|---|---|---|
| 181 | 1-1-40 | 2.0 | 4-22 | 2.0 | 2.03 | ○ |
| 182 | 1-1-44 | 2.0 | 4-23 | 2.0 | 2.01 | ○ |
| 183 | 1-1-47 | 2.0 | 4-25 | 2.0 | 2.17 | ○ |
| 184 | 1-1-48 | 2.0 | 4-27 | 2.0 | 1.86 | ○ |
| 185 | 1-1-50 | 2.0 | 4-28 | 2.0 | 1.87 | ○ |
| 186 | 1-1-54 | 2.0 | 4-29 | 2.0 | 1.84 | ○ |
| 187 | 1-1-57 | 2.0 | 4-31 | 2.0 | 1.86 | ○ |
| 188 | 1-1-58 | 1.5 | 4-31 | 2.5 | 2.24 | ○ |
| 189 | 1-1-60 | 1.5 | 4-32 | 2.5 | 2.27 | ○ |
| 190 | 1-1-63 | 1.5 | 4-32 | 2.0 | 2.11 | ○ |
| 191 | 1-1-64 | 2.0 | 4-33 | 2.0 | 1.99 | ○ |
| 192 | 1-1-65 | 2.0 | 4-34 | 2.0 | 1.99 | ○ |
| 193 | 1-1-66 | 2.0 | 4-35 | 2.0 | 1.89 | ○ |
| 194 | 1-1-68 | 2.0 | 4-36 | 2.0 | 1.92 | ○ |
| 195 | 1-1-68 | 2.0 | 4-37 | 2.0 | 1.77 | ○ |
| 196 | 1-1-73 | 2.0 | 4-2 | 2.0 | 1.98 | ○ |
| 197 | 1-1-75 | 2.0 | 4-3 | 2.0 | 1.84 | ○ |
| 198 | 1-1-77 | 2.0 | 4-6 | 2.0 | 1.92 | ○ |
| 199 | 1-2-1 | 2.0 | 4-11 | 2.0 | 1.85 | ○ |
| 200 | 1-2-3 | 2.0 | 4-15 | 2.0 | 1.94 | ○ |
| 201 | 1-2-5 | 2.0 | 4-8 | 2.0 | 1.91 | ○ |
| 202 | 1-2-7 | 2.0 | 4-7 | 2.0 | 1.93 | ○ |
| 203 | 1-2-8 | 1.5 | 4-3 | 2.5 | 1.99 | ○ |
| 204 | 1-2-9 | 1.5 | 4-9 | 2.5 | 2.07 | ○ |
| 205 | 1-2-10 | 2.0 | 4-18 | 2.0 | 1.89 | ○ |
| 206 | 1-2-11 | 2.0 | 4-19 | 2.0 | 2.03 | ○ |
| 207 | 1-2-12 | 2.0 | 4-31 | 2.0 | 1.90 | ○ |
| 208 | 1-2-13 | 2.0 | 4-1 | 2.0 | 2.07 | ○ |
| 209 | 1-2-15 | 2.0 | 4-6 | 2.0 | 1.88 | ○ |
| 210 | 1-2-17 | 2.0 | 4-9 | 2.0 | 2.11 | ○ |
| 211 | 1-2-18 | 2.0 | 4-21 | 2.0 | 2.14 | ○ |
| 212 | 1-2-20 | 2.0 | 4-23 | 2.0 | 2.16 | ○ |
| 213 | 1-2-21 | 2.0 | 4-4 | 2.0 | 1.94 | ○ |
| 214 | 1-2-24 | 2.0 | 4-8 | 2.0 | 2.17 | ○ |
| 215 | 1-2-26 | 2.0 | 4-3 | 2.0 | 1.9 | ○ |
| 216 | 1-2-30 | 2.0 | 4-11 | 2.0 | 1.89 | ○ |
| 217 | 1-2-31 | 2.0 | 4-34 | 1.5 | 1.94 | ○ |
| 218 | 1-2-32 | 2.0 | 4-37 | 1.5 | 1.88 | ○ |
| 219 | 1-2-33 | 2.0 | 4-31 | 1.5 | 1.92 | ○ |
| 220 | 1-2-35 | 2.0 | 4-27 | 1.5 | 1.97 | ○ |
| 221 | 1-2-37 | 2.0 | 4-28 | 2.0 | 1.87 | ○ |
| 222 | 1-2-40 | 2.0 | 4-29 | 2.0 | 1.87 | ○ |
| 223 | 1-2-42 | 2.5 | 4-25 | 2.0 | 1.92 | ○ |
| 224 | 1-2-43 | 2.0 | 4-17 | 2.0 | 1.90 | ○ |
| 225 | 1-2-44 | 2.0 | 4-4 | 2.0 | 1.87 | ○ |
| 226 | 1-2-50 | 2.5 | 4-8 | 2.0 | 1.90 | ○ |
| 227 | 1-2-53 | 2.5 | 4-9 | 1.5 | 2.00 | ○ |
| 228 | 1-2-58 | 2.5 | 4-16 | 1.5 | 1.93 | ○ |
| 229 | 1-2-59 | 1.5 | 4-11 | 2.0 | 1.86 | ○ |
| 230 | 1-2-60 | 1.5 | 4-27 | 2.5 | 2.10 | ○ |
| 231 | 1-2-62 | 2.0 | 4-6 | 2.5 | 2.28 | ○ |
| 232 | 1-2-63 | 2.0 | 4-7 | 2.0 | 1.87 | ○ |
| 233 | 1-2-66 | 1.5 | 4-14 | 2.0 | 1.85 | ○ |
| 234 | 1-2-67 | 1.5 | 4-17 | 2.0 | 1.88 | ○ |
| 235 | 1-2-68 | 1.5 | 4-19 | 2.0 | 1.92 | ○ |
| 236 | 1-2-70 | 2.0 | 4-33 | 1.5 | 1.87 | ○ |
| 237 | 1-2-72 | 2.0 | 4-37 | 1.5 | 1.84 | ○ |
| 238 | 1-2-73 | 2.0 | 4-31 | 2.0 | 1.95 | ○ |
| 239 | 1-3-1 | 2.0 | 4-24 | 2.0 | 1.83 | ○ |
| 240 | 1-3-2 | 2.0 | 4-28 | 2.0 | 1.90 | ○ |
| 241 | 1-3-3 | 2.0 | 4-16 | 2.0 | 1.89 | ○ |
| 242 | 1-3-5 | 2.0 | 4-17 | 2.0 | 1.90 | ○ |
| 243 | 1-3-6 | 2.0 | 4-19 | 2.0 | 2.10 | ○ |
| 244 | 1-3-8 | 2.0 | 4-4 | 2.0 | 1.94 | ○ |
| 245 | 1-3-9 | 2.0 | 4-6 | 2.0 | 2.11 | ○ |
| 246 | 1-3-11 | 1.5 | 4-9 | 2.5 | 1.98 | ○ |
| 247 | 1-3-13 | 1.5 | 4-17 | 2.5 | 2.17 | ○ |
| 248 | 1-3-14 | 2.0 | 4-19 | 2.0 | 1.99 | ○ |
| 249 | 1-4-1 | 2.0 | 4-21 | 2.0 | 1.79 | ○ |
| 250 | 1-4-2 | 2.5 | 4-24 | 2.0 | 1.97 | ○ |
| 251 | 1-4-3 | 2.5 | 4-12 | 2.0 | 2.23 | ○ |
| 252 | 1-4-5 | 2.5 | 4-12 | 1.5 | 1.80 | ○ |
| 253 | 1-5-7 | 2.0 | 4-18 | 2.0 | 1.92 | ○ |
| 254 | 1-5-8 | 2.0 | 4-27 | 2.0 | 1.87 | ○ |
| 255 | 2-1 | 4.0 | 3-46 | 2.0 | 2.02 | ○ |
| 256 | 2-1 | 2.0 | 4-28 | 4.0 | 2.25 | ○ |
| 257 | 2-2 | 3.0 | 3-41 | 3.0 | 2.07 | ○ |

TABLE 9-continued

| Ex. | Dye Formula and Number | Dye Amount used "a" | Dye Formula and Number | Dye Amount used "b" | Color Density | Light Fastness |
|---|---|---|---|---|---|---|
| 258 | 2-3 | 4.0 | 4-34 | 2.0 | 1.98 | ○ |
| 259 | 2-4 | 4.0 | 3-34 | 2.0 | 1.96 | ○ |
| 260 | 2-5 | 4.0 | 4-36 | 2.0 | 2.10 | ○ |
| 261 | 2-1 | 4.0 | 4-3 | 2.0 | 1.94 | ○ |

COMPARATIVE EXAMPLES 1 THROUGH 20

Example 1 was repeated except that the following dyes were used in place of the dye described in Example. The results are shown in Table 10.

| | |
|---|---|
| Dye of the formulae 1 through 4 | "a" parts |
| Polyvinyl butyral resin | 4.5 parts |
| Methyl ethyl ketone | 46.25 parts |
| Toluene | 46.25 parts |

TABLE 10

| Com. Ex. | Dye Formula and Number | Dye Amount used "a" | Color Density | Light Fastness |
|---|---|---|---|---|
| 1 | 1-1-1 | 4.0 | 1.79 | ○ |
| 2 | 1-1-12 | 3.0 | 1.61 | ○ |
| 3 | 1-1-23 | 2.5 | 1.53 | ○ |
| 4 | 1-1-45 | 3.0 | 1.63 | ○ |
| 5 | 1-2-11 | 3.0 | 1.54 | ○ |
| 6 | 1-2-24 | 3.0 | 1.74 | ○ |
| 7 | 1-2-45 | 3.0 | 1.65 | ○ |
| 8 | 1-2-74 | 2.5 | 1.64 | ○ |
| 9 | 1-4-3 | 2.0 | 1.74 | ○ |
| 10 | 1-5-4 | 2.0 | 1.59 | ○ |
| 11 | 1-6-2 | 3.0 | 1.71 | ○ |
| 12 | 2-1 | 3.0 | 2.63 | X |
| 13 | 2-4 | 3.0 | 2.43 | X |
| 14 | 3-28 | 3.5 | 2.41 | X |
| 15 | 3-43 | 2.0 | 1.89 | X |
| 16 | 3-59 | 2.0 | 1.97 | X |
| 17 | 4-1 | 2.5 | 2.30 | X |
| 18 | 4-14 | 3.0 | 2.18 | X |
| 19 | 4-23 | 3.0 | 2.39 | X |
| 20 | 4-31 | 3.5 | 1.98 | X |

According to the present invention as described above, there can be provided the thermal transfer sheets capable of providing full color images having excellent color density, clearness and fastnesses, particularly light fastness by using the mixture of the specific dyes even if a heat energy is applied for an extremely short period of time.

A preferred embodiment of a magenta dye illustrates the present invention in more detail.

Anthraquinone dyes used in the present invention include dyes represented by the formulae (5) through (8) described above. These dyes can be used alone or in mixture.

Polymethine dyes used in the present invention include dyes represented by the formula (9) described above. These dyes can be used alone or in mixture.

The anthraquinone dyes and polymethine dyes suitable for use in the present invention are shown in the following Tables 11 through 15 by expressing them by their substituents. These dyes per se are the dyes known as disperse dyes or the like, and they are available in the market to use in the present invention.

TABLE 11

| No. | X | Dye of the formula (5) $R_1$ |
|---|---|---|
| 5-1 | —O— | phenyl |
| 5-2 | —O— | 3-hexylphenyl |
| 5-3 | —O— | 4-(2-ethyl)-pentoxyphenyl |
| 5-4 | —O— | 3-hydroxyphenyl |
| 5-5 | —O— | 4-butoxycarbonylphenyl |
| 5-6 | —O— | 4-hexanoylphenyl |
| 5-7 | —O— | 3-bromophenyl |
| 5-8 | —O— | 4-acetylaminophenyl |
| 5-9 | —O— | 4-tosylphenyl |
| 5-10 | —O— | 4-benzensulfonyloxyphenyl |
| 5-11 | —O— | 4-nitrophenyl |
| 5-12 | —O— | 4-ethylthiophenyl |
| 5-13 | —O— | 4-isopropoxycarboxyphenyl |
| 5-14 | —O— | 4-ethylaminocarboxyphenyl |
| 5-15 | —O— | 3-ethoxycarbonylmethoxyphenyl |
| 5-16 | —O— | 4-(N-ethyl-N-propylamino)sulfonylphenyl |
| 5-17 | —O— | 3-cyanomethylphenyl |
| 5-18 | —O— | 3-methoxycarbonylmethylphenyl |
| 5-19 | —O— | 3-[2-(2-methoxyethoxy)ethoxy]phenyl |
| 5-20 | —O— | 4-(4-hydroxybutyl)phenyl |
| 5-21 | —O— | 3-[2-(3-chlorophenyl)ethoxy]phenyl |
| 5-22 | —O— | 7-ethylnonanyl |
| 5-23 | —O— | 5-hydroxypentyl |
| 5-24 | —O— | 2-phenoxycarbonylethyl |
| 5-25 | —O— | 4-methylcarboxybutyl |
| 5-26 | —O— | 3-ethoxycarboxypropyl |
| 5-27 | —O— | cyclohexyl |
| 5-28 | —O— | 4-(4-hydroxybutyl)cyclohexyl |
| 5-29 | —S— | 3-propylphenyl |
| 5-30 | —S— | 3-(3-hydroxyhexyloxy)phenyl |
| 5-31 | —S— | 4-pentoxycarbonylphenyl |
| 5-32 | —S— | 3-propylcarboxyphenyl |
| 5-33 | —S— | 4-dimethylaminosulfonylphenyl |
| 5-34 | —S— | 4-(2-methylcarboxyethyl)phenyl |
| 5-35 | —S— | 5-methoxypentyl |
| 5-36 | —S— | 4-pentylcyclohexyl |
| 5-37 | —S— | 2-(2-pentoxyethoxy)ethyl |
| 5-38 | —$OSO_2$— | phenyl |
| 5-39 | —$OSO_2$— | 3-butylphenyl |
| 5-40 | —$OSO_2$— | 4-(2-hydroxyethoxy)phenyl |
| 5-41 | —$OSO_2$— | 3-methoxycarbonylmethylphenyl |
| 5-42 | —$OSO_2$— | 3-methlcarboxyphenyl |
| 5-43 | —$OSO_2$— | 3,4-dichlorophenyl |

TABLE 12

| No. | Dye of the formula (6) $R_3$ |
|---|---|
| 6-1 | 6-methyloctyl |
| 6-2 | 3-isopropylcyclohexyl |
| 6-3 | 2-cyclohexylethyl |
| 6-4 | 2-(2-ethoxyethoxy)ethyl |
| 6-5 | hydroxyhexyl |
| 6-6 | 2-(4-ethylphenyl)ethyl |
| 6-7 | 4-ethylcarboxybutyl |
| 6-8 | 4-methoxycarboxybutyl |
| 6-9 | 5-propoxycarbonylpentyl |
| 6-10 | 2-methoxyethoxycarbonylmethyl |

TABLE 13

| No. | X | Y | Dye of the formula (7) $R_1$ | $R_2$ |
|---|---|---|---|---|
| 7-1 | —O— | —O— | phenyl | phenyl |
| 7-2 | —O— | —O— | 3-propylphenyl | 3-propylphenyl |
| 7-3 | —O— | —O— | 4-(4-hydroxybutyl) | 4-(4-hydroxybutyl) |

TABLE 13-continued

| No. | X | Y | Dye of the formula (7) $R_1$ | $R_2$ |
|---|---|---|---|---|
| | | | phenyl | phenyl |
| 7-4 | —O— | —O— | 3-[2-(2-methoxyethoxy) ethyl]phenyl | phenyl |
| 7-5 | —O— | —O— | 3,4-dichlorophenyl | phenyl |
| 7-6 | —O— | —O— | 3-(2-propylcarboxy) ethylphenyl | 3-(2-propylcarboxy) ethylphenyl |
| 7-7 | —O— | —O— | 3-(2-methoxycarboxy) ethylphenyl | 3-(2-methoxycarboxy) ethylphenyl |
| 7-8 | —O— | —O— | 3-(2-pentylcarbonyl) ethylphenyl | phenyl |
| 7-9 | —O— | —O— | 3-(2-butoxycarbonyl) ethylphenyl | phenyl |
| 7-10 | —O— | —O— | 4-(1-methylbutyl) carboxyphenyl | phenyl |
| 7-11 | —O— | —O— | 4-hexoxyphenyl | 4-hexoxyphenyl |
| 7-12 | —O— | —O— | 3-hydroxyphenyl | phenyl |
| 7-13 | —O— | —O— | 3-butylcarbonyphenyl | 3-butylcarbonyphenyl |
| 7-14 | —O— | —O— | 4-acetylaminophenyl | 3-hexylphenyl |
| 7-15 | —O— | —O— | 3-nitrophenyl | phenyl |
| 7-16 | —O— | —O— | 2-(2-acetoxyethoxy) ethyl | phenyl |
| 7-17 | —O— | —O— | 4-hydroxybutyl | ethylcarboxymethyl |
| 7-18 | —O— | —O— | 4-methylcyclohexyl | 3-methylbenzyl |
| 7-19 | —S— | —S— | 4-methylphenyl | 4-methylphenyl |
| 7-20 | —S— | —S— | 3-(2-acetoxy) ethylphenyl | 3-chlorophenyl |
| 7-21 | —S— | —S— | cyclohexyl | m-toluyl |
| 7-22 | —S— | —S— | 2-(2-ethoxyethoxy) ethyl | 2-(2-ethoxyethoxy) ethyl |
| 7-23 | $—OSO_2—$ | $—OSO_2—$ | m-toluyl | phenyl |
| 7-24 | $—OSO_2—$ | $—OSO_2—$ | 4-ethoxyphenyl | 2-hydroxyethyl |
| 7-25 | $—OSO_2—$ | $—OSO_2—$ | 4-pentylcyclohexyl | phenyl |
| 7-26 | $—OSO_2—$ | $—OSO_2—$ | 3-chlorophenyl | 3-chlorophenyl |
| 7-27 | —O— | —S— | phenyl | phenyl |
| 7-28 | —O— | —S— | phenyl ethyl | 2-(2-propoxyethoxy) |
| 7-29 | —O— | $—OSO_2—$ | m-toluyl | phenyl |
| 7-30 | —S— | $—OSO_2—$ | 3-chlorophenyl | phenyl |

TABLE 14

| Dye of the formula (8) No. | $R_4$ |
|---|---|
| 8-1 | —CN |
| 8-2 | —Br |
| 8-3 | —Cl |

TABLE 15

| No. | Dye of the formula (9) $R_5$ | $R_6$ | $R_7$ | $R_8$ |
|---|---|---|---|---|
| 9-1 | $—C_4H_9$ | $—C_4H_9$ | —Ph | $—NR_9R_{10}$ ($R_9 = COCH_3$, $R_{10}$ = COPh) |
| 9-2 | $—(C_2H_4O)_2C_2H_5$ | $—C_2H_5$ | —Ph | $—C_4H_9$ |
| 9-3 | $—C_4H_9$ | $—C_4H_8OH$ | 2-thienyl- | cyclohexyl |
| 9-4 | $—C_4H_9$ | $—C_4H_9$ | —Ph | $—C_3H_7$ |
| 9-5 | $—C_2H_4OCOCH_3$ | $—C_2H_4OCOCH_3$ | 2-theinyl- | $—C_4H_9$ |
| 9-6 | $—C_2H_5$ | $—C_2H_5$ | —Ph | $—C_2H_4OCH_3$ |
| 9-7 | $—C_2H_5$ | $—C_2H_5$ | 4-methoxyphenyl- | $—C_6H_{13}$ |
| 9-8 | $—C_2H_5$ | $—C_2H_5$ | 2-thienyl- | $—C_6H_{13}$ |
| 9-9 | $—C_2H_4OCOCH_3$ | $—C_2H_4OCOCH_3$ | —Ph | cyclohexyl |
| 9-10 | $—(C_2H_4O)_2C_2H_5$ | $—C_2H_5$ | —Ph | $—CH(CH_3)_2$ |

While the amounts of the anthraquinone and polymethine dyes as described above can vary depending upon the respective specific dyes selected, they are preferably used in a weight ratio of the anthraquinone dye to the polymethine dye of from 5:95 to 95:5. If the proportion of the anthraquinone dye is larger, the color density will be reduced and color reproducibility will be reduced. If the proportion of the anthraquinone dye is smaller, the light fastness will be reduced.

In order to adjust hue, known yellow dyes, magenta dyes or cyan dyes may be mixed. The dyes used are as described above.

The thermal transfer sheet of the present invention is characterized in that the specific dye mixture as described above is used. Other constitutions may be similar to those of the prior known thermal transfer sheets.

Any prior known material may be used as the base sheet for use in the thermal transfer sheet of the present invention wherein the dye mixture described above is used, provided that the material has a certain measure of heat resistance and strength. Examples of such materials include materials having a thickness of the order of from 0.5 to 50 micrometers, preferably from 3 to 10 micrometers such as papers, various processed papers, polyester films, polystyrene films, polypropylene films, polysulfone films, polycarbonate films, aramid films, polyvinyl alcohol films, cellophane and the like. A particularly preferred material is a polyester film.

A dye-containing layer provided on the surface of the base sheet as described above is a layer wherein the dye mixture described above is supported on the base sheet by an optional binder resin.

Any prior known binder resin can be used as the binder resin for supporting the dye mixture described above. Examples of the preferred binder resins include cellulosic resins such as ethyl cellulose, hydroxyethyl cellulose, ethyl hydroxyethyl cellulose, hydroxypropyl cellulose, methyl cellulose, cellulose acetate and cellulose acetate butyrate; vinylic resins such as polyvinyl alcohol, polyvinyl acetate, polyvinyl butyral, polyvinyl acetoacetal, polyvinyl pyrrolidone, polyacrylamide and polystyrene; and the like. Of these, polyvinyl butyral and polyvinyl acetal are particularly preferred from the standpoints of heat resistance and dye migration.

While the dye-containing layer of the thermal transfer sheet of the present invention is basically formed by the materials described above, it may include various additives similar to the prior known additives as needed. Such as dye-containing layer is preferably formed by adding the dye mixture, the binder resin and optional components to a suitable solvent to dissolve or disperse each component therein to prepare a coating solution or ink composition for forming the dye-containing layer, applying the coating solution or ink composition to the base sheet described above and drying the whole. The dye-containing layer thus formed has a thickness of the order of from 0.2 to 5.0 micrometers, preferably from 0.4 to 2.0 micrometers. It is suitable that the dye mixture in the dye-containing layer be present in an amount of from 5% to 70% by weight, preferably from 10% to 60% by weight bared on the weight of the dye-containing layer. While the present thermal transfer sheet as described above is sufficiently useful for thermal transfer as it is, the surface of the dye-containing layer may be provided with an antisticking layer, i.e., a release layer. Such a layer prevents the sticking between the thermal transfer sheet and the transferable material during the thermal transfer operation. Thus, higher thermal transfer temperatures can be used, and images having an even more excellent density can be formed.

When an antisticking inorganic powder is merely deposited, the resulting release layer exerts a relatively high effect. Further, a release layer having a thickness of from 0.1 to 5 micrometers, preferably from 0.05 to 2 micrometers can be formed from resins having excellent releasability such as silicone polymers, acrylic polymers and fluorinated polymers.

Even if the inorganic powder or releasing polymers as described above are included in the dye-containing layer, a sufficient effect can be obtained.

Further, the back surface of such a thermal transfer sheet may be provided with a heat-resistant layer in order to prevent adverse effect due to the heat of the thermal head.

Any transferable material may be used in forming images using the thermal transfer sheet as described above, provided that its recording surface has a dye receptivity against the dye described above. When the transferable materials are those having no dye receptivity such as papers, metals, glasses and synthetic resins, a dye-receptive layer may be formed or at least one surface thereof.

Means for imparting a heat energy used in carrying out thermal transfer using the present thermal transfer sheet as described above and the recordable material as described above may be any of the prior known means. For example, a required purpose can be achieved by imparting a heat energy of the order of from 5 to 100 $mJ/mm^2$ by controlling the recording time vic a recording device such as a thermal printer (e.g., Video Printer VY-100 manufactured by Hitachi Seisakusho).

According to the thermal transfer sheet of the present invention, magenta images can be formed. Full color images having excellent color reproducibility can be provided by using the present thermal transfer sheet having the magenta dye-containing layer in combination with a thermal transfer sheet having a yellow dye-containing layer and a thermal transfer sheet having a cyan dye-containing layer. Alternatively, full color images having excellent color reproducibility can be provided by a thermal transfer sheet having a layer formed by superficially successively applying a yellow dye, the magenta dye and a cyan dye.

EXAMPLES 262 THROUGH 293

An ink composition for forming a dye-containing layer having the following composition was prepared. The ink composition was applied to a polyethylene terephthalate film having a thickness of 6 micrometers (wherein its back surface had been treated to provide heat resistance) so that the dry coating weight was 1.0 gram per square meter. The whole was dried to obtain a thermal transfer sheet of the present invention.

| Ink Composition | |
|---|---|
| Anthraquinone dye | "a" parts |
| Polymethine dye | "b" parts |
| Polyvinyl butyral resin | 4.5 parts |
| Methyl ethyl ketone | 45.75 parts |
| Toluene | 45.75 parts |

When the dyes in the composition described above were insoluble, a solvent such as DMF, dioxane or chloroform was suitably used. (The dyes used and their amounts ("a", "b") are shown in the following Table 16.) For Examples 292 and 293, hue adjustment was carried out by mixing a yellow dye as described hereinafter.

Synthetic paper (Yupo FPG #150 manufactured by Oji Yuka) was used as a base sheet. A coating solution having the following composition was applied to the one surface of the base sheet so that its dry coating weight was 10.0 grams per square meter. The whole was dried for 30 minutes at 100° C. to obtain a transferable material.

Polyester resin (Vylon 200 11.5 parts manufactured by Toyobo)

Vinyl chloride-vinyl acetate copolymer 5.0 parts (VYHH manufactured by U.C.C.)

Amino-modified silicone (KF-393 1.2 part manufactured by Shin-etsu Kaguku Kogyo)

Epoxy-modified silicone (X-22-343 1.2 part manufactured by Shin-etsu Kagaku Kogyo)

Methyl ethyl ketone/toluene/cyclohexanone 102.0 parts (weight ratio of 4:4:2)

Thermal Transfer Recording Test

The present thermal transfer sheet described above and the transferable material described above were stacked with the dye-containing layer opposing to the dye-receptive surface. Recording was carried out by means of a thermal head from the back surface of the thermal transfer sheet under a head application voltage of 11 V for an application time of 16 msec. The results are shown in Table 16.

Color Reproducibility Test

A Yellow-color thermal transfer sheet was obtained as in Example 262 except that an ink composition for forming a dye-containing layer having the following composition was used.

| | |
|---|---|
| C.I. Disperse Yellow 141 | 3 parts |
| Polyvinyl butyral resin | 4.5 parts |
| Methyl ethyl ketone | 46.25 parts |
| Toluene | 46.25 parts |

The Yellow-color thermal transfer sheet described above was used as in the thermal transfer test described above to form a Yellow image. The thermal transfer sheet of the present invention was used at the same signal to superpose a magenta thereon. Thus, a red image was formed.

The resulting red image, and the magenta image of the thermal transfer test were visually observed to evaluate color reproducibility on the following criteria. The results are shown in Table 16.

◎: very clear
○: clear
Δ: slightly unclear
x: unclear

Light Fastness Test

A light fastness test of the yellow images obtained in the thermal transfer test described above was carried out by means of a xenon fadeometer (Ci 35 A manufactured by Atlas) (the black panel temperature being 50° C. and the illuminance being 50 kLux). In any case, discoloration and fading did not occur when the irradiation time wad 50 hours.

Measurement of Color Density

The color density was measured by means of a densitometer RD-918 manufactured by U.S. Macbeth Company.

TABLE 16

| | Anthraquinone Dye | | Polymethine Dye | | | | |
|---|---|---|---|---|---|---|---|
| Ex. | Formula and Number | Amount used "a" | Formula and Number | Amount used "b" | Color Density | Light Fastness | Color Reproducibility |
| 262 | 5-1 | 2.0 | 9-1 | 2.0 | 1.87 | ○ | ◎ |
| 263 | 5-1 | 1.5 | 9-7 | 2.5 | 1.82 | ○ | ◎ |
| 264 | 5-2 | 1.5 | 9-1 | 2.5 | 1.91 | ○ | ◎ |
| 265 | 5-2 | 2.0 | 9-4 | 2.0 | 1.87 | ○ | ○ |
| 266 | 5-4 | 2.5 | 9-7 | 1.5 | 1.83 | ○ | ◎ |
| 267 | 5-5 | 3.0 | 9-8 | 1.0 | 1.78 | ○ | ◎ |
| 268 | 5-9 | 2.0 | 9-2 | 2.0 | 1.85 | ○ | ◎ |
| 269 | 5-12 | 1.0 | 9-4 | 3.0 | 1.94 | ○ | ◎ |
| 270 | 5-19 | 2.0 | 9-1 | 2.0 | 1.81 | ○ | ◎ |
| 271 | 5-23 | 2.0 | 9-6 | 2.0 | 1.78 | ○ | ◎ |
| 272 | 5-28 | 0.5 | 9-10 | 3.5 | 1.92 | ○ | ◎ |
| 273 | 5-29 | 2.0 | 9-2 | 2.0 | 1.81 | ○ | ◎ |
| 274 | 5-34 | 2.0 | 9-3 | 2.0 | 1.83 | ○ | ◎ |
| 275 | 5-36 | 3.5 | 9-4 | 0.5 | 1.71 | ○ | ◎ |
| 276 | 5-39 | 2.0 | 9-1 | 2.0 | 1.78 | ○ | ◎ |
| 277 | 5-42 | 1.5 | 9-2 | 2.5 | 1.86 | ○ | ◎ |
| 278 | 6-1 | 2.0 | 9-4 | 2.0 | 1.82 | ○ | ◎ |
| 279 | 6-4 | 2.0 | 9-4 | 2.0 | 1.78 | ○ | ◎ |
| 280 | 6-9 | 2.0 | 9-10 | 2.0 | 1.79 | ○ | ◎ |
| 281 | 7-1 | 2.0 | 9-3 | 2.0 | 1.80 | ○ | ◎ |
| 282 | 7-1 | 2.0 | 9-9 | 2.0 | 1.80 | ○ | ◎ |
| 283 | 7-4 | 2.0 | 9-1 | 2.0 | 1.78 | ○ | ◎ |
| 284 | 7-7 | 2.0 | 9-5 | 2.0 | 1.84 | ○ | ◎ |
| 285 | 7-17 | 2.0 | 9-8 | 2.0 | 1.83 | ○ | ◎ |
| 286 | 7-19 | 2.0 | 9-7 | 2.0 | 1.81 | ○ | ◎ |
| 287 | 7-21 | 2.0 | 9-2 | 2.0 | 1.79 | ○ | ◎ |
| 288 | 7-23 | 1.5 | 9-4 | 2.5 | 1.89 | ○ | ◎ |
| 289 | 7-25 | 1.5 | 9-6 | 2.5 | 1.91 | ○ | ◎ |
| 290 | 8-2 | 1.0 | 9-7 | 3.0 | 1.96 | ○ | ◎ |

| | Anthraquinone Dye | | Polymethine Dye | | Yellow Dye | | | | |
|---|---|---|---|---|---|---|---|---|---|
| Ex. | Formula and Number | Amount used "a" | Formula and Number | Amount used "b" | Dye Number | Amount used "c" | Color Density | Light Fastness | Color Reproducibility |
| 291 | 7-1 | 1.0 | 9-1 | 2.0 | — | — | 1.84 | ○ | ◎ |
| | 5-1 | 1.0 | | | | | | | |
| 291-1 | 7-1 | 0.5 | 9-1 | 3.0 | — | — | 1.93 | ○ | ◎ |
| | 5-1 | 0.4 | | | | | | | |
| 292 | 7-1 | 1.0 | 9-1 | 2.0 | I | 0.3 | 1.82 | ○ | ◎ |
| | 5-1 | 1.0 | | | | | | | |
| 293 | 7-1 | 1.5 | 9-1 | 1.0 | II | 0.3 | 1.78 | ○ | ◎ |
| | 5-1 | 0.5 | | | | | | | |
| 293-1 | 7-1 | 2.5 | 9-1 | 1.5 | I | 0.3 | 1.80 | ○ | ◎ |
| 293-2 | 7-1 | 2.0 | 9-1 | 2.0 | II | 0.2 | 1.83 | ○ | ◎ |

Yellow Dye

TABLE 16-continued

| | |
|---|---|
| 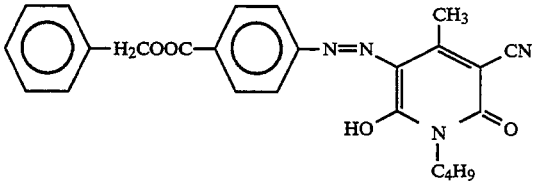 | 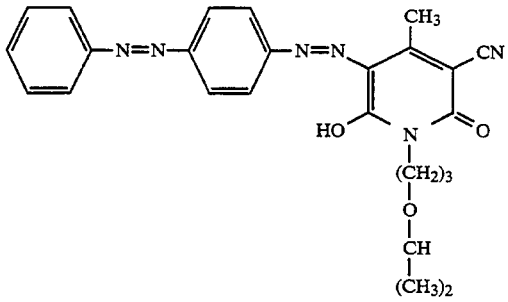 |
| I<br>Foron Brilliant Yellow S-6GL<br>(C.I. Disperse Yellow 201 manufactured by Sand Company) | II<br>Terasil Golden Yellow 2RS<br>(C.I. Disperse Orange 149 manufactured by Ciba-Geigy Corporation) |

COMPARATIVE EXAMPLES 21 THROUGH 35

Example 262 was repeated except that the following dyes were used in place of the dye in Example. The results are shown in Table 17.

| | |
|---|---|
| Dye of the following Table 17 | "a" parts |
| Polyvinyl butyral resin | 4.5 parts |
| Methyl ethyl ketone | 46.25 parts |
| Toluene | 46.25 parts |

TABLE 17

| Com. Ex. | Dye: Formula and Number | Dye: Amount used "a" | Color Density | Light Fastness | Color Reproducibility |
|---|---|---|---|---|---|
| 21 | 5-1 | 4.0 | 1.60 | ○ | Δ |
| 22 | 5-2 | 4.0 | 1.58 | ○ | Δ |
| 23 | 5-12 | 4.0 | 1.57 | ○ | Δ |
| 24 | 5-36 | 4.0 | 1.61 | ○ | Δ |
| 25 | 6-1 | 4.0 | 1.55 | ○ | X |
| 26 | 6-4 | 4.0 | 1.58 | ○ | Δ |
| 27 | 7-1 | 4.0 | 1.60 | ○ | X |
| 28 | 7-7 | 4.0 | 1.57 | ○ | X |
| 29 | 8-1 | 4.0 | 1.59 | ○ | Δ |
| 30 | 9-1 | 4.0 | 1.87 | X | ◎ |
| 31 | 9-2 | 4.0 | 1.80 | X | ◎ |
| 32 | 9-3 | 4.0 | 1.78 | X | ◎ |
| 33 | 9-5 | 4.0 | 1.86 | X | ◎ |
| 34 | 9-7 | 4.0 | 1.92 | ◎ | |
| 35 | 9-9 | 4.0 | 1.88 | X | ◎ |

According to the present invention as described above, there can be provided the thermal transfer sheets which provide full color images having excellent color density, clearness and fastnesses, particularly light fastness by using the mixture of the specific dyes in spite of the high saturation of the magenta color.

A preferred embodiment of a cyan dye illustrates the present invention in more detail.

Dyes represented by the above formulae (10) through (14) used in the present invention can be used alone or in mixture. Dyes represented by the above formulae (15) and (16) used in the present invention can be used alone or in mixture.

Dyes of the formulae (10) through (16) suitable for use in the present invention are shown in Tables 18 through (24) by expressing them by their substituents. The substituents which are not described therein refer to a hydrogen atom. These dyes per se are dyes known as disperse dyes or the like, and they are available in the market to use in the present invention.

TABLE 18

| Dye of the formula (10) | | |
|---|---|---|
| No | $R_1$ | $R_2$ |
| 1 | hydrogen arom- | 3-methylphenyl |
| 2 | methyl- | 4-methylphenyl- |
| 3 | isopropyl- | 4-butylphenyl- |
| 4 | 2-(2-methoxyethoxy) ethoxyphenyl- | 4-methoxyphenyl- |
| 5 | 4-hydroxybutyl- | 3-methylphenyl |
| 6 | isopropyl- | 4-(3-hydroxypropyl)phenyl- |
| 7 | methyl- | isopropyl- |
| 8 | isopropyl- | 1,4-dimethylphenyl- |

TABLE 19

| Dye of the formula (11) | |
|---|---|
| No | $R_1$ |
| 1 | $-C_3H_6OCH_3$ |
| 2 | $-C_2H_4OC_2H_4OC_2H_5$ |
| 3 | 3-ethylhexyl- |
| 4 | cyclohexyl- |
| 5 | 3-isopropylhexyl- |
| 6 | 2-(3-ethylphenyl)ethyl- |

TABLE 20

| Dye of the formula (12) | | |
|---|---|---|
| No | $R_1$ | $R_2$ |
| 1 | 3,4-dimethylphenyl- | 3,4-dimethylphenyl- |
| 2 | 3-isopropylphenyl- | 4-butylphenyl- |
| 3 | 3,4-dimethylphenyl- | 2-ethoxycyclohexyl- |
| 4 | phenyl- | 2-(3-methylphenyl)ethyl- |
| 5 | 3-methoxyphenyl- | 3-ethyhexyl- |
| 6 | 3-ethoxypropyl- | 1,5-dimethylhexyl- |
| 7 | 2-methylpropyl- | 2-methylcyclohexyl- |
| 8 | 2-(benzyl)cyclohexyl- | benzyl- |

TABLE 21

| Dye of the formula (13) | | |
|---|---|---|
| No | $R_1$ | $R_2$ |
| 1 | 3,4-diemthylphenyl- | 3,4-dimethylphenyl- |
| 2 | 3-isopropylphenyl- | phenyl- |
| 3 | 3,4-dimethylphenyl- | 2-ethoxycyclohexyl- |
| 4 | 3-methoxyphenyl- | 2-(3-methylphenyl)ethyl- |
| 5 | 3-[2-(2-methoxyethoxy) ethoxy]phenyl- | 4-(4-hydroxybutyl)phenyl- |
| 6 | 3-(2-ethoxyethoxy)propyl- | 1,5-dimethylcyclohexyl- |
| 7 | 2-methylpropyl- | 2-methylcyclohexyl- |
| 8 | 2-isopropylcyclohexyl- | benzyl- |

TABLE 22

| Dye of the formula (14) | | |
|---|---|---|
| No | $R_1$ | $R_2$ |
| 1 | $-C_2H_4OC_2H_5$ | $-C_3H_7$ |
| 2 | $-C_3H_6OC_2H_5$ | $-C_2H_4Ph$ |
| 3 | $-C_2H_4OH$ | $-C_3H_7$ |
| 4 | $-C_2H_5$ | $-C_2H_4OC_2H_4OCH_3$ |
| 5 | $-CH_3$ | $-C_6H_{12}OH$ |

TABLE 22-continued

| Dye of the formula (14) | | |
|---|---|---|
| No | $R_1$ | $R_2$ |
| 6 | $-C_3H_6OH$ | cyclohexyl- |
| 7 | allyl- | $-C_2H_4OCH_3$ |
| 8 | 3-methylphenyl- | $-C_2H_4OCH_3$ |
| 9 | 3-methylphenyl- | cyclohexyl- |

TABLE 23

| Dye of the formula (15) | | | | |
|---|---|---|---|---|
| No | $R_{12}$ | $R_{13}$ | $R_3$ | $R_4$ |
| 1 | $-C_2H_5$ | $-C_2H_5$ | —H | —H |
| 2 | $-C_2H_5$ | $-C_2H_5$ | 2-$CH_3$ | —H |
| 3 | $-C_2H_5$ | $-C_2H_5$ | 2-$CH_3$ | $-CH_3$ |
| 4 | $-C_2H_5$ | $-C_2H_5$ | —H | $-NHCOC_3H_7$ |
| 5 | $-C_2H_5$ | $-C_2H_5$ | 2-$CH_3$ | $-CONHCH_3$ |
| 6 | $-C_2H_5$ | $-C_2H_5$ | 2-$CH_3$ | $-NHSO_2CH_3$ |
| 7 | $-C_2H_5$ | $-C_2H_5$ | 4-$CH_3$ | $-SO_2NHCH_3$ |
| 8 | $-C_2H_5$ | $-C_2H_5$ | 2-$NHCOCH_3$ | $-NHCOCH_3$ |
| 9 | $-C_2H_5$ | $-C_2H_5$ | 2-$NHCOCH_3$ | $-NHSO_2CH_3$ |
| 10 | $-C_2H_5$ | $-C_2H_5$ | 4-$NHCOCH_3$ | $-CONHCH_3$ |
| 11 | $-C_2H_5$ | $-C_2H_5$ | 2-$NHCOCH_3$ | $-SO_2NHCH_3$ |
| 12 | $-C_2H_4OH$ | $-C_2H_5$ | 2-$CH_3$ | $-CONHCH_3$ |
| 13 | $-C_2H_4CN$ | $-C_2H_5$ | 2-$CH_3$ | $-CONHCH_3$ |
| 14 | $-C_2H_4OCH_3$ | $-C_2H_5$ | 2-$CH_3$ | $-CONHCH_3$ |
| 15 | $-C_2H_4OCOCH_3$ | $-C_2H_5$ | 4-$CH_3$ | $-CONHCH_3$ |
| 16 | $-C_2H_4OCOPh$ | $-C_2H_5$ | 2-$CH_3$ | $-CONHCH_3$ |
| 17 | $-C_2H_4OCOOCH_3$ | $-C_2H_5$ | 2-$CH_3$ | $-CONHCH_3$ |
| 18 | $-C_2H_4OCOOPh$ | $-C_2H_5$ | 2-$CH_3$ | $-CONHCH_3$ |
| 19 | $-C_2H_4OCOCH_3$ | $-C_2H_4OCOCH_3$ | 2-$CH_3$ | $-CONHCH_3$ |
| 20 | $-C_2H_4OCOCH_3$ | $-C_2H_4OCOCH_3$ | 2-$CH_3$ | $-CONHCH_3$ |
| 21 | $-C_2H_4OCOCH_3$ | $-C_2H_4OCOCH_3$ | 2-$NHCOCH_3$ | $-CONHCH_3$ |
| 22 | $-C_2H_4OCH_3$ | $-C_2H_4OCH_3$ | 2-$NHCOCH_3$ | $-CONHCH_3$ |
| 23 | $-C_2H_4OC_2H_4OCH_3$ | $-C_2H_5$ | 2-$NHCOCH_3$ | $-CONHCH_3$ |
| 24 | $-C_2H_4OCH_2Ph$ | $-C_2H_5$ | 2-$CH_3$ | $-CONHCH_3$ |
| 25 | $-C_2H_4OCH_2Ph$ | $-C_2H_5$ | 2-$NHCOCH_3$ | $-CONHCH_3$ |
| 26 | $-C_2H_4O$-cyclohexyl | $-C_2H_5$ | 2-$CH_3$ | $-CONHCH_3$ |
| 27 | $-C_2H_4OPh$ | $-C_2H_5$ | 2-$CH_3$ | $-CONHCH_3$ |
| 28 | $-C_2H_4OPh$ | $-C_2H_5$ | 2-$NHCOCH_3$ | $-CONHCH_3$ |
| 29 | $-C_2H_5$ | $-C_2H_5$ | 2-$CH_3$ | —Cl |
| 30 | $-C_2H_5$ | $-C_2H_5$ | —H | —Cl |
| 31 | $-C_2H_5$ | $-C_2H_5$ | 2-$NHCOCH_3$ | —Cl |
| 32 | $-C_2H_5$ | $-C_2H_5$ | 4-$NHSO_2CH_3$ | —Cl |
| 33 | $-C_2H_5$ | $-C_2H_5$ | 2-$NHCOC_2H_5$ | $-CONHCH_3$ |
| 34 | $-C_2H_4OCH_3$ | $-C_2H_5$ | 2-$NHCOC_2H_5$ | $-CONHCH_3$ |
| 35 | $-C_2H_4OCOCH_3$ | $-C_2H_5$ | 2-$NHCOC_2H_5$ | $-CONHCH_3$ |
| 36 | $-C_2H_5$ | $-C_2H_5$ | 2-$NHCON(C_2H_5)_2$ | $-CONHCH_3$ |
| 37 | $-C_2H_5$ | $-C_2H_5$ | 2-$NHCONHCH_3$ | $-CONHCH_3$ |
| 38 | $-C_2H_5$ | $-C_2H_5$ | 2-$NHCOCOC_2H_5$ | $-CONHCH_3$ |
| 39 | $-C_2H_5$ | $-C_2H_5$ | 2-$NHCOOCH_3$ | $-CONHCH_3$ |
| 40 | $-C_2H_5$ | $-C_2H_5$ | 2-$NHCOCH_2Ph$ | $-CONHCH_3$ |
| 41 | $-C_2H_5$ | $-C_2H_5$ | 2-NHCOPh | $-CONHCH_3$ |
| 42 | $-C_2H_5$ | $-C_2H_5$ | 2-$NHSO_2C_2H_5$ | $-CONHCH_3$ |
| 43 | $-C_2H_5$ | $-C_2H_5$ | 2-$NHSO_2NHCH_3$ | $-CONHCH_3$ |
| 44 | $-C_2H_5$ | $-C_2H_5$ | $-CONHCOCH_3$ | $-CONHCH_3$ |
| 45 | $-C_2H_5$ | $-C_2H_5$ | 2-$NHCOCH_3$ | $-CONHCH_3$ |
| 46 | $-C_2H_5$ X=$NHCOCH_3$ | $-C_2H_5$ | 2-$NHCOCH_3$ | $-CONHCH_3$ |
| 47 | $-C_2H_5$ X=CN | $-C_2H_5$ | 2-$CH_3$ | $-CONHCH_3$ |
| 48 | $-C_2H_5$ X=$-NHCOCH_3$ | $-C_2H_5$ | 4-$CH_3$ | $-CONHCH_3$ |
| 49 | $-C_2H_5$ | $-C_2H_5$ | 2-$CH_3$ | $-NHCH_3$ |
| 50 | $-C_2H_5$ | $-C_2H_5$ | 2-$CH_3$ | $-N(CH_3)_3$ |
| 51 | $-C_2H_5$ | $-C_2H_5$ | 2-$NHCOCH_3$ | $-N(C_2H_5)_2$ |
| 52 | $-C_2H_5$ | $-C_2H_5$ | 2-$NHSO_2CH_3$ | $-N(C_2H_5)_2$ |
| 53 | $-C_2H_5$ | $-C_2H_5$ | 2-OH | —OH |
| 54 | $-C_2H_5$ | $-C_2H_5$ | 2-OH | $-NHCOCH_3$ |
| 55 | $-C_2H_5$ | $-C_2H_5$ | 2-OH | $-CONHCH_3$ |
| 56 | $-C_2H_5$ | $-C_2H_5$ | 2-OH | —NHCOPh |
| 57 | $-C_2H_5$ | $-C_2H_5$ | 2-OH | —CONHPh |
| 58 | $-C_2H_5$ | $-C_2H_5$ | 2-OH | —CONH-cyclohexyl |
| 59 | $-C_2H_5$ | $-C_2H_5$ | 2-OH | $-CONHCH_2Ph$ |
| 60 | $-C_2H_5$ | $-C_2H_5$ | 4-OH | $-CONHC_2H_5$ |
| 61 | $-C_2H_5$ | $-C_2H_5$ | 2-$OCH_3$ | $-CONHCH_3$ |
| 62 | $-C_2H_5$ | $-C_2H_5$ | 2-$OCH_3$ | —NHCOPh |
| 63 | $-C_2H_5$ | $-C_2H_5$ | 2-$OCH_3$ | —CONHPh |
| 64 | $-C_2H_5$ | $-C_2H_5$ | 2-$OCH_3$ | $-NHCOCH_3$ |
| 65 | $-C_2H_5$ | $-C_2H_5$ | 2-Cl | —Cl |
| 66 | $-C_2H_5$ | $-C_2H_5$ | 2-Cl | $-CONHCH_3$ |
| 67 | $-C_2H_5$ $R_9$=2-$CH_3$ | $-C_2H_5$ | 2-$CH_3$ | $-CONHCH_3$ |
| 68 | $-C_2H_5$ $R_9$=$-NH_3$ | $-C_2H_5$ | 2-$CH_3$ | $-CONHCH_3$ |

TABLE 23-continued

| No | $R_{12}$ | $R_{13}$ | $R_3$ | $R_4$ |
|---|---|---|---|---|
| | Dye of the formula (15) | | | |
| 69 | $-C_2H_5$ $R_9$=$NHCH_3$ | $-C_2H_5$ | 4-$CH_3$ | $-CONHCH_3$ |
| 70 | $-C_2H_5$ $R_9$=—OH | $-C_2H_5$ | 2-$CH_3$ | $-CONHCH_3$ |
| 71 | $-C_2H_5$ | $-C_2H_5$ | 2-$CH_3$ | —CONH-thienyl (3) |
| 72 | $-C_2H_5$ | $-C_2H_5$ | 2-$CH_3$ | —CONH-thienyl (2) |
| 73 | $-C_2H_5$ | $-C_2H_5$ | 2-$CH_3$ | —CONH-furyl (2) |
| 74 | $-C_2H_5$ | $-C_2H_5$ | 2-$CH_3$ | $-COOCH_3$ |
| 75 | $-C_2H_5$ | $-C_2H_5$ | 2-$CH_3$ | —$CONHCH_2$-thienyl (2) |
| 76 | $-C_2H_5$ | $-C_2H_5$ | 2-$CH_3$ | —$CONHCH_2$-thienyl (3) |
| 77 | $-C_2H_5$ | $-C_2H_5$ | 2-$CH_3$ | —NHCO-thienyl (3) |
| 78 | $-C_2H_5$ | $-C_2H_5$ | 2-$CH_3$ | —NHCO-thienyl (2) |
| 79 | $-C_2H_5$ | $-C_2H_5$ | 2-$CH_3$ | —$NHCOCH_2$-thienyl (2) |
| 80 | $-C_2H_4OCH_3$ | $-C_2H_5$ | 2-$CH_3$ | —CONH-thienyl (2) |
| 81 | $-C_2H_4OCH_3$ | $-C_2H_4OCH_3$ | 2-$CH_3$ | —CONH-thienyl (2) |
| 82 | $-C_2H_4OCOCH_3$ | $-C_2H_5$ | 2-$CH_3$ | —CONH-thienyl (2) |
| 83 | $-C_2H_4OCOCH_3$ | $-C_2H_4OCOCH_3$ | 2-$CH_3$ | —CONH-thienyl (2) |
| 84 | $-C_2H_4CN$ | $-C_2H_5$ | 2-$CH_3$ | —CONH-thienyl (2) |
| 85 | $-C_2H_4OH$ | $-C_2H_5$ | 2-$CH_3$ | —CONH-thienyl (2) |
| 86 | $-C_2H_4OCH_3$ | $-C_2H_5$ | 2-$NHCOCH_3$ | —CONH-thienyl (2) |
| 87 | $-C_2H_4OCH_3$ | $-C_2H_4OCH_3$ | 2-$NHCOCH_3$ | —CONH-thienyl (2) |
| 88 | $-C_2H_4OCOCH_3$ X=CN | $-C_2H_5$ | 2-$NHCOCH_3$ | —CONH-thienyl (2) |
| 89 | $-C_2H_4COOCH_3$ | $-C_2H_5$ | 2-$NHCOCH_3$ | $-CONHCH_3$ |
| 90 | $-C_2H_4COOCH_3$ | $-C_2H_4COOCH_3$ | 2-$CH_3$ | $-CONHCH_3$ |
| 91 | $-C_2H_4COOCH_3$ | $-C_2H_4COOCH_3$ | 2-$NHCOCH_3$ | $-CONHCH_3$ |
| 92 | $-C_2H_5$ | $-C_2H_5$ | 4-$CH_3$ | $-CONHNHCH_3$ |
| 93 | $-C_2H_5$ | $-C_2H_5$ | 2-$CH_3$ | —CONH-piperidyl (1) |
| 94 | $-C_2H_5$ | $-C_2H_5$ | 2-$CH_3$ | —CONH-morpholyl (1) |
| 95 | $-C_2H_5$ | $-C_2H_5$ | 2-$CH_3$ | —CONH-bicyclo[2,2,1]-hepto-2-yl |
| 96 | $-C_2H_5$ | $-C_2H_5$ | 2-$CH_3$ | 2-NHCO-bicyclo[2,2,1]-hepto-2-yl |
| 97 | $-C_2H_5$ | $-C_2H_5$ | 2-$NHCOCH_3$ | —CONH-piperidyl (1) |
| 98 | $-C_2H_5$ | $-C_2H_5$ | 2-$NHCOC_2H_5$ | —CONH-morpholyl (1) |
| 99 | $-C_2H_5$ | $-C_2H_5$ | 2-$NHCOCH_3$ | —CONH-pyrrolidolyl (1) |
| 100 | $-C_2H_5$ | $-C_2H_5$ | 2-$NHCOCH_3$ | —CO-pyrrolidol (1) |
| 101 | $-C_2H_5$ | $-C_2H_5$ | 2-$CH_3$ | —CO-pyrrolidol (1) |
| 102 | $-C_2H_5$ | $-C_2H_5$ | 2-$CONHCH_3$ | $-CONHCH_3$ |
| 103 | $-C_2H_5$ | $-C_2H_5$ | 2-$SO_2NHCH_3$ | $-CONHCH_3$ |
| 104 | X and (—$C_3H_6$—) | $-C_2H_5$ | 2-$CH_3$ | $-CONHCH_3$ |
| 105 | X and (—$C_3H_6$—) | $-C_2H_4OCH_3$ | 4-$CH_3$ | $-CONHCH_3$ |
| 106 | X and (—$C_3H_6$—) | $-C_2H_4OCOCH_3$ | 2-$CH_3$ | $-CONHCH_3$ |
| 107 | X and (—$C_3H_6$—) | $-C_2H_5$ | 2-$NHCOCH_3$ | $-CONHCH_3$ |
| 108 | X and (—$C_3H_6$—) | $-CH_3$ | 2-$CH_3$ | —CONHPh |
| 109 | X and (—$C_3H_6$—) | —H | 2-$CH_3$ | —CONHPh |
| 110 | X and (—$C_3H_6$—) | $-C_2H_5$ | 2-$OC_2H_5$ | —CONHPh |
| 111 | X and (—$C_3H_6$—) | $-C_2H_5$ | 2-$OC_2H_5$ | —NHCOPh |
| 112 | $R_{12}$ and $R_{13}$ form (—$C_5H_{10}$—) | | 2-$CH_3$ | $-CONHCH_3$ |
| 113 | $R_{12}$ and $R_{13}$ form (—$C_2H_4OC_2H_4$—) | | 2-$CH_3$ | $-CONHCH_3$ |
| 114 | $R_{12}$ and $R_{13}$ form (—$C_5H_{10}$—) | | 2-$NHCOCH_3$ | $-CONHCH_3$ |
| 115 | $R_{12}$ and $R_{13}$ form (—$C_5H_{10}$—) | | 2-$CH_3$ | —CONHPh |
| 116 | $R_{12}$ and $R_{13}$ form (—$C_4H_8$—) | | 2-$NHCOCH_3$ | —CONHPh |

TABLE 24

| No | $R_{12}$ | $R_{13}$ | $R_3$ | $R_4$ | $R_6$ | $R_7$ |
|---|---|---|---|---|---|---|
| | Dye of the formula (16) | | | | | |
| 1 | $-C_2H_5$ | $-C_2H_5$ | —H | $-NHCOCH_3$ | —H | —H |
| 2 | $-C_2H_5$ | $-C_2H_5$ | 2-$CH_3$ | $-NHCOC_2H_5$ | $-CH_3$ | —H |
| 3 | $-C_2H_5$ | $-C_2H_5$ | 2-$NHCOCH_3$ | —NHCOPh | —H | —Cl |
| 4 | $-C_2H_5$ | $-C_2H_5$ | 2-$NHCOC_2H_5$ | —NHCO-cyclohexyl | $-C_2H_5$ | —Cl |
| 5 | $-C_2H_4CN$ | $-C_2H_5$ | 2-OH | $-NHCOCH_3$ | $-CH_3$ | —Cl |
| 6 | $-C_2H_4OH$ | $-C_2H_5$ | 2-$CH_3$ | $-NHCOCH_3$ | $-CH_3$ | —Cl |
| 7 | $-C_2H_4OCH_3$ | $-C_2H_5$ | 2-$CH_3$ | $-NHCOCH_3$ | $-CH_3$ | —Cl |
| 8 | $-C_2H_4OCOCH_3$ | $-C_2H_5$ | 2-$CH_3$ | $-NHCOCH_3$ | $-CH_3$ | —Cl |
| 9 | $-C_2H_4OCOOPh$ | $-C_2H_5$ | 2-$CH_3$ | $-NHCOCH_3$ | $-CH_3$ | —Cl |
| 10 | $-C_2H_4OPh$ | $-C_2H_5$ | 2-$CH_3$ | $-NHCOCH_3$ | $-CH_3$ | —Cl |
| 11 | $-C_2H_4OCH_2Ph$ | $-C_2H_5$ | 2-$CH_3$ | $-NHCOCH_3$ | $-CH_3$ | —Cl |
| 12 | $-C_2H_4OC_2H_4OCH_3$ | $-C_2H_5$ | 2-$CH_3$ | $-NHCOCH_3$ | $-CH_3$ | —Cl |
| 13 | $-C_2H_4COOCH_3$ | $-C_2H_5$ | 2-$CH_3$ | $-NHCOCH_3$ | $-CH_3$ | —Cl |
| 14 | $-C_2H_5$ | $-C_2H_5$ | —H | $-NHCOCH_3$ | $-CH_3$ | —Cl |
| 15 | $-C_2H_5$ | $-C_2H_5$ | 2-$CH_3$ | $-NHCOC_2H_5$ | $-CH_3$ | —Cl |
| 16 | $-C_2H_5$ | $-C_2H_5$ | 2-$CH_3$ | $-NHCOCNHCH_3$ | $-CH_3$ | —Cl |
| 17 | $-C_2H_5$ | $-C_2H_5$ | 2-$CH_3$ | $-NHSO_2CH_3$ | $-CH_3$ | —Cl |
| 18 | $-C_2H_5$ | $-C_2H_5$ | 4-$CH_3$ | $-CONHCH_3$ | $-CH_3$ | —Cl |
| 19 | $-C_2H_5$ | $-C_2H_5$ | 4-$CH_3$ | $-SO_2NHCH_3$ | $-CH_3$ | —Cl |
| 20 | $-C_2H_5$ | $-C_2H_5$ | 4-$CH_3$ | $-NHCOCH_3$ | $-N(CH_3)_2$ | —Cl |
| 21 | $-C_2H_5$ | $-C_2H_5$ | 4-$CH_3$ | $-NHCOCH_3$ | $-N(C_2H_5)_2$ | —Cl |
| 22 | $-C_2H_5$ | $-C_2H_5$ | 2-$CH_3$ | $-NHCOCH_3$ | $-NHCOCH_3$ | —Cl |

TABLE 24-continued

| | Dye of the formula (16) | | | | | |
|---|---|---|---|---|---|---|
| No | $R_{12}$ | $R_{13}$ | $R_3$ | $R_4$ | $R_6$ | $R_7$ |
| 23 | $-C_2H_5$ | $-C_2H_5$ | 2-$C_2H_5$ | $-NHCOC_6H_{13}$ | $-CH_3$ | —Cl |
| 24 | $-C_2H_5$ | $-C_2H_5$ | 2-$NHSO_2CH_3$ | $-NHCOCH_3$ | $-C_2H_5$ | —Cl |
| 25 | $-C_2H_4OCH_3$ | $-C_2H_5$ | 2-$OC_2H_5$ | $-NHCOCH_3$ | $-C_2H_5$ | —Cl |
| 26 | $-C_2H_4OCOCH_3$ | $-C_2H_4OCOCH_3$ | 2-$CH_3$ | —NHCOPh | $-CH_3$ | —Cl |
| 27 | $-C_2H_4OCOCH_3$ | $-C_2H_4OCOCH_3$ | 2-$NHCOCH_3$ | —NHCOPh | $-CH_3$ | —Cl |
| 28 | $-C_2H_5$ | $-C_2H_5$ | 2-$CH_3$ | $-NHC_2H_5$ | $-C_2H_5$ | —Cl |
| 29 | $-C_2H_5$ | $-C_2H_5$ | 2-$NHCONHCH_3$ | $-N(C_2H_5)_2$ | $-C_2H_5$ | —Cl |
| 30 | $-C_2H_4OCH_3$ | $-C_2H_5$ | 2-$CH_3$ | —Cl | —H | $-CH_3$ |
| 31 | $-C_2H_4OCH_3$ | $-C_2H_5$ | 2-$CH_3$ | —OH | —OH | —H |
| 32 | $-C_2H_4OCH_3$ | $-C_2H_5$ | 2-$COOCH_3$ | —H | —H | —H |
| 33 | $-C_2H_5$ | —H | 2-$CH_3$ | $-NHCOCH_3$ | $-CH_3$ | —Cl |
| 34 | $-C_2H_5$ | $-C_2H_5$ | 2-$CH_3$ | $-CONHCH_3$ | —H | —H |
| 35 | $-C_2H_5$ | $-C_2H_5$ | 2-$CH_3$ | $-CONHCH_3$ | $-CH_3$ | —H |
| 36 | $-C_2H_5$ | $-C_2H_5$ | 2-$CH_3$ | $-CONHCH_3$ | $-CH_3$ | —Cl |
| 37 | $-C_2H_5$ | $-C_2H_5$ | 2-OH | $-CONHCH_3$ | $-CH_3$ | —Cl |
| 38 | $-C_2H_5$ | $-C_2H_5$ | 2-$NHCONHC_2H_5$ | $-NHCOCH_3$ | $-CH_3$ | —Cl |
| 39 | $-C_2H_5$ | $-C_2H_5$ | 2-$NHCOCH_3$ | $-CONHCH_3$ | $-CH_3$ | —Cl |
| 40 | $-C_2H_5$ | $-C_2H_5$ | 2-$NHSO_2CH_3$ | $-CONHCH_3$ | $-CH_3$ | —Cl |
| 41 | $-C_2H_5$ | $-C_2H_5$ | 2-$NHCOCH_3$ | $-CONHCH_3$ | $-NHCH_3$ | —Cl |
| 42 | $-C_2H_5$ | $-C_2H_5$ | 2-$CH_3$ | $-CONHCH_3$ | $-N(CH_3)_2$ | —Cl |
| 43 | $-C_2H_5$ | $-C_2H_5$ | 4-$CH_3$ | $-CONHCH_3$ | $-NHCOCH_3$ | —Cl |
| 44 | $-C_2H_5$ | $-C_2H_5$ | 4-$CH_3$ | $-CONHCH_3$ | —NHPh | —Cl |
| 45 | $-C_2H_5$ | $-C_2H_5$ | 2-$CH_3$ | $-CONHCH_3$ | —NHPh | —H |
| 46 | $-C_2H_5$ | $-C_2H_5$ | 2-$CH_3$ | $-CONHCH_3$ | $-N(C_2H_5)_2$ | —H |
| 47 | $-C_2H_5$ | $-C_2H_5$ | 2-$CH_3$ | $-CONHCH_3$ | $-CONHCH_3$ | —Cl |
| 48 | $-C_2H_5$ | $-C_2H_5$ | 2-$CH_3$ | $-SO_2NHCH_3$ | $-CH_3$ | —Cl |
| 49 | $-C_2H_5$ | $-C_2H_5$ | 2-$NHCOCH_3$ | $-SO_2NHCH_3$ | $-C_2H_5$ | —Cl |
| 50 | $-C_2H_5$ | $-C_2H_5$ | 2-$NHCOCH_3$ | $-SO_2NHCH_3$ | —H | $-CH_3$ |
| 51 | $-C_2H_5$ | $-C_2H_5$ | 2-$NHSO_2CH_3$ | $-SO_2NHCH_3$ | $-OC_2H_5$ | —H |
| 52 | $-C_2H_4OCH_3$ | $-C_2H_4OCH_3$ | 2-$NHCOCH_3$ | $-SO_2NHCH_3$ | $-CH_3$ | —Cl |
| 53 | $-C_2H_5$ | $-C_2H_5$ | 4-$CH_3$ | $-NHCOCH_2Ph$ | $-CH_3$ | —Cl |
| 54 | $-C_2H_5$ | $-C_2H_5$ | 2-NHCOPh | $-NHCOCH_2Ph$ | $-CH_3$ | —Cl |
| 55 | $-C_2H_5$ | $-C_2H_5$ | 4-$CH_3$ | $-NHCOOC_2H_5$ | $-CH_3$ | —Cl |
| 56 | $-C_2H_5$ | $-C_2H_5$ | 2-$CH_3$ | $-NHCOOCH_2Ph$ | $-CH_3$ | —Cl |
| 57 | $-C_2H_5$ | $-C_2H_5$ | 2-$CH_3$ | $-NHCOCOC_2H_5$ | $-CH_2H_5$ | $-CH_3$ |
| 58 | $-C_2H_5$ | $-C_2H_5$ | 2-$CH_3$ | $-NHCSOC_2H_5$ | $-CH_3$ | —Cl |
| 59 | $-C_2H_5$ | $-C_2H_5$ | 2-$CH_3$ | —NHCO-thienyl (2) | $-CH_3$ | —Cl |
| 60 | $-C_2H_5$ | $-C_2H_5$ | 2-$CH_3$ | —NHCO-thienyl (3) | $-CH_3$ | —Cl |
| 61 | $-C_2H_5$ | $-C_2H_5$ | 2-$CH_3$ | $-NHCOCH_2$-thienyl (3) | $-CH_3$ | —Cl |
| 62 | $-C_2H_5$ | $-C_2H_5$ | 2-$CH_3$ | $-NHCOCH_2$-thienyl (2) | $-CH_3$ | —Cl |
| 63 | $-C_2H_5$ | $-C_2H_5$ | 2-$CH_3$ | —NHCO-furyl (2) | $-CH_3$ | —Cl |
| 64 | $-C_2H_5$ | $-C_2H_5$ | 2-$CH_3$ | —NHCO—Ph—$OCH_3$ (4) | $-CH_3$ | —Cl |
| 65 | $-C_2H_5$ | $-C_2H_5$ | 4-$CH_3$ | —NHCO—Ph-cyclohexyl (4) | $-CH_3$ | —Cl |
| 66 | $-C_2H_5$ | $-C_2H_5$ | 2-$CH_3$ | —NHCO-pyrrolyl (1) | $-CH_3$ | —Cl |
| 67 | $-C_2H_5$ | $-C_2H_5$ | 2-$CH_3$ | —NHCO-morpholyl (1) | $-CH_3$ | —Cl |
| 68 | $-C_2H_5$ | $-C_2H_5$ | 2-$CH_3$ | —NHCOpyrrolidonyl (1) | $-CH_3$ | —Cl |
| 69 | $-C_2H_5$ | $-C_2H_5$ | 2-$CH_3$ | —NHCOcyclopropane | $-CH_3$ | —Cl |
| 70 | $-C_2H_5$ | $-C_2H_5$ | 2-$CH_3$ | $-NHCOCH_3$ | —Cl | —Cl |
| 71 | $-C_2H_5$ | $-C_2H_5$ | 2-$CH_3$ | $-NHCOCH_3$ | —Cl | $-CH_3$ |
| 72 | $-C_2H_5$ | $-C_2H_5$ | 2-$CH_3$ | $-NHCOCH_3$ | $-CH_3$ | $-NHCOCH_3$ |
| 73 | $-C_2H_5$ | $-C_2H_5$ | 2-$CH_3$ | $-NHSO_2CH_3$ | $-CH_3$ | $-NHCOCH_3$ |
| 74 | $R_{12}$ and $R_{13}$ form a ring ($-C_5H_{10}-$) | | 2-$CH_3$ | —NHCOPh | $-CH_3$ | —Cl |
| 75 | $R_{12}$ and $R_{13}$ form a ring ($-C_2H_4-O-C_2H_4-$) | | 2-$CH_3$ | —NHCOPh | $-CH_3$ | —Cl |
| 76 | $R_{12}$ and $R_{13}$ form a ring ($-C_4H_8-$) | | 2-$CH_3$ | $-NHCOCH_3$ | $-CH_3$ | —Cl |
| 77 | X and $R_{12}$ form a ring ($-C_3H_6-$) | $-C_2H_5$ | —H | $-NHCOCH_3$ | $-CH_3$ | —Cl |
| 78 | X and $R_{12}$ form a ring ($-C_3H_6-$) | $-C_2H_5$ | 4-$CH_3$ | $-NHCOCH_3$ | —H | —H |
| 79 | X and $R_{12}$ form a ring ($-C_3H_6-$) | $-C_2H_5$ | 2-$CH_3$ | $-NHCOCH_3$ | $-CH_3$ | —H |
| 80 | X and $R_{12}$ form a ring ($-C_3H_6-$) | —H | 2-$CH_3$ | $-NHCOCH_3$ | $-CH_3$ | —Cl |
| 81 | X and $R_{12}$ form a ring ($-C_3H_6-$) | $-C_2H_4OCOCH_3$ | 2-$CH_3$ | —NHCOPh | $-CH_3$ | —Cl |
| 82 | X and $R_{12}$ form a ring ($-C_3H_6-$) | $-C_2H_4OCH_3$ | 2-$CH_3$ | —NHCOPh | $-CH_3$ | —Cl |
| 83 | X and $R_{12}$ form a ring ($-C_3H_6-$) | $-C_2H_4OCH_3$ | 4-$CH_3$ | $-NHSO_2CH_3$ | $-C_2H_5$ | —Cl |
| 84 | X and $R_{12}$ form a ring ($-C_3H_6-$) | $-C_2H_4OH$ | 2-OH | $-NHCOCH_3$ | $-CH_3$ | —Cl |
| 85 | X and $R_{12}$ form a ring ($-C_3H_6-$) | $-C_2H_4CN$ | 2-$NHCOCH_3$ | $-NHCOCH_3$ | $-CH_3$ | —Cl |
| 86 | X and $R_{12}$ form a ring ($-C_3H_6-$) | 2-$CH_3$ | 2-$OC_2H_5$ | $-NHCOOCH_3$ | $-N(C_2H_5)_2$ | —Cl |
| 87 | X and $R_{12}$ form a ring ($-C_3H_6-$) | $-C_2H_5$ | 2-$CH_3$ | $-CONHCH_3$ | $-CH_3$ | —Cl |

While the amounts of the anthraquinone dyes and the dyes of the formulae (15) and (16) as described above can vary depending upon the respective specific dyes selected, they are preferably used in a weight ratio of the anthraquinone dye to the dye of the formulae (15) and (16) of from 10:90 to 90:10. If the proportion of the anthraquinone dye is larger, the color density will be reduced. If the proportion of the anthraquinone dye is smaller, the light fastness will reduced.

In order to adjust hue, the known yellow dyes, magenta dyes or cyan dyes may be mixed. The dyes used are as described above.

The thermal transfer sheet of the present invention is characterized in that the specific dye mixture as described above is used. Other constitutions may be similar to those of the known thermal transfer sheets.

Any prior known material may be used as the base sheet for use in the thermal transfer sheet of the present invention wherein the dye mixture described above is used, provided that the material has a certain measure of heat resistance and strength. Examples of such materials include materials having a thickness of the order of from 0.5 to 50 micrometers, preferably from 3 to 10 micrometers such as papers, various processed papers, polymers films, polystyrene films, polypropylene films, polysulfone films, polycarbonate films, aramid films, polyvinyl alcohol films, cellophane and the like. A particularly preferred material is a polyester film.

A dye-containing layer provided on the surface of the base sheet as described above is a layer wherein the dye mixture described above is supported on the base sheet by an optional binder resin.

Any prior known binder resin can be used as the binder resin for supporting the dye mixture described above. Examples of the preferred binder resins include cellulosic resins such as ethyl cellulose, hydroxyethyl cellulose, ethyl hydroxyethyl cellulose, hydroxypropyl cellulose, methyl cellulose, cellulose acetate and cellulose acetate butyrate; vinylic resins such as polyvinyl alcohol, polyvinyl acetate, polyvinyl butyral, polyvinyl acetoacetal, polyvinyl pyrrolidone, polyacrylamide and polystyrene; and the like. Of these, polyvinyl butyral and polyvinyl acetal, ethyl cellulose and ethyl hydroxyethyl cellulose are particularly preferred from the standpoints of heat resistance and dye migration.

While the dye-containing layer of the thermal transfer sheet of the present invention is basically formed by the materials described above, it may include various additives similar to the prior known additives as needed. Such as dye-containing layer is preferably formed by adding the dye mixture, the binder resin and optional components to a suitable solvent to dissolve or disperse each component therein to prepare a coating solution or ink composition for forming the dye-containing layer, applying the coating solution or ink composition to the base sheet described above and drying the whole. The dye-containing layer thus formed has a thickness of the order of from 0.2 to 5.0 micrometers, preferably from 0.4 to 2.0 micrometers. It is suitable that the dye mixture in the dye-containing layer be present in an amount of from 5% to 70% by weight, preferably from 10% to 60% by weight bared on the weight of the dye-containing layer.

While the present thermal transfer sheet as described above is sufficiently useful for thermal transfer as it is, the surface of the dye-containing layer may be provided with an antisticking layer, i.e., a release layer. Such a layer prevents the sticking between the thermal transfer sheet and the transferable material during the thermal transfer operation. Thus, higher thermal transfer temperatures can be used, and images having an even more excellent density can be formed.

When an antisticking inorganic powder is merely deposited, the resulting release layer exerts a relatively high effect. Further, a release layer having a thickness of from 0.1 to 5 micrometers, preferably from 0.05 to 2 micrometers can be formed from resins having excellent releasability such as silicone polymers, acrylic polymers and fluorinated polymers. Even if the inorganic powder or releasing polymers as described above are included in the dye-containing layer, a sufficient effect can be obtained.

Further, the back surface of such a thermal transfer sheet may be provided with a heat-resistant layer in order to prevent adverse effect due to the heat of the thermal head.

Any transferable material may be used in forming images using the thermal transfer sheet as described above, provided that its recording surface has a dye receptivity against the dye described above. When the transferable materials are those having no dye receptivity such as papers, metals, glasses and synthetic resins, a dye-receptive layer may be formed or at least one surface thereof.

Means for imparting a heat energy used in carrying out thermal transfer using the present thermal transfer sheet as described above and the recordable material as described above may be any of the prior known means. For example, a required purpose can be achieved by imparting a heat energy of the order of from 5 to 100 $mJ/mm^2$ by controlling the recording time vic a recording device such as a thermal printer (e.g., Video Printer VY-100 manufactured by Hitachi Seisakusho).

According to the thermal transfer sheet of the present invention, cyan images can be formed. Full color images having excellent color reproducibility can be provided by using the cyan dye-containing layer in combination with a thermal transfer sheet having a yellow dye-containing layer and a thermal transfer sheet having a magenta dye-containing layer. Alternatively, full color images having excellent color reproducibility can be provided by a thermal transfer sheet having a layer formed by superficially successively applying a yellow dye, the cyan dye and a magenta dye.

EXAMPLES 294 THROUGH 373

An ink composition for forming a dye-containing layer having the following composition was prepared. The ink composition was applied to a polyethylene terephthalate film having a thickness of 6 micrometers (wherein its back surface had been treated to provide heat resistance) so that the dry coating weight was 1.0 gram per square meter. The whole was dried to obtain a thermal transfer sheet of the present invention.

| Ink Composition | |
|---|---|
| Dye of the formulae (10) through (14) | "a" parts |
| Dye of the formula (15) through (16) | "b" parts |
| Polyvinyl butyral resin | 4.5 parts |
| Methyl ethyl ketone | 45.75 parts |
| Toluene | 45.75 parts |

When the dyes in the composition described above were insoluble, a solvent such as DMF, dioxane or chloroform was suitably used. (The dyes used and their amounts ("a", "b") are shown in the following Table 25.)

Synthetic paper (Yupo FPG #150 manufactured by Oji Yuka) was used as a base sheet. A coating solution having the following composition was applied to the one surface of the base sheet so that its dry coating weight was 10.0 grams per square meter. The whole was dried for 30 minutes at 100° C. to obtain a transferable material.

Polyester resin (Vylon 200 11.5 parts manufactured by Toyobo)

Vinyl chloride-vinyl acetate copolymer 5.0 parts (VYHH manufactured by U.C.C.)

Amino-modified silicone (KF-393 1.2 part manufactured by Shin-etsu Kaguku Kogyo)

Epoxy-modified silicone (X-22-343 1.2 part manufactured by Shin-etsu Kagaku Kogyo)

Methyl ethyl ketone/toluene/cyclohexanone 102.0 parts (weight ratio of 4:4:2)

Thermal Transfer Recording Test

The present thermal transfer sheet described above and the transferable material described above were stacked with the dye-containing layer opposing to the dye-receptive surface. Recording was carried out by means of a thermal head from the back surface of the thermal transfer sheet under a head application voltage of 11 V for an application time of 16 msec. The results are shown in Table 25.

Light Fastness Test

A light fastness test of the cyan images obtained in the thermal transfer test described above was carried out by means of a xenon fadeometer (Ci 35 A manufactured by Atlas) (the black panel temperature being 50° C. and the illuminance being 50 kLux). In any case, discoloration and fading did not occur when the irradiation time wad 50 hours.

Measurement of Color Density

The color density was measured by means of a densitometer RD-918 manufactured by U.S. Macbeth Company.

TABLE 25

| | Dye of Formulae (10) through (14) | | Dye of Formulae (15) and (16) | | | |
|---|---|---|---|---|---|---|
| Ex. | Formula and Number | Amount used "a" | Formula and Number | Amount used "b" | Color Density | Light Fastness |
| 294 | 10-1 | 2.0 | 15-4 | 2.0 | 1.80 | ○ |
| 295 | 10-1 | 2.0 | 15-7 | 2.0 | 1.81 | ○ |
| 296 | 10-2 | 2.0 | 15-9 | 2.0 | 1.82 | ○ |
| 297 | 10-3 | 2.0 | 15-16 | 2.0 | 1.78 | ○ |
| 298 | 10-4 | 2.0 | 15-17 | 2.0 | 1.77 | ○ |
| 299 | 10-5 | 1.5 | 15-47 | 2.5 | 1.74 | ○ |
| 300 | 10-6 | 2.5 | 15-71 | 1.5 | 1.80 | ○ |
| 301 | 10-7 | 2.0 | 15-90 | 2.0 | 1.72 | ○ |
| 302 | 10-8 | 2.0 | 15-97 | 2.0 | 1.73 | ○ |
| 303 | 10-1 | 2.0 | 15-108 | 2.0 | 1.81 | ○ |
| 304 | 10-3 | 2.0 | 16-5 | 2.0 | 1.82 | ○ |
| 305 | 10-4 | 1.0 | 16-9 | 3.0 | 1.76 | ○ |
| 306 | 10-6 | 2.0 | 16-15 | 2.0 | 1.84 | ○ |
| 307 | 10-7 | 2.0 | 16-16 | 2.0 | 1.77 | ○ |
| 308 | 10-8 | 2.0 | 16-18 | 2.0 | 1.72 | ○ |
| 309 | 10-9 | 2.0 | 16-20 | 2.0 | 1.73 | ○ |
| 310 | 10-3 | 2.0 | 16-45 | 2.0 | 1.76 | ○ |
| 311 | 10-4 | 2.0 | 16-52 | 2.0 | 1.78 | ○ |
| 312 | 10-6 | 2.0 | 16-60 | 2.0 | 1.81 | ○ |
| 313 | 10-8 | 2.0 | 16-79 | 2.0 | 1.72 | ○ |
| 314 | 11-1 | 2.0 | 15-5 | 2.0 | 1.78 | ○ |
| 315 | 11-2 | 2.0 | 15-13 | 2.0 | 1.73 | ○ |
| 316 | 11-4 | 2.0 | 15-18 | 2.0 | 1.77 | ○ |

TABLE 25-continued

| | Dye of Formulae (10) through (14) | | Dye of Formulae (15) and (16) | | | |
|---|---|---|---|---|---|---|
| Ex. | Formula and Number | Amount used "a" | Formula and Number | Amount used "b" | Color Density | Light Fastness |
| 317 | 11-5 | 2.0 | 15-22 | 2.0 | 1.81 | ○ |
| 318 | 11-1 | 2.0 | 15-39 | 2.0 | 1.76 | ○ |
| 319 | 11-3 | 1.5 | 15-61 | 1.5 | 1.79 | ○ |
| 320 | 11-6 | 2.0 | 15-101 | 2.0 | 1.74 | ○ |
| 321 | 11-1 | 2.0 | 16-6 | 2.0 | 1.76 | ○ |
| 322 | 11-1 | 2.0 | 16-9 | 2.0 | 1.82 | ○ |
| 323 | 11-6 | 2.0 | 16-21 | 2.0 | 1.81 | ○ |
| 324 | 11-5 | 2.0 | 16-26 | 2.0 | 1.78 | ○ |
| 325 | 11-1 | 2.0 | 16-37 | 2.0 | 1.77 | ○ |
| 326 | 11-3 | 2.0 | 16-47 | 2.0 | 1.82 | ○ |
| 327 | 11-4 | 2.0 | 16-61 | 2.0 | 1.79 | ○ |
| 328 | 11-5 | 2.0 | 16-72 | 2.0 | 1.83 | ○ |
| 329 | 11-6 | 2.5 | 16-82 | 1.5 | 1.76 | ○ |
| 330 | 12-1 | 2.0 | 15-17 | 2.0 | 1.80 | ○ |
| 331 | 12-2 | 2.0 | 15-47 | 2.0 | 1.82 | ○ |
| 332 | 12-4 | 2.0 | 15-64 | 2.0 | 1.85 | ○ |
| 333 | 12-5 | 2.0 | 15-70 | 2.0 | 1.80 | ○ |
| 334 | 12-7 | 3.0 | 15-71 | 1.0 | 1.75 | ○ |
| 335 | 12-8 | 2.0 | 15-80 | 2.0 | 1.81 | ○ |
| 336 | 12-1 | 2.0 | 15-91 | 2.0 | 1.77 | ○ |
| 337 | 12-3 | 2.0 | 15-101 | 2.0 | 1.76 | ○ |
| 338 | 12-4 | 1.5 | 16-4 | 2.5 | 1.78 | ○ |
| 339 | 12-6 | 2.0 | 16-15 | 2.0 | 1.82 | ○ |
| 340 | 12-7 | 2.0 | 16-26 | 2.0 | 1.74 | ○ |
| 341 | 12-8 | 2.0 | 16-56 | 2.0 | 1.73 | ○ |
| 342 | 12-1 | 2.0 | 16-66 | 2.0 | 1.72 | ○ |
| 343 | 12-4 | 2.5 | 16-75 | 1.5 | 1.76 | ○ |
| 344 | 12-5 | 2.0 | 16-82 | 2.0 | 1.75 | ○ |
| 345 | 13-2 | 2.0 | 15-13 | 2.0 | 1.80 | ○ |
| 346 | 13-3 | 2.0 | 15-18 | 2.0 | 1.82 | ○ |
| 347 | 13-4 | 2.0 | 15-26 | 2.0 | 1.81 | ○ |
| 348 | 13-5 | 2.0 | 15-63 | 2.0 | 1.83 | ○ |
| 349 | 13-7 | 2.0 | 15-68 | 2.0 | 1.78 | ○ |
| 350 | 13-8 | 2.5 | 15-77 | 1.5 | 1.77 | ○ |
| 351 | 13-1 | 2.0 | 15-107 | 2.0 | 1.76 | ○ |
| 352 | 13-3 | 2.0 | 16-11 | 2.0 | 1.74 | ○ |
| 353 | 13-4 | 2.0 | 16-21 | 2.0 | 1.75 | ○ |
| 354 | 13-6 | 3.0 | 16-46 | 1.0 | 1.72 | ○ |
| 355 | 13-7 | 2.0 | 16-50 | 2.0 | 1.71 | ○ |
| 356 | 13-1 | 2.0 | 16-57 | 2.0 | 1.80 | ○ |
| 357 | 13-2 | 2.0 | 16-63 | 2.0 | 1.78 | ○ |
| 358 | 13-5 | 2.0 | 16-75 | 2.0 | 1.79 | ○ |
| 359 | 13-8 | 1.0 | 16-86 | 2.0 | 1.75 | ○ |
| 360 | 14-1 | 2.0 | 15-13 | 2.0 | 1.74 | ○ |
| 361 | 14-2 | 2.0 | 15-27 | 2.0 | 1.73 | ○ |
| 362 | 14-4 | 2.0 | 15-47 | 2.0 | 1.72 | ○ |
| 363 | 14-6 | 2.0 | 15-64 | 2.0 | 1.76 | ○ |
| 364 | 14-8 | 2.5 | 15-67 | 1.5 | 1.74 | ○ |
| 365 | 14-9 | 2.0 | 15-77 | 2.0 | 1.76 | ○ |
| 366 | 14-1 | 2.0 | 15-94 | 2.0 | 1.77 | ○ |
| 367 | 14-3 | 2.5 | 15-106 | 1.5 | 1.73 | ○ |
| 368 | 14-7 | 2.0 | 16-15 | 2.0 | 1.71 | ○ |
| 369 | 14-9 | 2.0 | 16-43 | 2.0 | 1.76 | ○ |
| 370 | 14-2 | 2.0 | 16-56 | 2.0 | 1.74 | ○ |
| 371 | 14-4 | 1.5 | 16-65 | 2.5 | 1.80 | ○ |
| 372 | 14-6 | 2.0 | 16-72 | 2.0 | 1.79 | ○ |
| 373 | 14-8 | 2.0 | 16-79 | 2.0 | 1.78 | ○ |

COMPARATIVE EXAMPLES 36 THROUGH 50

Example 294 was repeated except that the following dyes were used in place of the dye in Example. The results are shown in Table 26.

| | |
|---|---|
| Dyes of the formulae (10) through (16) | "a" parts |
| Polyvinyl butyral resin | 4.5 parts |
| Methyl ethyl ketone | 46.25 parts |
| Toluene | 46.25 parts |

TABLE 26

| Com. Ex. | Dye: Formula and Number | Dye: Amount used "a" | Color Density | Light Fastness |
|---|---|---|---|---|
| 36 | 10-1 | 4.0 | 1.58 | ○ |
| 37 | 10-6 | 4.0 | 1.52 | ○ |
| 38 | 11-2 | 4.0 | 1.10 | ○ |
| 39 | 12-4 | 4.0 | 1.23 | ○ |
| 40 | 12-8 | 4.0 | 1.31 | ○ |
| 41 | 13-1 | 4.0 | 1.26 | ○ |
| 42 | 14-8 | 4.0 | 1.60 | ○ |
| 43 | 15-4 | 4.0 | 1.77 | X |
| 44 | 15-15 | 4.0 | 1.72 | X |
| 45 | 15-58 | 4.0 | 1.78 | X |
| 46 | 15-111 | 4.0 | 1.76 | X |
| 47 | 16-1 | 4.0 | 1.82 | X |
| 48 | 16-25 | 4.0 | 1.78 | X |
| 49 | 16-37 | 4.0 | 1.81 | X |
| 50 | 16-86 | 4.0 | 1.80 | X |

According to the present invention as described above, there can be provided the thermal transfer sheets which provide full color images having excellent color density, clearness and fastnesses, particularly light fastness by using the mixture of the specific dyes even if a heat energy applied for an extremely short period of time.

A preferred embodiment of a black thermal transfer illustrate the present invention in more detail.

Dyes used in the present invention may be any doe so long as they are represented by the general formulae (17) through (21) described above. Of the dyes represented by the general formulae (17) through (21), examples of particularly preferred dyes are shown in the following Tables 27 through 31. There dyes may also be used in combination with the prior known other dyes.

TABLE 27

| Dye of the general formula (17) ($R_1$ and $R_2$ represent substitutents) | | |
|---|---|---|
| No. | $R_1$ | $R_2$ |
| Y-1 | -isoC$_3$H$_7$ | —CON(C$_4$H$_9$)$_2$ |
| Y-2 | —CH$_3$ | —COOC$_8$H$_{17}$(n) |
| Y-3 | -isoC$_3$H$_7$ | —OC$_4$H$_9$(n) |
| Y-4 | -cyclohexyl | —COOC$_3$H$_7$(n) |
| Y-5 | -isoC$_3$H$_7$ | —CONHC$_5$H$_{11}$ |
| Y-6 | -isoC$_3$H$_7$ | 2-(4-ethyl-4-isopropylcarboxymethyl) oxazolynyl) |

TABLE 28

| Dye of the general formula (18) | |
|---|---|
| No. | $R_{11}$ |
| Y-7 | —C$_2$H$_4$OC$_3$H$_7$ |
| Y-8 | —C$_2$H$_4$COOPh |
| Y-9 | —C$_8$H$_{17}$ (n) |

TABLE 29

| Dye of the general formula (19) ($R_3$ through $R_6$ represent substituents) | | | | |
|---|---|---|---|---|
| No. | $R_3$ | $R_4$ | $R_5$ | $R_6$ |
| M-1 | —C$_4$H$_9$ | —C$_4$H$_9$ | —Ph | —NR$_7$R$_8$ (R$_7$ = —COCH$_3$, R$_8$ = —COPh) |
| M-2 | —(C$_2$H$_4$O)$_2$C$_2$H$_5$ | —C$_2$H$_5$ | —Ph | —C$_4$H$_9$ |
| M-3 | —C$_4$H$_9$ | —C$_4$H$_8$OH | 2-thienyl- | cyclohexyl- |
| M-4 | —C$_4$H$_9$ | —C$_4$H$_9$ | —Ph | —C$_3$H$_7$ |
| M-5 | —C$_2$H$_4$OCOCH$_3$ | —C$_2$H$_4$OCOCH$_3$ | 2-thienyl- | —C$_4$H$_9$ |
| M-6 | —C$_2$H$_5$ | —C$_2$H$_5$ | —Ph | —C$_2$H$_4$OCH$_3$ |
| M-7 | —C$_2$H$_5$ | —C$_2$H$_5$ | 4-methoxyphenyl- | —C$_6$H$_3$ |
| M-8 | —C$_2$H$_5$ | —C$_2$H$_5$ | 2-thienyl- | —C$_6$H$_3$ |
| M-9 | —C$_2$H$_4$OCOCH$_3$ | —C$_2$H$_4$OCOCH$_3$ | —Ph | cyclohexyl- |
| M-10 | —(C$_2$H$_4$O)$_2$C$_2$H$_5$ | —C$_2$H$_5$ | —Ph | —CH(CH$_3$)$_2$ |

TABLE 30

| Dye of the general formula (20) ($R_9$ through $R_{12}$ represent substituents) | | | | |
|---|---|---|---|---|
| No. | $R_9$ | $R_{10}$ | $R_{11}$ | $R_{12}$ |
| C-1 | —CONHC$_3$H$_7$ | —CH$_3$ | —C$_2$H$_5$ | —C$_2$H$_5$ |
| C-2 | —CONH(3-methyl phenyl) | —CH$_3$ | —C$_2$H$_5$ | —C$_2$H$_5$ |
| C-3 | —SO$_2$NHCH$_3$ | —CH$_3$ | —C$_2$H$_5$ | —C$_2$H$_5$ |
| C-4 | —CONHCH$_3$ | —CH$_3$ | —C$_2$H$_4$OCOCH$_3$ | —C$_2$H$_4$OCOCH$_3$ |
| C-5 | —CONHCH$_3$ | —CH$_3$ | —C$_2$H$_4$CN | —C$_2$H$_5$ |
| C-6 | —CONHC$_3$H$_7$ | —CH$_3$ | cyclohexyl- | —C$_2$H$_4$OH |
| C-7 | —CONHPh | —CH$_3$ | phenyl- | —C$_2$H$_5$ |

TABLE 31

| Dye of the general formula (21) | | | | | |
|---|---|---|---|---|---|
| No | $R_9$ | $R_3$ | $R_{10}$ | $R_{11}$ | $R_{12}$ |
| C-8 | —NHCOCH$_3$ | —CH$_3$ | —CH$_3$ | —C$_2$H$_5$ | —C$_2$H$_5$ |

The thermal transfer sheet of the present invention is characterized in that the specific dye mixture as described above are used in combination. Other constitutions may be similar to those of the prior known thermal transfer sheets. The dye of the general formula (19) is used in an amount of from 50 to 300 parts by weight of the dye of the general formula (17) or (18), and the dye of the general formula (20) or (21) is used in an amount of from 50 to 400 parts by weight based on 100 parts by weight of the dye of the general formula (17) or (18). It is preferred that a mixture of the three dyes be used. If the proportions are too larger or smaller, a pitch-dark clear color will not be obtained, a color obtained will become yellowish, bluish or reddish black or the light fastness will be reduced.

In order to adjust hue, the known yellow dyes, magenta dyes and cyan dyes can also be mixed. The specific dyes are as described above.

Any prior known material may be used as the base sheet for use in the thermal transfer sheet of the present invention wherein the dyes described above is used, provided that the material has a certain measure of heat resistance and strength. Examples of such materials include materials having a thickness of the order of from 0.5 to 50 micrometers, preferably from 3 to 10 micrometers such as papers, various processed papers, polyester films, polystyrene films, polypropylene films, polysulfone films, polycarbonate films, aramid films, polyvinyl alcohol films, cellophane and the like. A particularly preferred material is a polyester film.

A dye-containing layer provided on the surface of the base sheet as described above is a layer wherein the combination of a plurality of dyes described above is supported on the base sheet by an optional binder resin.

Any prior known binder resin can be used as the binder resin for supporting the dye mixture described above. Examples of the preferred binder resins include cellulosic resins such as ethyl cellulose, hydroxyethyl cellulose, ethyl hydroxyethyl cellulose, hydroxypropyl cellulose, methyl cellulose, cellulose acetate and cellulose acetate butyrate; vinylic resins such as polyvinyl alcohol, polyvinyl acetate, polyvinyl butyral, polyvinyl acetoacetal, polyvinyl pyrrolidone, polyacrylamide and polystyrene; and the like. Of these, polyvinyl butyral and polyvinyl acetal, ethyl cellulose and ethyl hydroxyethyl cellulose are particularly preferred from the standpoints of heat resistance and dye migration.

While the dye-containing layer of the thermal transfer sheet of the present invention is basically formed by the materials described above, it may include various additives similar to the prior known additives as needed. Such a dye-containing layer is preferably formed by adding a plurality of dyes, the binder resin and optional components to a suitable solvent to dissolve or disperse each component therein to prepare a coating solution or ink composition for forming the dye-containing layer, applying the coating solution or ink composition to the base sheet described above and drying the whole.

The dye-containing layer thus formed has a thickness of the order of from 0.2 to 5.0 micrometers, preferably from 0.4 to 2.0 micrometers. It is suitable that the dye in the dye-containing layer be present in an amount of from 5% to 70% by weight, preferably from 10% to 60% by weight bared on the weight of the dye-containing layer.

While the present thermal transfer sheet as described above is sufficiently useful for thermal transfer as it is, the surface of the dye-containing layer may be provided with an antisticking layer, i.e., a release layer. Such a layer prevents the sticking between the thermal transfer sheet and the thermal transfer image-receptive sheet during the thermal transfer operation. Thus, higher thermal transfer temperatures can be used, and black images having an even more excellent density can be formed.

When an antisticking inorganic powder is merely deposited, the resulting release layer exerts a relatively high effect. Further, a release layer having a thickness of from 0.1 to 5 micrometers, preferably from 0.05 to 2 micrometers can be formed from resins having excellent releasability such as silicone polymers, acrylic polymers and fluorinated polymers. Even if the inorganic powder or releasing polymers as described above are included in the dye-containing layer, a sufficient effect can be obtained.

Further, the back surface of such a thermal transfer sheet may be provided with a heat-resistant layer in order to prevent adverse effect due to the heat of the thermal head.

Any thermal transfer image-receptive sheet may be used in forming black images using the thermal transfer sheet as described above, provided that its recording surface has a dye receptivity against the dye described above. When the transferable materials are those having no dye receptivity such as papers, metals, glasses and synthetic resins, a dye-receptive layer may be formed or at least one surface thereof.

Means for imparting a heat energy used in carrying out thermal transfer using the present thermal transfer sheet as described above and the recordable material as described above may be any of the prior known means. For example, a required purpose can be achieved by imparting a heat energy of the order of from 5 to 100 $mJ/mm^2$ by controlling the recording time vic a recording device such as a thermal printer (e.g., Video Printer VY-100 manufactured by Hitachi Seisakusho).

EXAMPLES 374 THROUGH 383

An ink composition for forming a dye-containing layer having the following composition was prepared. The ink composition was applied to a polyethylene terephthalate film having a thickness of 6 micrometers (wherein its back surface had been treated to provide heat resistance) so that the dry coating weight was 1.0 gram per square meter. The whole was dried to obtain a black thermal transfer sheet of the present invention. The combination of dyes are as shown in Table 32.

| Ink Composition | | |
|---|---|---|
| Dye shown in Table 27 or 28 | "a" | parts |
| Dye shown in Table 29 | "b" | parts |
| Dye shown in Table 30 or 31 | "c" | parts |
| Polyvinyl acetoacetal resin | 4 | parts |
| Toluene | (96-a-b-c)/2 | parts |
| Methyl ethyl ketone | (96-a-b-c)/2 | parts |

When the dyes in the composition described above were insoluble, a solvent such as DMF, dioxane or chloroform was suitably used.

TABLE 32

| | Dye of General Furmula (17), (18) | | Dye of General Formula (19) | | Dye of General Formula (20), (21) | |
|---|---|---|---|---|---|---|
| Ex. | Kind | Amount used "a" | Kind | Amount used "b" | Kind | Amount used "c" |
| Ex. 374 | Y-1 | 1.8 | M-1 | 2.0 | C-1 | 2.2 |
| Ex. 375 | Y-1 | 1.5 | M-2 | 2.0 | C-2 | 2.6 |
| Ex. 376 | Y-4 | 1.8 | M-3 | 1.9 | C-5 | 2.3 |
| Ex. 377 | Y-2 | 1.7 | M-4 | 2.1 | C-3 | 2.4 |
| Ex. 378 | Y-1 | 1.7 | M-1 | 1.8 | C-4 | 2.5 |
| Ex. 379 | Y-3 | 1.5 | M-10 | 2.4 | C-1 | 1.8 |
| Ex. 380 | Y-5 | 1.9 | M-8 | 2.2 | C-6 | 1.7 |
| Ex. 381 | Y-6 | 1.8 | M-1 | 2.0 | C-7 | 2.0 |

TABLE 32-continued

| Ex. | Dye of General Furmula (17), (18) Kind | Amount used "a" | Dye of General Formula (19) Kind | Amount used "b" | Dye of General Formula (20), (21) Kind | Amount used "c" |
|---|---|---|---|---|---|---|
| Ex. 382 | Y-1 | 1.8 | M-1 | 2.0 | C-8 | 2.2 |
| Ex. 383 | Y-7 | 1.6 | M-1 | 2.1 | C-8 | 2.3 |

COMPARATIVE EXAMPLE 51

A thermal transfer sheet of this Comparative Example was obtained as in Examples 374 through 380 except that the following ink composition was used in place of the ink composition for dye-containing layer of Examples.

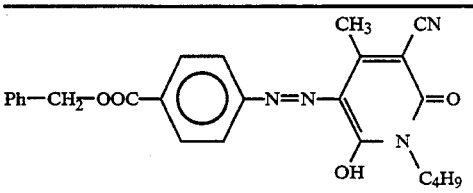

1.2 parts

| | |
|---|---|
| 1-Amino-2-phenoxy-4-hydroxyanthraquinone | 1.8 parts |
| 1-(3-Methylphenyl)amino-4-methylamino anthraquinone | 3 parts |
| Polyvinyl acetoacetal resin | 4 parts |
| Toluene | 45 parts |
| Methyl ethyl ketone | 45 parts |

Synthetic paper (Yupo FPG #150 manufactured by Oji Yuka) was used as a base sheet. A coating solution having the following composition was applied to the one surface of the base sheet so that its drying coating weight was 10.0 grams per square meter. The whole was dried for 30 minutes at 100° C. to obtain a thermal transfer image-receptive sheet.

| | |
|---|---|
| Polyester resin (Vylon 200 manufactured by Toyobo) | 11.5 parts |
| Vinyl chloride-vinyl acetate copolymer (VYHH manufactured by U.C.C.) | 5.0 parts |
| Amino-modified silicone (KF-393 manufactured by Shin-etsu Kagaku Kogyo) | 1.2 parts |
| Epoxy-modified silicone (4-22-343 manufactured by Shin-etsu Kagaku Kogyo) | 1.2 parts |
| Methly ethyl ketone/toluene/cyclohexanone (weight ratio of 4:4:2) | 102.0 parts |

Thermal Transfer Recording Test

The above thermal transfer sheets of the present invention and comparative Example and the thermal transfer image-receptive sheet described above were stacked with the dye-containing layer opposing to the dye-receptive surface. Recording was carried out by means of a thermal head from the back surface of the thermal transfer sheet under a head application voltage of 11 V for an application time of 16 msec. The results are shown in Table 33.

Light Fastness Test

A light fastness test of the cyan images obtained in the thermal transfer test described above was carried out by means of a xenon fadeometer (Ci 35 A manufactured by Atlas) (the black panel temperature being 50° C. and the illuminance being 50 k Lux).

○: no fading in the case of the irradiation time of 50 hr.

x: remashable fading in the case of the irradiation time of 50 hr.

Measurement of Color Density

The maximum B/W density of the black image obtained in the thermal transfer recording test was measured by means of a densitometer RD-918 manufactured by U.S. Macbeth Company. The results are shown in the following Table 33. The characteristic curves of Example 374 and Comparative Example 51 also are shown in FIG. 1.

TABLE 33

| Ex. | Light Fastness | Maximum B/W Density |
|---|---|---|
| Ex. 374 | ○ | 1.88 |
| Ex. 375 | ○ | 1.86 |
| Ex. 376 | ○ | 1.84 |
| Ex. 377 | ○ | 1.83 |
| Ex. 378 | ○ | 1.90 |
| Ex. 379 | ○ | 1.82 |
| Ex. 380 | ○ | 1.83 |
| Ex. 381 | ○ | 1.79 |
| Ex. 382 | ○ | 1.89 |
| Ex. 383 | ○ | 1.91 |
| Com. Ex. 51 | X | 1.45 |

According to the present invention as described above, there can be obtained the thermal transfer sheet capable of forming the black images having excellent color density and fastnesses, particularly light fastness by using the specific dyes in combination.

A preferred embodiment of a thermal sheet having at least three color layers of yellow, magenta, cyan (and like) formed plane successively illustrates the present invention in more detail.

The yellow, magenta and cyan dyes used in the present invention may any dye so long as they are represented by the general formulae (22) through (26) as described above. Of the dyes represented by the general formula (22) through (26), examples of particularly preferred dyes are shown in the following Tables 34 through 37. These dyes can be used alone or in mixture. Further, the respective dyes can be used in combination with further dyes having similar hue other than the dyes represented by the general formula (22) through (26).

TABLE 34

| Dye of the general formula (22) ($R_1$ and $R_2$ represent substituents) | | |
|---|---|---|
| No. | $R_1$ | $R_2$ |
| Y-1 | -isoC$_3$H$_7$ | —CON(C$_4$H$_9$)$_2$ |
| Y-2 | —CH$_3$ | —COOC$_8$H$_{17}$ (n) |
| Y-3 | -isoC$_3$H$_7$ | —OC$_4$H$_9$ (n) |
| Y-4 | -cyclohexyl | —COOC$_3$H$_7$ (n) |
| Y-5 | -isoC$_3$H$_7$ | —CONHC$_5$H$_{11}$ |

TABLE 35

| Dye of the general formula (23) | |
|---|---|
| No. | $R_{11}$ |
| Y-6 | —C$_2$H$_4$OC$_3$H$_7$ |
| Y-7 | —C$_2$H$_4$COOPh |
| Y-8 | —C$_8$H$_{17}$ (n) |

TABLE 36

| | Dye of the general formula (24) ($R_3$ through $R_6$ represent substituents) | | | |
|---|---|---|---|---|
| No. | $R_3$ | $R_4$ | $R_5$ | $R_6$ |
| M-1 | $-C_4H_9$ | $-C_4H_9$ | —Ph | $-NR_7R_8$ ($R_7$ = $-COCH_3$ $R_8$ = —COPh) |
| M-2 | $-(C_2H_4O)_2C_2H_5$ | $-C_2H_5$ | —Ph | $-C_4H_9$ |
| M-3 | $-C_4H_9$ | $-C_4H_8OH$ | 2-thienyl- | cyclohexyl- |
| M-4 | $-C_4H_9$ | $-C_4H_9$ | —Ph | $-C_3H_7$ |
| M-5 | $-C_2H_4OCOCH_3$ | $-C_2H_4OCOCH_3$ | 2-thienyl- | $-C_4H_9$ |
| M-6 | $-C_2H_5$ | $-C_2H_5$ | —Ph | $-C_2H_4OCH_3$ |
| M-7 | $-C_2H_5$ | $-C_2H_5$ | 4-methoxy phenyl | $-C_6H_{13}$ |
| M-8 | $-C_2H_5$ | $-C_2H_5$ | 2-thienyl- | $-C_6H_{13}$ |
| M-9 | $-C_2H_4OCOCH_3$ | $-C_2H_4OCOCH_3$ | —Ph | cyclohexyl- |
| M-10 | $-(C_2H_4O)_2C_2H_5$ | $-C_2H_5$ | —Ph | $-CH(CH_3)_2$ |

TABLE 37

| | Dye of the general formula (25) ($R_9$ through $R_{12}$ represent substitiuents) | | | |
|---|---|---|---|---|
| No. | $R_9$ | $R_{10}$ | $R_{11}$ | $R_{12}$ |
| C-1 | $-CONHC_3H_7$ | $-CH_3$ | $-C_2H_5$ | $-C_2H_5$ |
| C-2 | —CONH(3-methylphenyl) | $-CH_3$ | $-C_2H_5$ | $-C_2H_5$ |
| C-3 | $-SO_2NHCH_3$ | $-CH_3$ | $-C_2H_5$ | $-C_2H_5$ |
| C-4 | $-CONHCH_3$ | $-CH_3$ | $-C_2H_4OCOCH_3$ | $-C_2H_4OCOCH_3$ |
| C-5 | $-CONHCH_3$ | $-CH_3$ | $-C_2H_4CN$ | $-C_2H_5$ |

TABLE 38

| | Dye of the general formula (26) | | | | |
|---|---|---|---|---|---|
| No. | $R_9$ | $R_3$ | $R_{10}$ | $R_{11}$ | $R_{12}$ |
| C-6 | $-NHCOCH_3$ | $-CH_3$ | $-CH_3$ | $-C_2H_5$ | $-C_2H_5$ |

The thermal transfer sheet of the present invention is characterized in that three-color dyes of specific combination as described above are used. In order to adjust hue, the know yellow dyes, magenta dyes and cyan dyes as described above may be mixed. Other constitutions may be similar to those of the prior known three-color thermal transfer sheet.

Any prior known material may be used as the base sheet for use in the thermal transfer sheet of the present invention wherein the dyes described above is used, provided that the material has a certain measure of heat resistance and strength. Examples of such materials include materials having a thickness of the order of from 0.5 to 50 micrometers, preferably from 3 to 10 micrometers such as papers, various processed papers, polyester films, polystyrene films, polypropylene films, polysulfone films, polycarbonate films, aramid films, polyvinyl alcohol films, cellophane and the like. A particularly preferred material is a polyester film.

A three-color dye layer provided on the surface of the base sheet as described above is a layer wherein each of the three-color dyes described above is supported on the base sheet by an optional binder resin.

Any prior known binder resin can be used as the binder resin for supporting the dyes described above. Examples of the preferred binder resins include cellulosic resins such as ethyl cellulose, hydroxyethyl cellulose, ethyl hydroxyethyl cellulose, hydroxypropyl cellulose, methyl cellulose, cellulose acetate and cellulose acetate butyrate; vinylic resins such as polyvinyl alcohol, polyvinyl acetate, polyvinyl butyral, polyvinyl acetoacetal, polyvinyl pyrrolidone, polyacrylamide and polystyrene; and the like. Of these, polyvinyl butyral and polyvinyl acetal are particularly preferred from the standpoints of heat resistance and dye migration.

While the three-color dye layer of the thermal transfer sheet of the present invention is basically formed by the materials described above, it may include various additives similar to the prior known additives as needed.

Such a three-color dye layer is preferably formed by adding the dyes described above, the binder resin and optional components to a suitable solvent to dissolve or disperse each component therein to prepare coating solutions or ink compositions for forming the dye layer, superficially successively applying the coating solutions or ink compositions to the base sheet described above e.g., in sequence of yellow, magenta and cyan dyes at a width of several tens of centimeters and drying the whole.

Of course, a four-color dye layer may be produced by forming a black dye layer in addition to the three-color dye layer as described above.

The three-color dye layer thus formed has a thickness of the order of from 0.2 to 5.0 micrometers, preferably from 0.4 to 2.0 micrometers. It is suitable that the dyes in the dye layer be present in an amount of from 5% to 70% by weight, preferably from 10% to 60% by weight bared on the weight of the dye layer.

While the present thermal transfer sheet as described above is sufficiently useful for thermal transfer as it is, the surface of the dye layer may be provided with an antisticking layer, i.e., a release layer. Such a layer prevents the sticking between the thermal transfer sheet and the transferable material during the thermal transfer operation. Thus, higher thermal transfer temperatures can be used, and full color images having an even more excellent density can be formed.

When an antisticking inorganic powder is merely deposited, the resulting release layer exerts a relatively high effect. Further, a release layer having a thickness of from 0.1 to 5 micrometers, preferably from 0.05 to 2 micrometers can be formed from resins having excellent releasability such as silicone polymers, acrylic polymers and fluorinated polymers. Even if the inorganic powder or releasing polymers as described above are included in the dye-containing layer, a sufficient effect can be obtained.

Further, the back surface of such a thermal transfer sheet may be provided with a heat-resistant layer in order to prevent adverse effect due to the heat of the thermal head.

Any transferable material may be used in forming full color images using the thermal transfer sheet as described above, provided that its recording surface has a dye receptivity against the dye described above. When the transferable materials are those having no dye receptivity such as papers, metals, glasses and synthetic resins, a dye-receptive layer may be formed or at least one surface thereof.

Means for imparting a heat energy used in carrying out thermal transfer using the present thermal transfer sheet as described above and the recordable material as described above may be any of the prior known means. For example, a required purpose can be achieved by imparting a heat energy of the order of from 5 to 100 $mJ/mm^2$ by controlling the recording time vic a recording device such as a thermal printer (e.g., Video Printer VY-100 manufactured by Hitachi Seisakusho).

EXAMPLES 384 THROUGH 393

Ink compositions for forming a three-color dye layer having the following composition was prepared. The ink composition was applied to a polyethylene terephthalate film having a thickness of 6 micrometers (wherein its back surface had been treated to provide heat resistance) so that the each ink composition was superficially successively applied in sequence of yellow, magenta and cyan ink compositions at a width of 30 cm and so that each dry coating weight was 1.0 gram per square meter. The whole was dried to obtain a three-color thermal transfer sheet for full color according to the present invention. The combinations of the three-color dyes are as shown in Table 39.

| | |
|---|---|
| Yellow Ink Composition | |
| Yellow dye shown in Table 34 or 35 | 3 parts |
| Polyvinyl butyral resin | 4 parts |
| Toluene | 50 parts |
| Methyl ethyl ketone | 43 parts |
| Magenta Ink Composition | |
| Magenta dye shown in Table 36 | 3 parts |
| Polyvinyl butyral resin | 4 parts |
| Toluene | 50 parts |
| Methyl ethyl ketone | 43 parts |
| Cyan Ink Composition | |
| Cyan dye shown in Table 37 or 38 | 3 parts |
| Polyvinyl butyral resin | 4 parts |
| Toluene | 50 parts |
| Methyl ethyl ketone | 43 parts |

insoluble, a solvent such as DMF, dioxane or chloroform was suitably used.

TABLE 39

| Ex. | Yellow Dye | Magenta Dye | Cyan Dye |
|---|---|---|---|
| Ex. 384 | Y-1 | M-1 | C-1 |
| Ex. 385 | Y-1 | M-2 | C-2 |
| Ex. 386 | Y-2 | M-3 | C-3 |
| Ex. 387 | Y-5 | M-3 | C-4 |
| Ex. 388 | Y-1 | M-4 | C-1 |
| Ex. 389 | Y-4 | M-5 | C-5 |
| Ex. 390 | Y-1 | 2-1 | (C-1) + (C-2) (7:3) |
| Ex. 391 | Y-1 | (M + 1) + (1-amino-2-phenoxy-4-hydroxy anthraquinone (1:1) | C-1 |
| Ex. 392 | Y-1 | (M + 1) + (1-amino-2-phenoxy-4-hydroxy anthraquinone (1:1) | C-6 |
| Ex. 393 | Y-6 | (M + 1) + (1-amino-2-phenoxy-4-hydroxy anthraquinone (1:1) | C-6 |

COMPARATIVE EXAMPLE 52

A thermal transfer sheet of this Comparative Example was obtained as in Examples 384 through 390 except that the following three-color dyes were used in place of the three-color dyes of Examples.

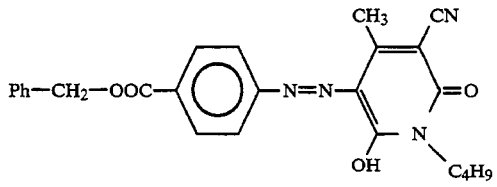

Magenta Dye

A 1:1 (weight ratio) mixture of 1-amino-2-phenoxy-4-hydroxyanthraquinone and 1,4-diamino-2,3-diphenoxyanthraquinone

Cyan Dye 1-3-(Methylphenyl) amino-4-methylaminoanthraquinone

Synthetic paper (Yupo FPG #150 manufactured by Oji Yuka) was used as a base sheet. A coating solution having the following composition was applied to the one surface of the base sheet so that its dry coating weight was 10.0 grams per square meter. The whole was dried for 30 minutes at 100° C. to obtain a transferable material.

| | |
|---|---|
| Polyester resin (Vylon 200 manufactured by Toyobo) | 11.5 parts |
| Vinyl chloride-vinyl acetate copolymer (VYHH manufactured by U.C.C.) | 5.0 parts |
| Amino-modified silicone (KF-393 manufactured by Shin-etsu Kagaku Kogyo) | 1.2 parts |
| Epoxy-modified silicone (X-22-343 manufactured by Shin-etsu Kagaku Kogyo) | 1.2 parts |
| Methly ethyl ketone/toluene/cyclohexanone (weight ratio of 4:4:2) | 102.0 parts |

Thermal Transfer Recording Test

The above thermal transfer sheets of the present invention and comparative Example and the transferable materials described above were stacked with the dye-containing layer opposing to the dye-receptive surface. Recording was carried out in sequence of yellow, magenta and cyan dyes by means of a thermal head from the back surface of the thermal transfer sheet under a head application voltage of 11 V for a maximum application time of 16 msec. The resulting full color images were visually examined to evaluate color reproducibility on the the following criteria. The results are shown in Table 40.

○: very clear x: unclear

Light Fastness Test

A light fastness test of the full color images obtained in the thermal transfer test described above was carried out by means of a xenon fadeometer (Ci 35 A manufactured by Atlas)(the black panel temperature being 50° C. and the illuminance being 50 k Lux).

○: no fading in the case of the irradiation time of 50 hr.

x: remarkable fading in the case of the irradiation time of 50 hr.

Measurement of Color Density

Figure 2:
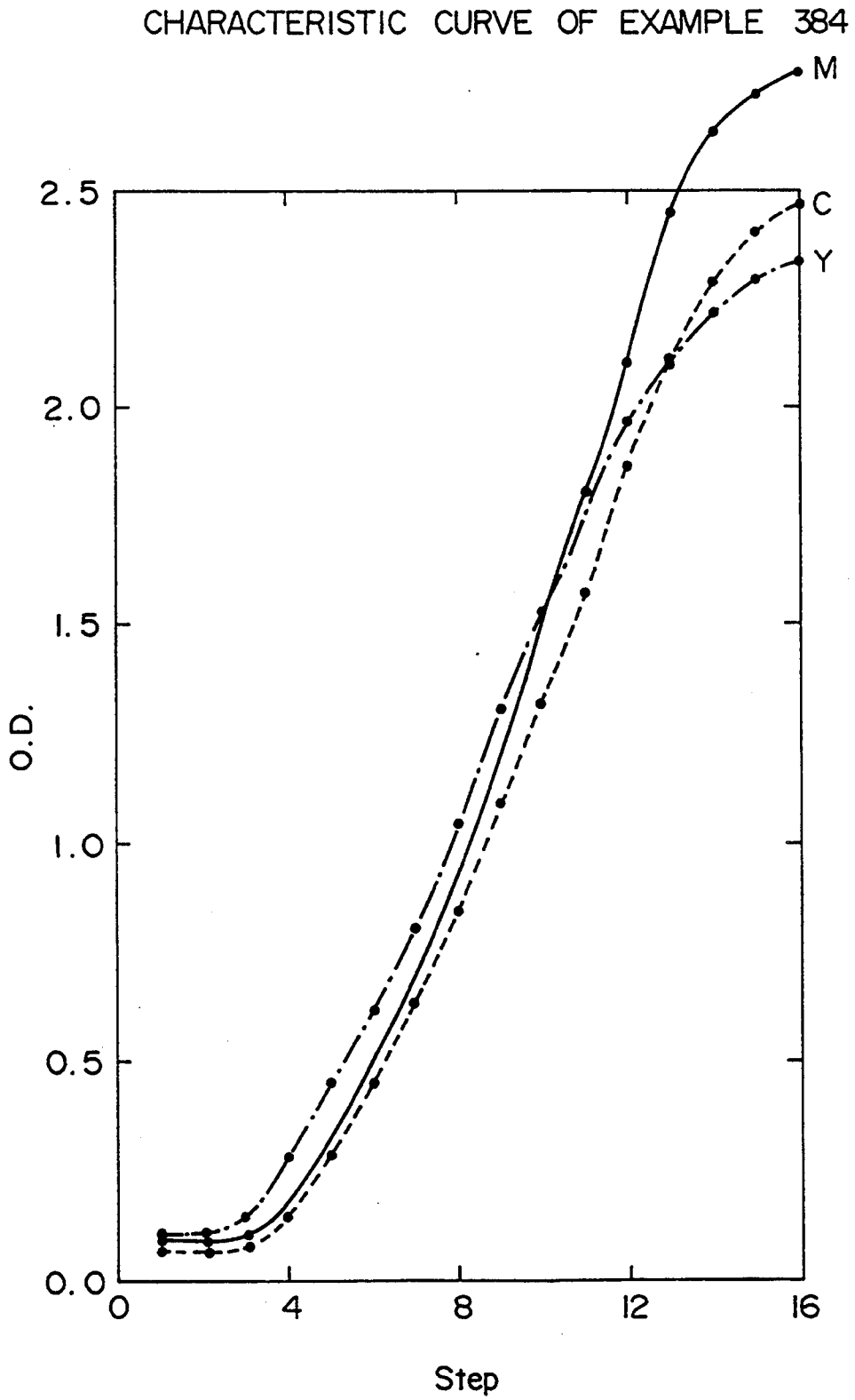
FIG. 2 is a view showing a characteristic curve of the portions of three primary colors of Example 384.
Figure 3:
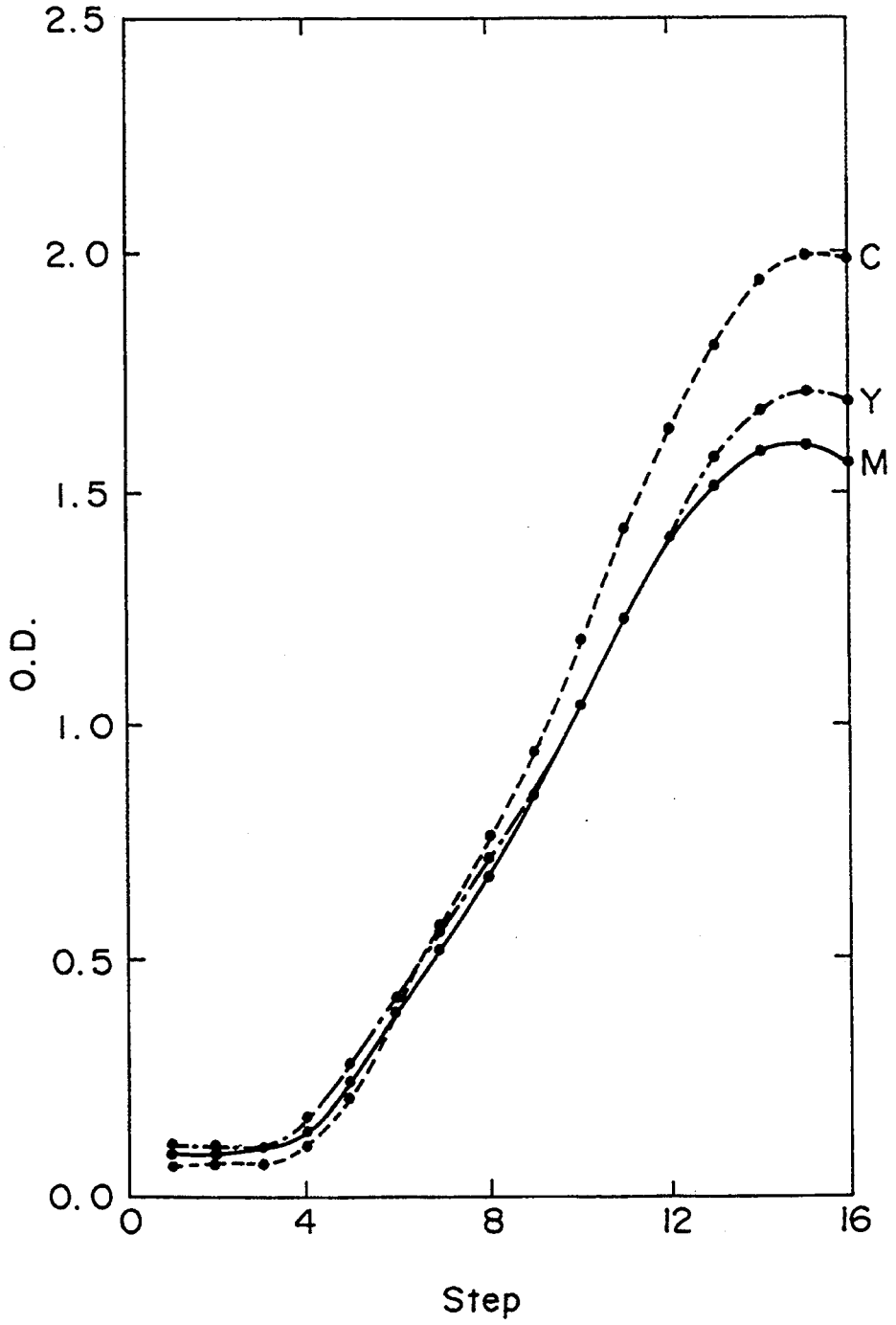
FIG. 3 is a view showing a characteristic curve of the portions of three primary colors of Comparative Example 52.

The maximum B/W density of the achromatic portions of the full color images obtained in the thermal transfer recording test described above was measured by means of a densitometer RD-918 manufactured by U.S. Macbeth Company. The results are shown in the following Table 40. The characteristic curves of the three primary color portions of Example 384 and Comparative Example 52 are shown in FIGS. 2 and 3, respectively.

Measurement of Color Reproducibility

Figure 4:
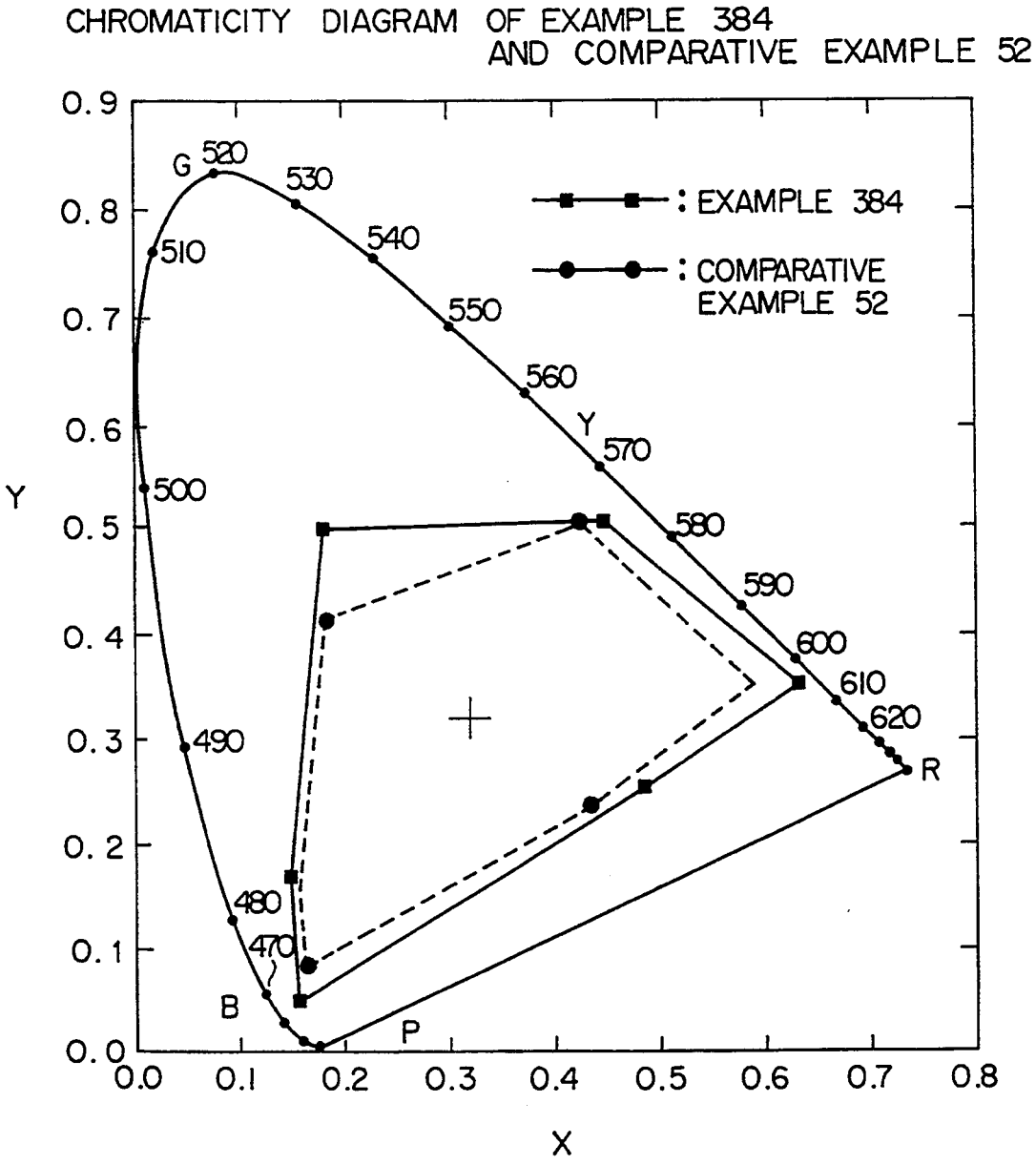
FIG. 4 is a view showing a color reproduction range of Example 384 and Comparative Example 52.

The color reproduction ranges of Example 384 and Comparative Example 52 were measured by means of a color difference meter CR-221 manufactured by Minoruta. The results are shown in FIG. 4.

TABLE 40

| Ex. | Color Reproducibility | Light fastness | Maximum B/W Density |
|---|---|---|---|
| Ex. 384 | ○ | ○ | 1.78 |
| Ex. 385 | ○ | ○ | 1.84 |
| Ex. 386 | ○ | ○ | 1.81 |
| Ex. 387 | ○ | ○ | 1.82 |
| Ex. 388 | ○ | ○ | 1.86 |
| Ex. 389 | ○ | ○ | 1.88 |
| Ex. 390 | ○ | ○ | 1.87 |
| Ex. 391 | ○ | ○ | 1.85 |
| Ex. 392 | ○ | ○ | 1.86 |
| Ex. 393 | ○ | ○ | 1.88 |
| Com. Ex. 52 | X | X | 1.43 |

According to the present invention as described above, there can be provided the thermal transfer sheets capable of forming the full color images having excellent color density, clearness, color reproducibility and fastnesses, particularly light fastness by using the specific yellow, magenta and cyan dyes in combination.

A preferred embodiment of a cyan thermal transfer sheet illustrates the present invention in more detail.

Of the dyes represented by the general formulae (27) and (28) described above, examples of the particularly preferred dyes for use in the present invention are shown in the following Tables 41 and 42.

TABLE 41

| | Dye of the general formula (27) | | | | |
|---|---|---|---|---|---|
| No. | $R_1$ | $R_2$ | $R_3$ | $R_4$ | $R_5$ |
| 1 | —NHCOCH$_3$ | —CH$_3$ | —CH$_3$ | —C$_2$H$_5$ | —C$_2$H$_5$ |
| 2 | —NHCOPh | —CH$_3$ | —CH$_3$ | —C$_2$H$_5$ | —C$_2$H$_5$ |
| 3 | —NHCOCH$_3$ | —C$_2$H$_5$ | —OC$_2$H$_5$ | —C$_2$H$_5$ | —C$_2$H$_4$OH |

TABLE 42

| | Dye of the general formula (28) | |
|---|---|---|
| No. | $R_6$ | $R_7$ |
| 1 | —H | —H |

TABLE 42-continued

| | Dye of the general formula (28) | |
|---|---|---|
| No. | $R_6$ | $R_7$ |
| 2 | —H | 3-CH$_3$ |
| 3 | 4-CH$_3$ | 4-Cl |

EXAMPLES 394 THROUGH 396

Example 294 was repeated except that the ink composition was replaced with the following composition. The results are shown in Table 43.

| | |
|---|---|
| Dye of the formula (27) | "a" parts |
| Dye of the formula (28) | "b" parts |
| Polyvinyl butyral resin | 4.5 parts |
| Methyl ethyl ketone | 45.75 parts |
| Toluene | 45.75 parts |

TABLE 43

| | Dye of Formula (27) | | Dye of Formula (28) | | | |
|---|---|---|---|---|---|---|
| Ex. | No. | Amount used "a" | No. | Amount used "b" | color Density | Light Fastness |
| 394 | 1 | 3.7 | 1 | 0.3 | 1.92 | ○ |
| 395 | 1 | 3.8 | 2 | 0.2 | 1.94 | ○ |
| 396 | 2 | 3.8 | 3 | 0.2 | 1.90 | ○ |

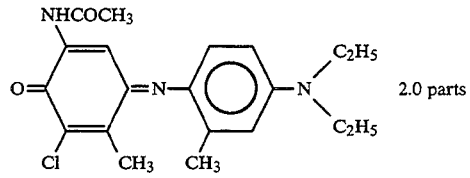

2.0 parts

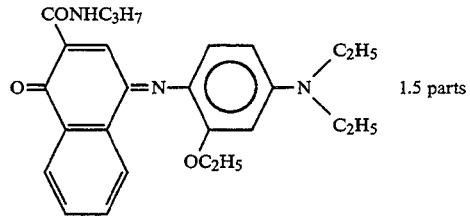

1.5 parts

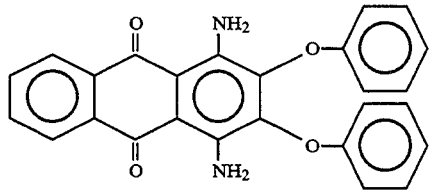

0.5 parts

Color density 1.87
Light fastness ○

What is claimed is:

1. A thermal transfer sheet comprising a base sheet and a dye-containing layer formed on one surface of said base sheet wherein a magenta dye included in said dye-containing layer is a mixture of (i) at least one anthraquinone dye represented by the following formulae (5) through (8):

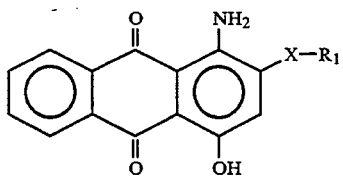
(5)

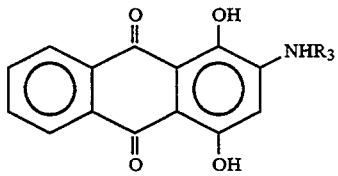
(6)

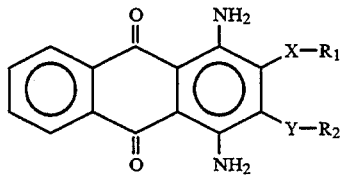
(7)

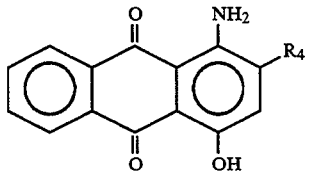
(8)

wherein X and Y represent —S—, —O—, or —$SO_2$; $R_1$, $R_2$ and $R_3$ represent a substituted or unsubstituted alkyl, cycloalkyl, aryl or allyl group, and $R_4$ represent a halogen atom or a cyano group and;

(ii) at least one polymethine dye represented by the following formula (9):

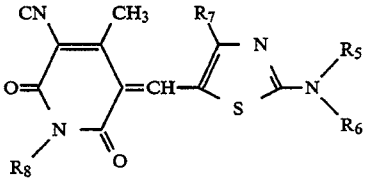
(9)

wherein $R_5$ and $R_6$ represent a substituted or unsubstituted alkyl; $R_7$ represents a substituted or unsubstituted aryl group or a substituted or unsubstituted aromatic heterocyclic group; $R_8$ represents a substituted or unsubstituted alkyl or cycloalkyl group or $NR_9R_{10}$; and $R_9$ and $R_{10}$ represent a substituted or unsubstituted alkylcarbonyl group or a substituted or unsubstituted arylcarbonyl group.

2. A black thermal transfer sheet comprising a base sheet and a dye layer containing a plurality of dyes which is formed on one surface of said base sheet wherein said dye layer contains at least one dye represented by the following general formulae (17) and (18), at least one dye represented by the following general formula (19) and at least one dye represented by the following general formulae (20) and (21):

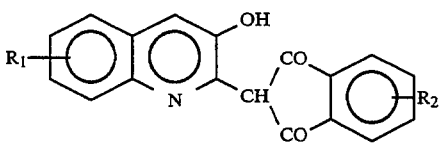
(17)

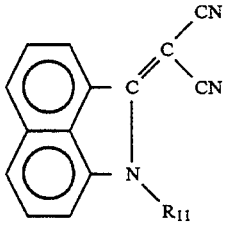
(18)

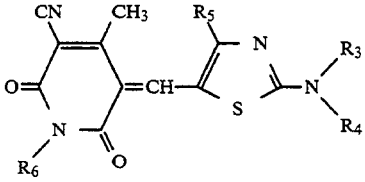
(19)

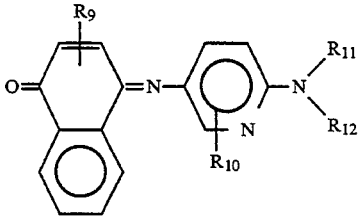
(20)

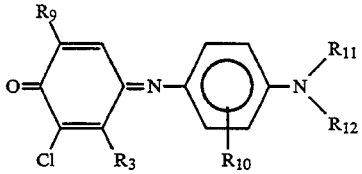
(21)

wherein $R_1$ represents a substituted or unsubstituted alkyl or alkoxy group; $R_2$ represents an alkoxycarbonyl, mono- or di-alkylaminocarbonyl, alkoxy, alkoxyalkoxy, alkyl, cycloalkyl or heterocyclic group; $R_3$ and $R_4$ represent a substituted or unsubstituted alkyl group; $R_5$ represents a substituted or unsubstituted aryl group or a substituted or unsubstituted aromatic heterocyclic group; $R_6$ represents a substituted or unsubstituted alkyl or cycloalkyl group or $NR_7R_8$; $R_7$ and $R_8$ represent a substituted or unsubstituted alkylcarbonyl group or a substituted or unsubstituted arylcarbonyl group; $R_{11}$ and $R_{12}$ represent a substituted or unsubstituted alkyl, aryl, cycloalkyl or vinyl group; $R_9$ represents CONHR, NHCOR, $SO_2NHR$, or $NHSO_2R$ in which R represents a substituted or unsubstituted alkyl, cycloalkyl, aryl or aromatic heterocyclic group; and $R_{10}$ represents a substituted or unsubstituted alkyl, alkoxy, alkylcarbonylamino, alkylsulfonylamino, carbamoyl or sulfamoyl group, a hydrogen atom, or a halogen atom.

3. A thermal transfer sheet comprising a base sheet and at least three color layers of yellow, magenta, and cyan formed on one surface of said base sheet and wherein said at least three-color dye layer contains at least one dye represented by the following formulae (22) and (23) as the yellow dye, at least one dye represented by the following formula (24) as the magenta dye and at least one dye represented by the following formulae (25) and (26) as the cyan dye:

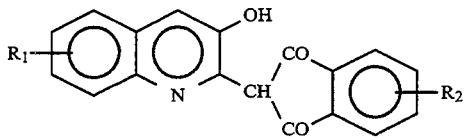

(22)

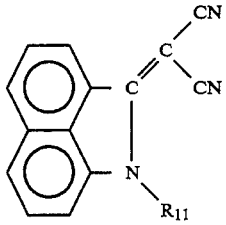

(23)

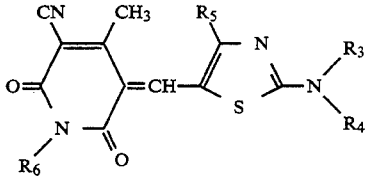

(24)

-continued

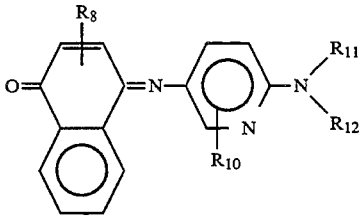

(25)

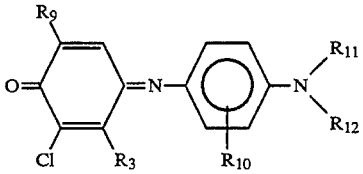

(26)

wherein $R_1$ and $R_{10}$ represent a substituted or unsubstituted alkyl or alkoxy group; $R_2$ represents an alkoxycarbonyl, mono- or di-alkylaminocarbonyl, alkoxy, alkoxyalkoxy, alkyl, or cycloalkyl group; $R_3$ and $R_4$ represent a substituted or unsubstituted alkyl group; $R_5$ represents a substituted or unsubstituted aryl group or a substituted or unsubstituted aromatic heterocyclic group; $R_6$ represents a substituted or unsubstituted alkyl or cycloalkyl group or $NH_7R_8$; $R_7$ and $R_8$ represent a substituted or unsubstituted alkylcarbonyl group or a substituted or unsubstituted arylcarbonyl group; $R_{11}$ and $R_{12}$ represent substituted or unsubstituted alkyl, or aryl group; $R_9$ represents CONHR, NHCOR, $SO_2NHR$, or $NHSO_2R$ in which R represents a substituted or unsubstituted alkyl, alkoxy, alkylcarbonylamino, alkylsulfonylamino, carbamoyl or sulfamoyl group, a hydrogen atom, or a halogen atom.

* * * * *